US010741007B2

(12) United States Patent
Andres

(10) Patent No.: US 10,741,007 B2
(45) **Date of Patent: *Aug. 11, 2020**

(54) SYSTEM AND METHOD FOR DYNAMICALLY PRESENTING LIVE REMOTE DEALER GAMES

(71) Applicant: Progressive Games Partners LLC, Douglas (IM)

(72) Inventor: Neal C. Andres, Gilbert, AZ (US)

(73) Assignee: Progressive Games Partners LLC, Douglas (IM)

( * ) Notice: Subject to any disclaimer, the term of this patent is extended or adjusted under 35 U.S.C. 154(b) by 0 days.

This patent is subject to a terminal disclaimer.

(21) Appl. No.: 15/910,816

(22) Filed: Mar. 2, 2018

(65) Prior Publication Data

US 2018/0261039 A1 Sep. 13, 2018

Related U.S. Application Data

(63) Continuation of application No. 14/892,931, filed as application No. PCT/US2014/038808 on May 20, 2014, now Pat. No. 9,959,701.

(60) Provisional application No. 61/825,893, filed on May 21, 2013.

(51) Int. Cl.
*G07F 17/32* (2006.01)

(52) U.S. Cl.
CPC ..... *G07F 17/3211* (2013.01); *G07F 17/326* (2013.01); *G07F 17/3267* (2013.01); *G07F 17/3293* (2013.01)

(58) Field of Classification Search
CPC ..... G07F 17/32; G07F 17/322; G07F 17/326; G07F 17/3293; A63F 1/00; A63F 3/00157; A63F 2001/003; A63F 2001/005
See application file for complete search history.

(56) References Cited

U.S. PATENT DOCUMENTS

| | | | | |
|---|---|---|---|---|
| 5,770,533 | A | 6/1998 | Franchi | |
| 5,800,268 | A | 9/1998 | Molnick | |
| 6,062,564 | A * | 5/2000 | Terminel | A63F 3/00157 273/292 |
| 7,727,060 | B2 | 6/2010 | Mills | |
| 8,152,641 | B2 | 4/2012 | Hill | |

(Continued)

OTHER PUBLICATIONS

International Search Report and Written Opinion (International Application No. PCT/US2014/38808; O/R: 068446.00004); dated Apr. 16, 2015.

*Primary Examiner* — Milap Shah
(74) *Attorney, Agent, or Firm* — Howard & Howard Attorneys PLLC

(57) ABSTRACT

A system for allowing players to play a plurality of games is described herein. The system includes a display device for displaying games to a player and a controller that is coupled to the display device. The controller is configured to display at least one of a first game and a second game on the display device, receive an image of a physical gaming table, and display the gaming table on the display device. The controller receives a signal indicative of a first player hand being dealt by the dealer, receives a signal indicative of a second player hand being dealt by the dealer, determines a first outcome of the first game as a function of the first player hand, and determines a second outcome of the second game as a function of the second player hand.

17 Claims, 50 Drawing Sheets

(56) References Cited

U.S. PATENT DOCUMENTS

| | | | | |
|---|---|---|---|---|
| 8,348,763 | B2 | 1/2013 | Moshal et al. | |
| 8,727,892 | B1 * | 5/2014 | Chun | G07F 17/3276 463/25 |
| 8,727,982 | B2 | 5/2014 | Chun | |
| 8,821,239 | B1 | 9/2014 | Chun | |
| 9,153,093 | B2 | 10/2015 | Hartley | |
| 9,836,916 | B2 | 12/2017 | Koza et al. | |
| 9,959,701 | B2 * | 5/2018 | Andres | G07F 17/3211 |
| 2002/0094869 | A1 | 7/2002 | Harkham | |
| 2003/0232651 | A1 | 12/2003 | Huard et al. | |
| 2003/0236113 | A1 | 12/2003 | Webb | |
| 2006/0217199 | A1 | 9/2006 | Adcox et al. | |
| 2007/0015583 | A1 | 1/2007 | Tran | |
| 2007/0060259 | A1 | 3/2007 | Pececnik | |
| 2007/0178955 | A1 | 8/2007 | Mills | |
| 2008/0026807 | A1 | 1/2008 | Moshal et al. | |
| 2008/0032798 | A1 | 2/2008 | Hatamian et al. | |
| 2008/0194334 | A1 | 8/2008 | Kuok et al. | |
| 2009/0291762 | A1 | 11/2009 | Walker | |
| 2011/0130184 | A1 | 6/2011 | Mills | |
| 2011/0177854 | A1 | 7/2011 | Kennedy | |
| 2011/0300917 | A1 | 12/2011 | Hill | |
| 2012/0238337 | A1 | 9/2012 | French | |
| 2013/0116033 | A1 | 5/2013 | Nicely | |
| 2013/0196777 | A1 | 8/2013 | Hill | |
| 2014/0094234 | A1 | 4/2014 | Chun | |
| 2014/0274253 | A1 * | 9/2014 | Chun | G06F 17/3225 463/11 |
| 2016/0012663 | A1 * | 1/2016 | Chun | G06F 17/322 463/16 |
| 2016/0310831 | A1 * | 10/2016 | Chun | A63F 1/067 |

* cited by examiner

SYSTEM AND METHOD FOR DYNAMICALLY PRESENTING LIVE REMOTE DEALER GAMES

CROSS REFERENCE TO RELATED APPLICATION

This application is a continuation of U.S. patent application Ser. No. 14/892,931, filed Nov. 20, 2015, which is a national stage application of PCT/US2014/038808, filed May 20, 2014 which claims the benefit of U.S. Provisional Patent Application Ser. No. 61/825,893, filed May 21, 2013, the disclosures of which are hereby incorporated by reference in its entirety.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for dynamically presenting live remote dealer games, and more particularly, to a system and method for providing additional features to live remote dealer games.

BACKGROUND OF THE INVENTION

One form of popular online game is generally referred to as, live remote dealer. In this form of gaming, a live dealer is located at a central location. The game may be a card game, such as black jack or some other form of gaming. In a live remote game, the players want to see the dealer performing the actions related to the game. Video of the dealer performing these actions is streamed or otherwise delivered to a display screen located near the remote player. The purpose of the live remote dealer is to replace the computer based random number generator (RNG) in the online form of gaming. The audience in live remote dealer gaming wants to actually see the cards being dealt so the business model has come around in the last few years where studios have been set up where the camera is directed towards the dealer to capture images of the dealer pulling cards from a shoe and displaying the cards on the table. A video camera may also be focused or aimed at the hand being dealt. In addition, some live remote dealer systems include video cameras positioned within a casino to capture images of dealer at a live casino table game. The output from the video camera is displayed on a display, such as the display of computer, located near the player so that the player can actually see the cards as the cards are dealt into their player position.

Live remote dealer gaming is aimed at an audience that does not like or will not gamble using on-line games or systems which utilize RNGs or computers to generate the game outcome. In addition, live remote dealer gaming may provide a more exciting gaming experience for the player over known computer simulated casino games, by providing a real time video image of the dealer and/or gaming table.

However, the live remote dealer gaming model is generally more expensive than online models which utilize RNG because it replicates the live casino environment. In an online system which do not use a live dealer, the system could have one or 10,000 people playing blackjack at once with little or very little additional cost. With a live dealer, an employee or dealer must stand at the table, if there is only one person playing, that dealer's time is amortized over one. The maximum is just amortizing it over a predetermined number of players (based on the game being played), e.g., seven, in general, for games in which the player plays against the dealer, such as blackjack, or some poker. In addition, the number of players that may play table games at a casino and/or gaming establishment is limited to the physical floor space of the gaming establishment that is dedicated to the table games. In addition, casinos/gaming establishments may offer different types of blackjack-type card games with different betting methods, different dealing methods, and/or different side-bets such as Progressive Blackjack, Lucky Lucky Blackjack, and Lucky Ladies Blackjack. Each type of blackjack game is provided with at least one live dealer and a physical table for each type of game. Thus, if a casino provides three blackjack games, e.g. Progressive Blackjack, Lucky Lucky Blackjack, and Lucky Ladies Blackjack, the casino must provide at least 3 dealers, each dealer operating a different physical table. If there is only one player for each type of game, then there exists a 1 dealer to 1 player ratio, which is uneconomical.

The present invention is aimed at one or more of the problems identified above.

SUMMARY OF THE INVENTION

The invention is generally directed to systems and methods for allowing players to play live remote dealer games that allow a player to play a plurality of games with a remote gaming device.

In one aspect of the invention, a system for allowing players to play a plurality of games is provided. The system includes a remote device for displaying games to a player and a controller that is coupled to the remote device. The controller is configured to display at least one of a first game and a second game on the remote device, receive an image of a physical gaming table, and display the gaming table on the remote device. The image includes a dealer for distributing a plurality of player hands. Each of the player hands is dealt from a deck of randomly-ordered physical playing cards. The controller receives a signal indicative of a first player hand being dealt by the dealer, receives a signal indicative of a second player hand being dealt by the dealer, determines a first outcome of the first game as a function of the first player hand, and determines a second outcome of the second game as a function of the second player hand.

In another aspect of the invention, a method for allowing players to play a plurality of games is provided. The method includes the steps of displaying at least one of a first game and a second game on a remote device, receiving an image of a physical gaming table, and displaying the gaming table on the remote device. The image includes a dealer for distributing a plurality of player hands. Each of the player hands is dealt from a deck of randomly-ordered physical playing cards. The method includes receiving a signal indicative of a first player hand being dealt by the dealer, receiving a signal indicative of a second player hand being dealt by the dealer, determining a first outcome of the first game as a function of the first player hand, and determining a second outcome of the second game as a function of the second player hand.

In yet another aspect of the invention, one or more non-transitory computer-readable storage media, having computer-executable instructions embodied thereon is provided. The computer-executable instructions, when executed by at least one processor, cause the processor to display at least one of a first game and a second game on a remote device, receive an image of a physical gaming table, and display the gaming table on the remote device. The image includes a dealer for distributing a plurality of player hands. Each of the player hands is dealt from a deck of randomly-ordered physical playing cards. The processor receives a signal indicative of a first player hand being dealt by the dealer, receives a signal indicative of a second player hand being dealt by the dealer, determines a first outcome of the first game as a function of the first player hand, and determines a second outcome of the second game as a function of the second player hand.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
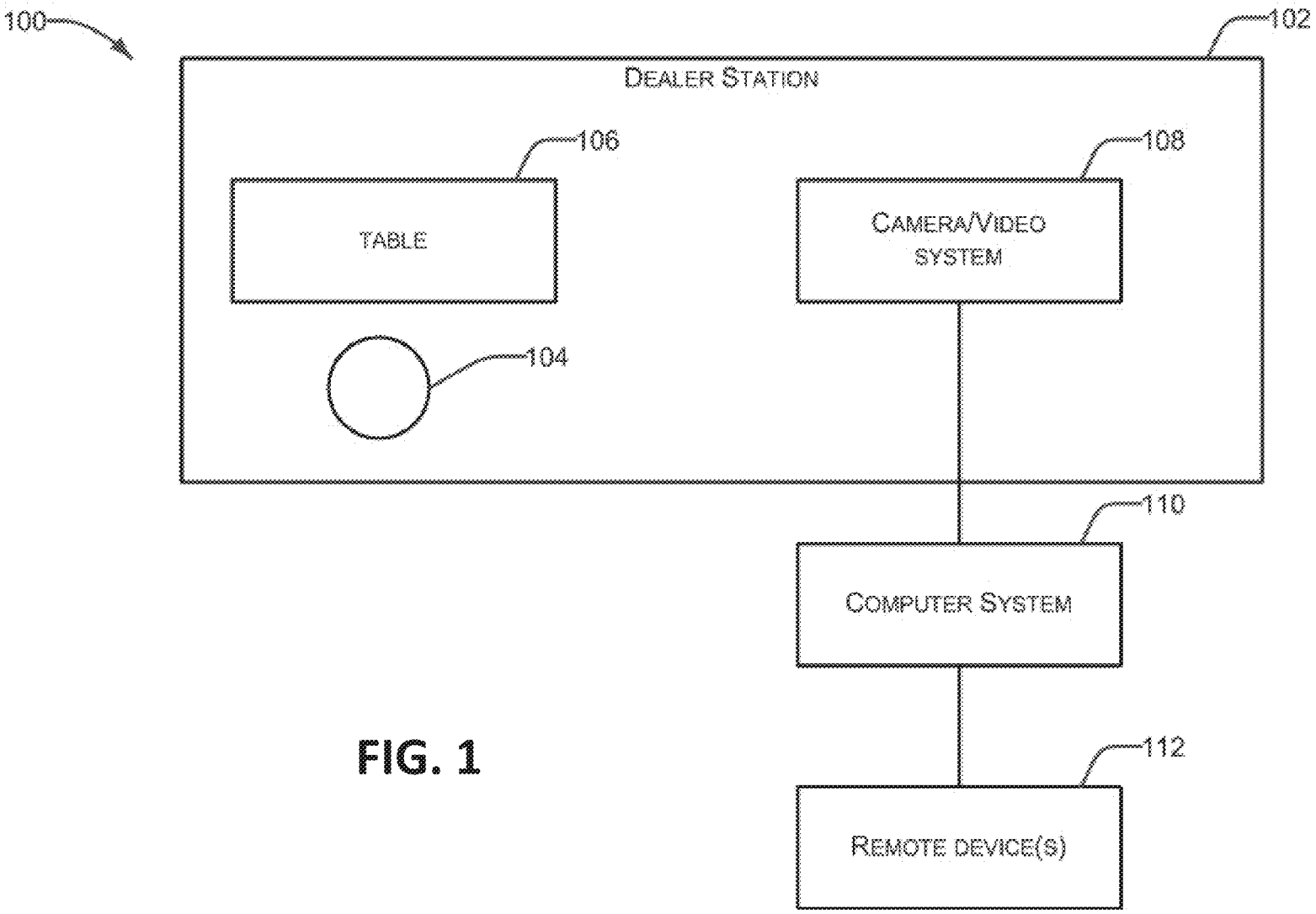
FIG. 1 is a schematic representation of an exemplary system for allowing a player to play live remote dealer games, according to an embodiment of the invention.

The exemplary embodiments herein relate to live remote dealer games. It should be understood that each of the methods and individual steps recited herein may be partially or wholly carried out in a variety of ways and/or systems, which may include, but are not limited to, a live dealer physically dealing playing cards, an electronic gaming machine (EGM) for use by one or more players, a multi-player platform which may include a player interface such as a touchscreen display and involve physical or virtual game symbols, a home computer and/or portable computing device, such as a tablet computer or mobile phone capable of communicating with a network or over the Internet, global telecommunication network or world wide web.

With reference to the drawings and in operation, the invention overcomes at least some of the disadvantages of known systems by providing, among other things, systems and methods which enable a player to play a plurality of live dealer games with a remote device. More specifically, the system includes a controller that is configured to display a live dealer and associated gaming table on a remote device and display one or more games being played with playing cards being dealt by the dealer on the remote device. Moreover, the system may display simulated images on the remote device of the playing cards being dealt to a player station located on the gaming table and allow the player to place wagers on the corresponding player hands formed by the dealt cards. In addition, the system allows a player to select and play a different game associated with each player station such that each game is played with different game rules and uses the same dealer for distributing the player hands to each of the player stations.

The system may also allow several players to place wagers on a single player hand. For example, the system may allow a first player to place a wager and play a game with an associated player hand including allowing the first player to make decisions relating to the player hand based on the rules associate with the game being played by the first player. The system also allows a plurality of different players to play a plurality of different games with the first player's player hand. For example, the system may allow different player's to player different side bets on the outcome associated with the player hand such as, for example, side bets on the type/value cards being dealt in the player hand and/or the type/value of cards being dealt in a dealer hand.

By providing a system that allows a player to play different games having different game rules using the same dealer, the costs of providing the corresponding games is reduced and the excitement of the player is increased. Thus, the amount of time that the remote devices are played by the players, and the revenue being generated by the games, is increased.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Referring to the Figures, wherein like numerals indicate like or corresponding parts throughout the several views, a system and method provides live dealer games to one or more remote locations from a central location.

In one aspect of the present invention, the system and method of the present invention allows a single live table to be branded or identified as different games to maximize usage of the live table.

As shown in FIG. 1, the system 100 includes a dealer station 102. The dealer station 102 will be dependent upon the game being played. In general, the dealer station 102 may include a dealer 104, a table 106 and a camera or video station 108. The system 100 may also include a computer system 110, coupled to the camera or video system 108, which administers the game being played and which forwards or streams video from the video system 108 to one or more remote stations 112 (see below). The remote stations 112 may be personal computers, laptop computers, tablets, mobile phones, or any other suitable device. The computer system 110 sends information to, and receives information from the remote stations 112 to administer the game, e.g., by relaying game information to the remote stations 112, and to receive from the remote stations 112, game instructions received from the respective player. The computer system 110 may be connected to the remote stations 112 through a computer network, such as the Internet.

With reference to FIGS. 1A-20B, sample or exemplary display screens of the remote stations 112 are shown. In general, FIGS. 1A, 2A, 3A, . . . 20A, show graphical representations of the display screens, while FIGS. 1B, 2B, 3B, . . . 20B are block diagrams illustrating the relevant components of the display screen in the corresponding FIGS. 1A, 2A, 3A, . . . 20A, respectively.

With reference to FIGS. 1A, 1B, 2A, 2B, 3A, and 3B, in one aspect of the present invention a live remote dealer which allows a single live (human) dealer to present one or more different games to different players. In one aspect of the present invention, the system displays to each player one or more video streams of the live dealer (one of which may include the dealer's cards and the cards of all of the players), a graphic representation of each player's chips and wagers, and an identifying indicia, e.g., a logo, of the game being played by the respective player.

Figure 1A:
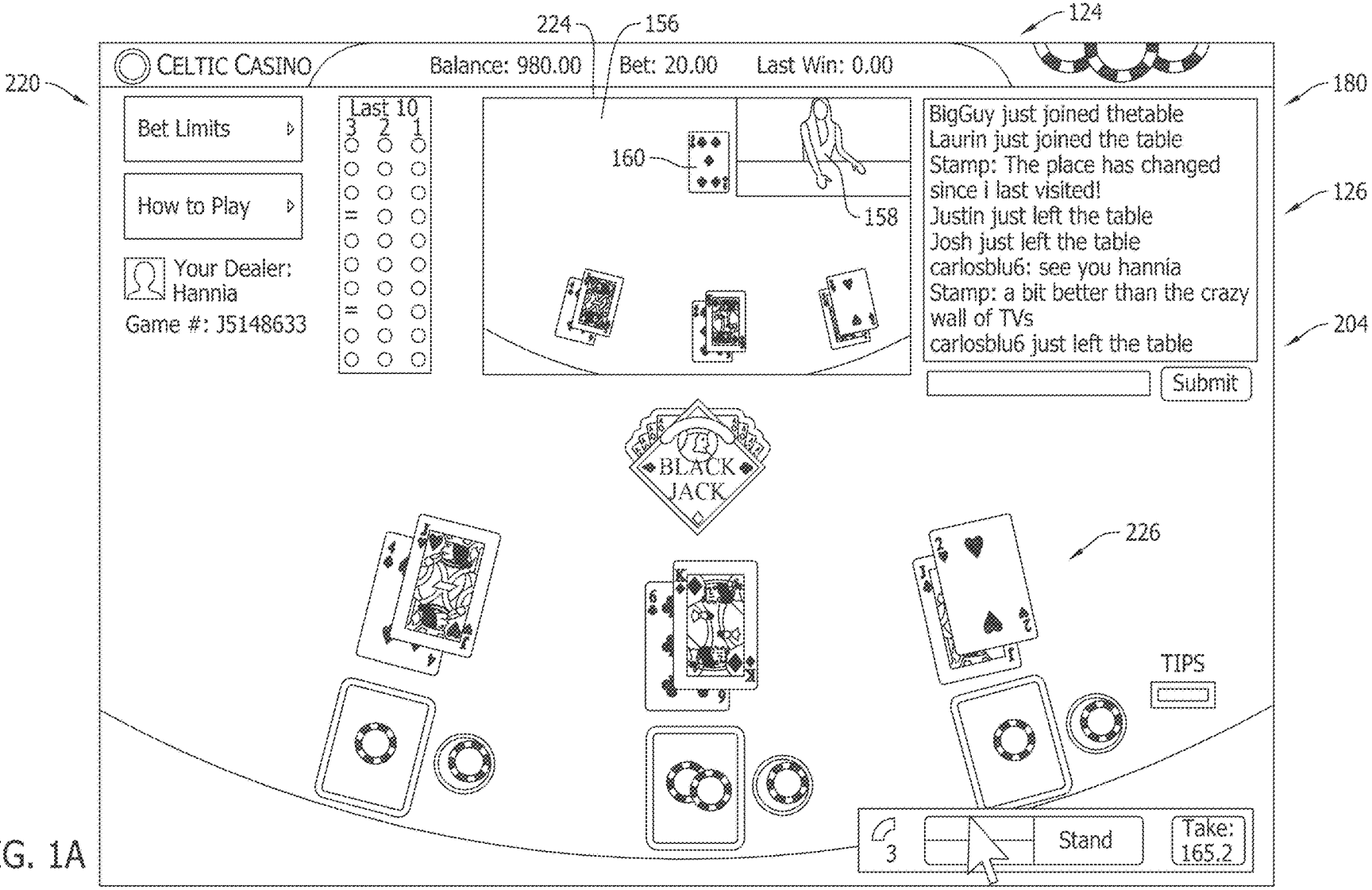
FIG. 1A is a graphical display of a live remote dealer game that may be displayed with the system shown in FIG. 1.
Figure 1B:
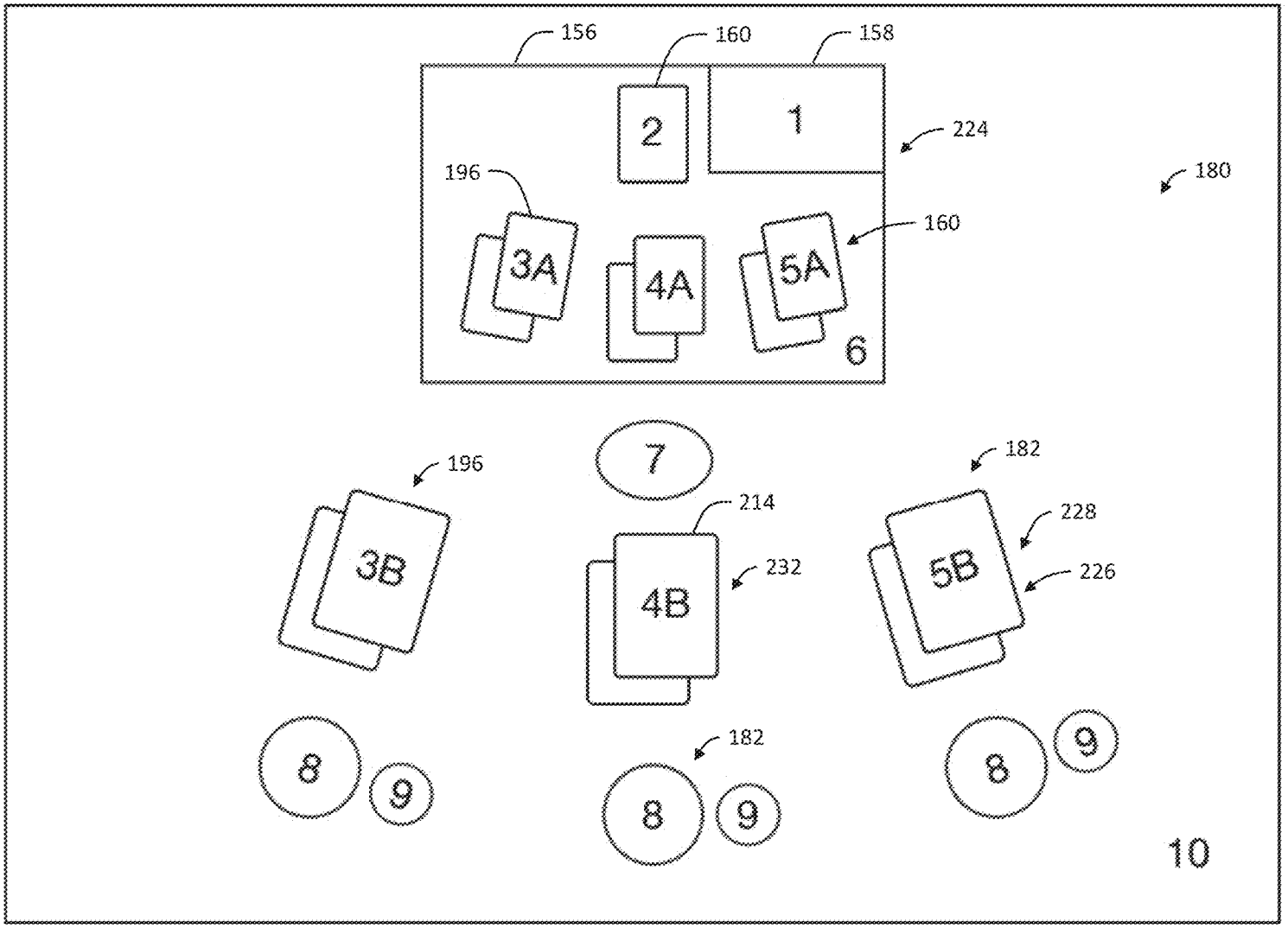
FIG. 1B is a schematic block diagram illustrating graphical components being displayed with the graphic display shown in FIG. 1A.
Figure 2A:
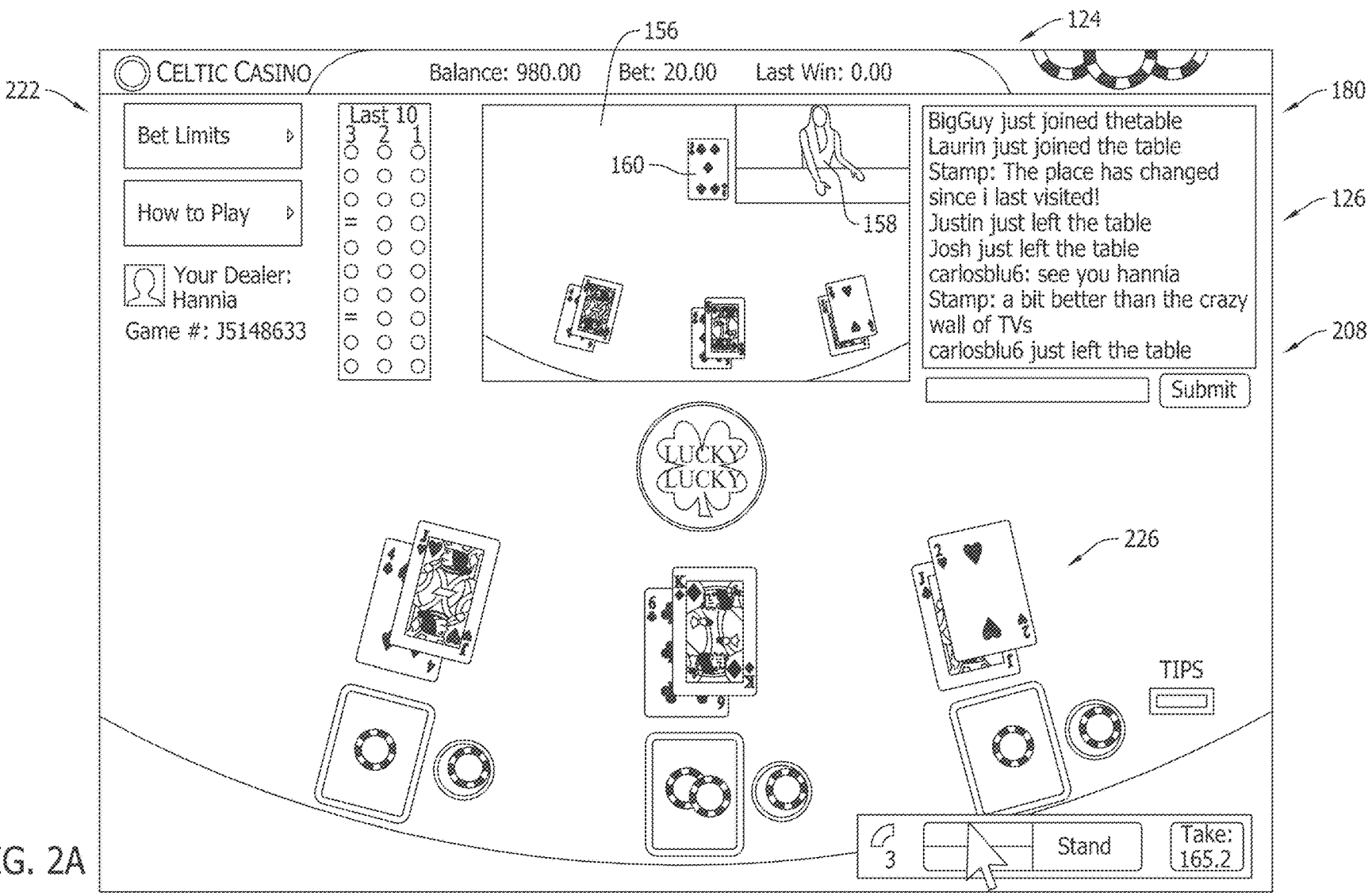
FIGS. 2A-20B are graphical displays and corresponding schematic block diagrams of the live remote dealer game that may be displayed with the system shown in FIG. 1.
Figure 2B:
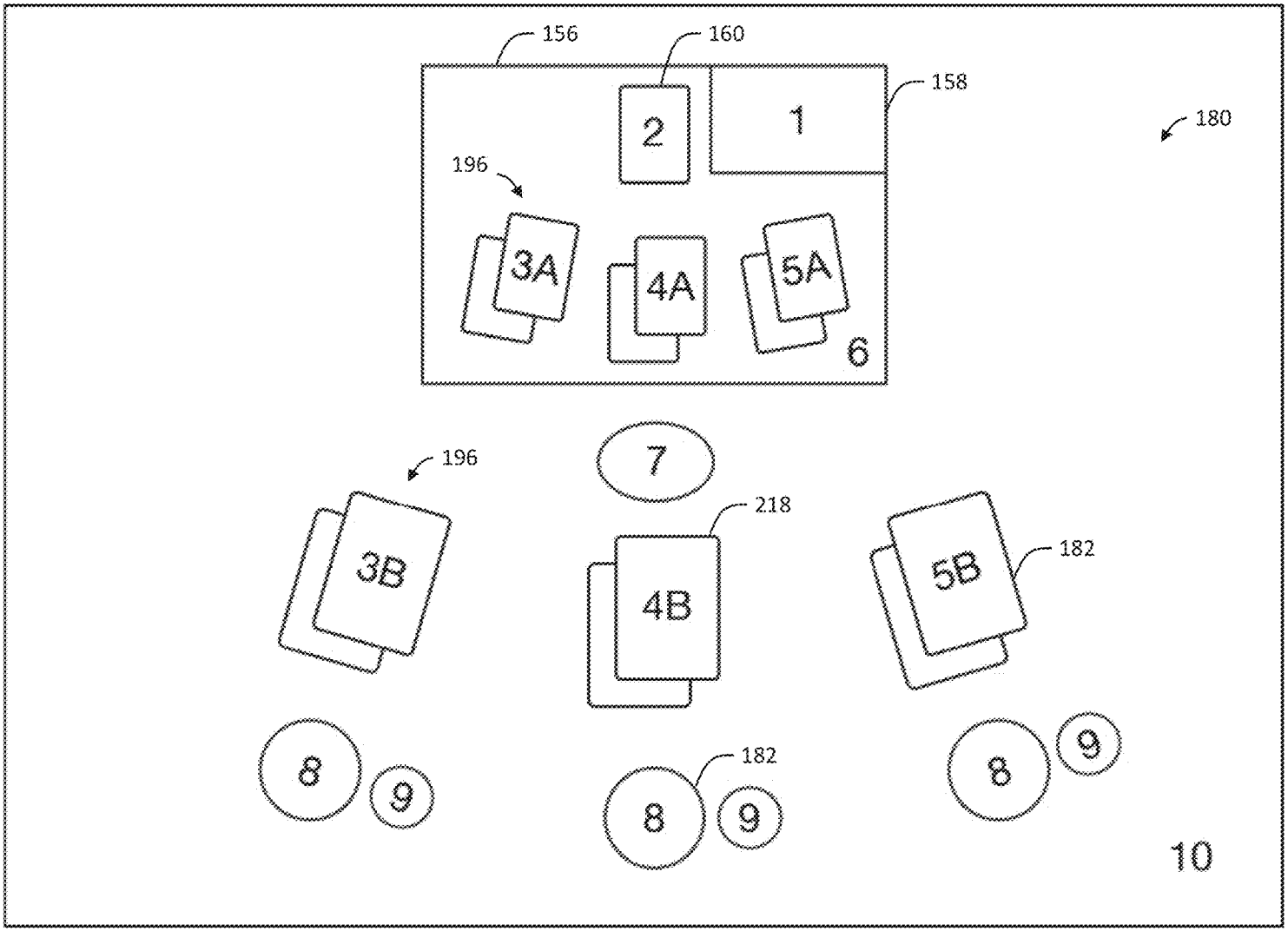
Figure 3A:
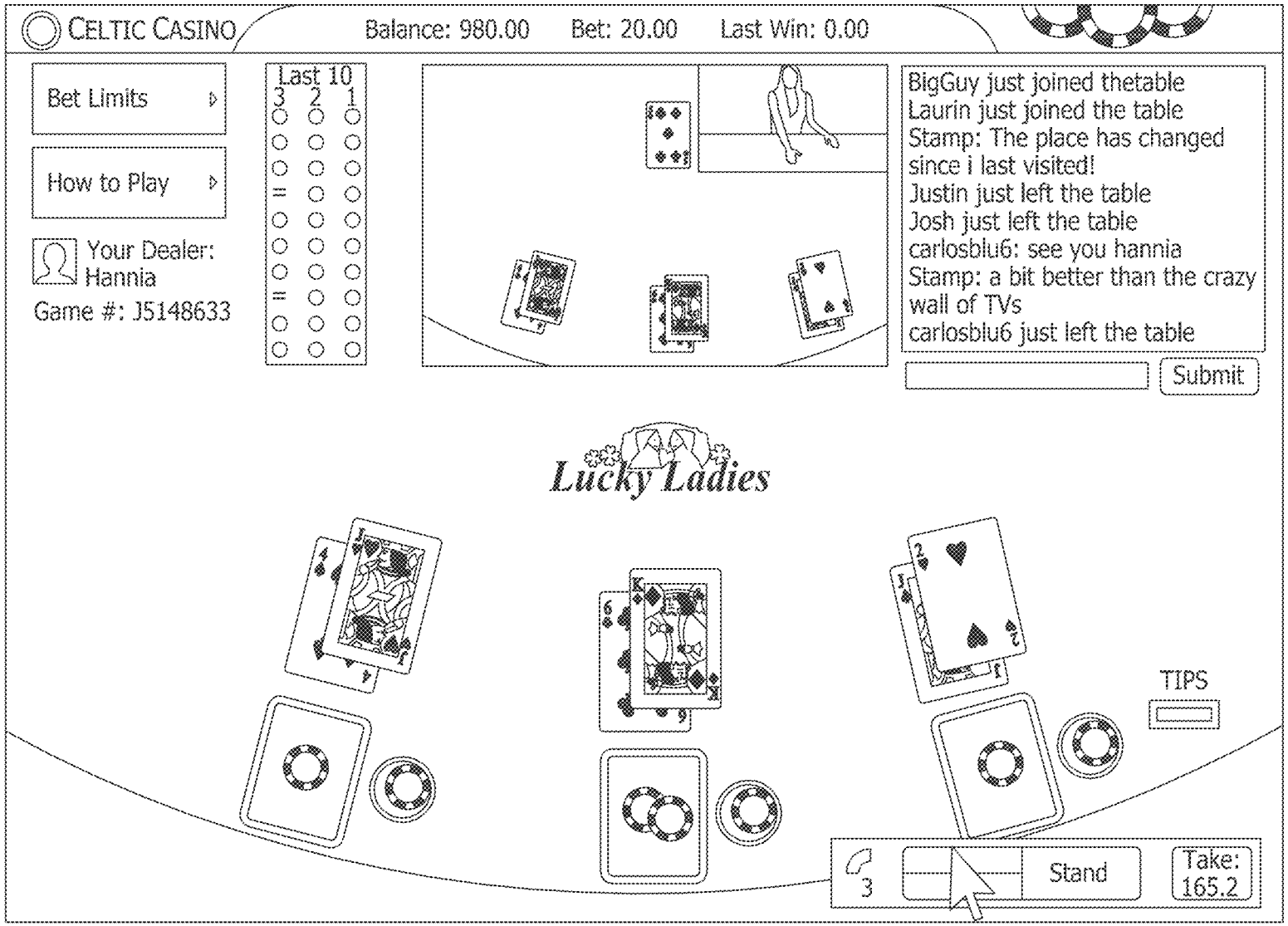
Figure 3B:
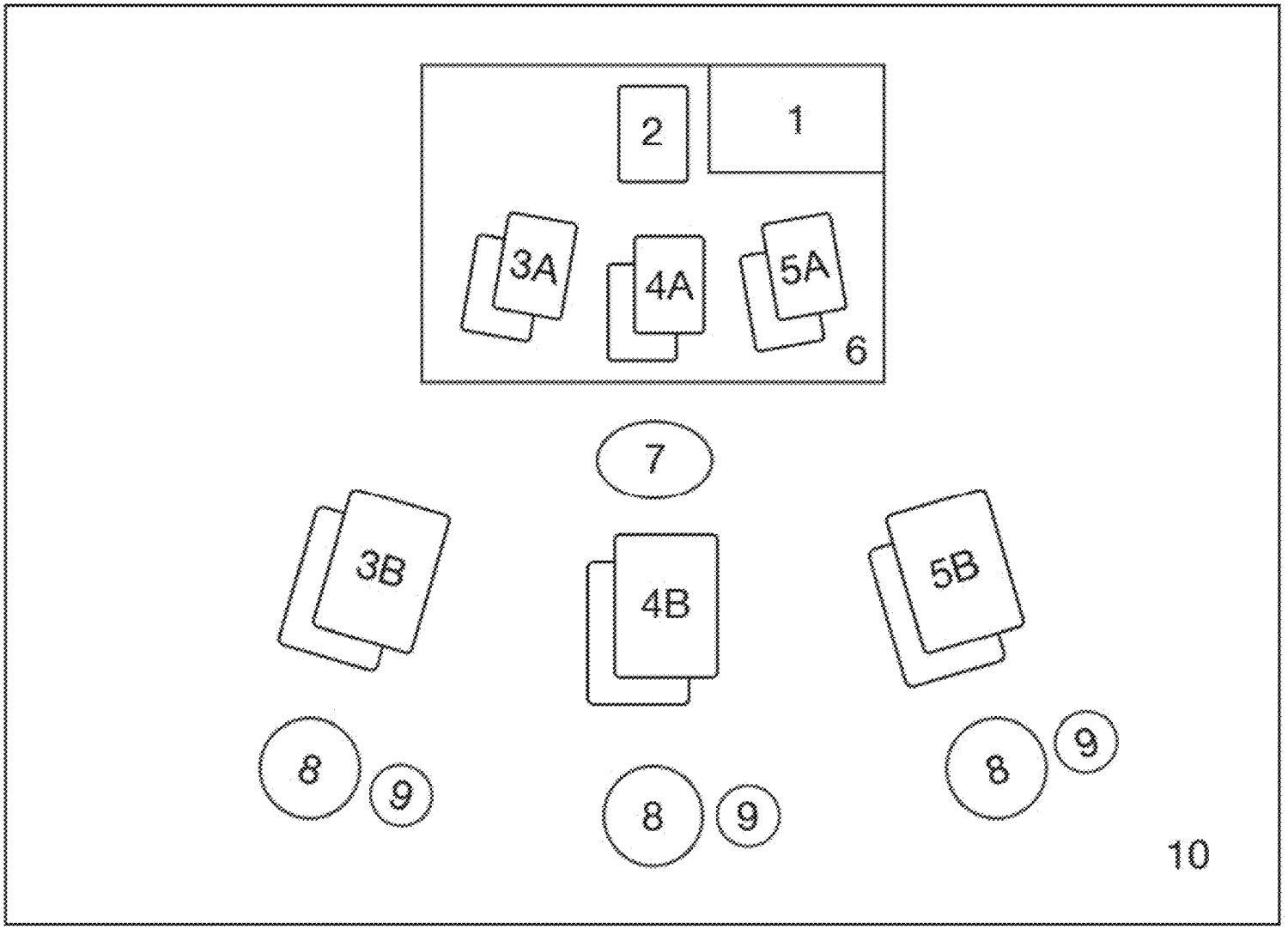

For example, in the illustrated example shown in FIGS. 1A-3B, there are three players, although the number of players are not limited to a specific number. All three players are playing a version of blackjack; however, each player is playing a different version of blackjack, with, e.g., a different sidebet. The first, second, and third players are playing Progressive Blackjack, Lucky Lucky Blackjack, and Lucky Lady Blackjack, respectively. The display screens of the first, second, and third players are shown in FIGS. 1A and 1B; FIGS. 2A and 2B; and FIGS. 3A and 3B, respectively.

In general, live remote dealer systems is a remote system in which players are playing over the internet using remote devices such as personal computers, tablets, smart phones. Other devices may also be used, such as game consoles and/or interactive or smart televisions.

In each display screen, a logo 7 is displayed in the center of the screen. The logo 7 identifies to the respective player which game or version of blackjack is currently being played. Depending on the game being played, other elements of the display screen, such as the color of the felt or tabletop, may also be modified. As shown, the first player is shown a logo 7 corresponding to Progressive Blackjack, the second player is shown a logo 7 corresponding to Lucky Lucky Blackjack, and the third player is shown a logo 7 corresponding to Lucky Lady Blackjack. Each display screen includes two live video images 1, 6. The first video image 1 is generally a full video image of the dealer and the table top showing the cards being dealt. The second video image 6 is close-up of the dealer's hands and the cards. In the illustrated embodiment, the first video image 1 is smaller than, and overlays a portion of, the second video image 6. In one embodiment, the first and second video images 1, 6 are exactly the same across the display screens of each player.

In general, the two separate live video images create different points of view to develop trust with the player. So in this example, the first video image 1 is a head on shot upper body and table of the dealer, so that the players can actually watch the process of her pulling the card(s) out of the shoe. In the second video image 6 an overhead camera is displaying, in synchronized real-time the cards as they are placed on the table in front of the players.

It should be noted that the angles and/or views shown are exemplary only. A different number of views and/or different views may be used. However, the aim of the live view(s) are to build trust with the players by showing the players the actual shuffling process and the dealer pulling the cards from the shoe.

In general, the system includes a card reader mechanism which reads the cards as the cards are pulled from the shoe. The card reader mechanism may be RFID based, camera or video based or some other technology. The card reader mechanism relays the card information to the computer system 110 which is then relayed to the remote device(s). The computer system 110 creates a representation of the card(s), turns the card(s) over, places the card(s), and overlay the cards on the virtual field 10. In the illustrated embodiment, the real cards are shown in the dealer hand 2 and the first, second, and third player hands 3A, 4A, 5A in the second video image 2. The presentation of the cards are shown in the player hands 3B, 4B, 4C on the virtual field 10 of each player's display screen.

The representations of the player's hands on the virtual field 10 of the display screen makes the players' hands clear and larger, i.e., easier for the player to see. In the illustrated embodiment, three player hands/positions are shown. However, any number of player hands/positions, e.g., up to 6 or 7, may be used. The number of player hands/positions may be determined by the computer system 110 dynamically based on, inter alia, the total number of players on the system and the games which the players want to play. The system is aimed at amortizing the dealers over as many players and as many games and/or sidebets as possible.

In the illustrated embodiment, the entire virtual field is computer generated, i.e., the felt, the graphic and the player cards. However, in some embodiments, the table may be a physical table and the indicia 7 and the player cards/hands (and other elements, see below), may be graphic elements which are overlaid on a video or image of the physical table.

In another aspect of the present invention, the system utilizes virtual chips. Each player has a chip rack or stack. To make a wager, the player moves chips corresponding to a desired wager to a respective wager area 8. The manner in which the player performs this action may depend on the device being used. For instance, the player may control a cursor using a mouse or touchpad on a computer to drag and drop chips corresponding to the player's desired wager, from their chip rack to their wager area 8. Alternatively, if the utilized device includes a touchscreen display, the player may utilize their finger (or a stylus) to drag and drop chips from their chip rack to their wager area 8. Alternatively, the player may enter a number representing the wager amount using a real or virtual keyboard to make a wager.

The screen display screen 10 includes a user interface which allows the player to input commands with respect to the game being played, e.g., "hit", "stand", or "double down". An exemplary user interface is shown in the lower left of FIGS. 1A, 2A, 3A. In one aspect of the present invention, the user interface includes a plurality of overlay buttons that relate to that game. These buttons that are on here do not relate to these hands necessarily. The player may click on one of the buttons (using the mouse or touchpad) or select with their finger or stylus (depending on the type of device being used).

In the upper left of the exemplary display screens a series of menu buttons may be displayed. In the illustrated embodiment, a Bet Limits button and a How to Play button are displayed. Actuation of these buttons results in information about the current game being displayed. Below, the menu buttons identifying information related to the live dealer may be displayed and to the right, historical game information, e.g., result information of the last 10 hands, may be displayed.

To the right of the first and second video images 1, 6 a chat window may be displayed. The chat window allows the player to send live messages to the dealer and/or other players.

The live remote dealer shown in the figures is exemplary only. The elements thereof may be arranged differently and not all of the elements described above may be utilized. Additional elements may also be included without departing from the spirit of the invention.

In one aspect of the present invention, the system allows a live dealer to be used as the dealer in more than one game. In general, the games must be similar. For example, if a system provides three different types of blackjack, e.g., Progressive Blackjack, Lucky Lucky Blackjack, and Lucky Ladies Blackjack, in prior art system, at least one live dealer and a physical table must be provided for each type of game. Thus, in this situation at least 3 dealers must be provided, one for each type of game. If there is only one player for each type of game, then there exists a 1 dealer to 1 player ratio. This is uneconomical.

In one embodiment of the present invention, one dealer could actually be dealing more than one game at a time. This may be applied to any game or set of games that use the same general method of play and the same dealer procedure.

Referring back to FIGS. 1A-3B, the first player is playing Progressive Blackjack. The sidebets available to the first player are associated with, and based on a paytable for, Progressive Blackjack. The graphics and the interface that the first player sees on the virtual area or the overlay is for Progressive Blackjack. The second player, who may be in some other part of the world, is playing Lucky Lucky Blackjack, so the overlay or the virtual area shown to the second player is for Lucky Lucky Blackjack and the paytable on the sidebet(s) available for the second player is associated with Lucky Lucky Blackjack. However, it is noted that the actual game is a completely different event or results; however, the game for each player is dealt the same way. The third player is playing Lucky Ladies Blackjack. As shown, the dealer is dealing all three games using the same method of dealing the game. The dealer is now dealing three different games or different branded games and attracting people that like to play those particular games, and the house now has the opportunity again to modify the sidebets (sidebet wager area 9).

In another aspect of the present invention, each player may initially be provided an opportunity to select which game to play. In aspect, different games are the same or a similar base game, e.g., blackjack, with a different name and a different sidebet (or a different combination of) sidebets. In general, the sidebet does not affect how the game is dealt, it just affects how much money the player may win based on the result of their hand. For this to work, the games have to have the same basic dealing procedure. Dealing a hand is a process and it is something that can generate the result for all of these games.

In another aspect of the present invention, the system may be used to provide, using a single dealer, different games of a similar type. The games may be, for examples, different games within the same type game, such as, but not limited to blackjack, baccarat, poker (stud poker, hold'em poker) or any game in which the method of dealing the game is consistent. Each game (within the same type), then you can put the various sidebets on it.

In one embodiment of the present invention, each player may know that the other players are, or may be playing a different one of the same type of game. In other words, the first player may know that the second player is playing a different version of blackjack and that the third player is playing a third version of blackjack.

In another embodiment, each player does not know that the other players are playing a different one of the same type of game. Or at least, the system does not provide this information. It is not apparent.

In another aspect of the present invention, the system is flexible in that each player may think that they are at a table with other players, and that all of the players are playing the same game, e.g., Progressive Blackjack. So when the player enters the lobby or the entrance into this virtual world, the player may select Progressive Blackjack. During game play, the player is sitting at a virtual table playing Progressive Blackjack and all of the other players appear to be playing Progressive Blackjack through the look and feel of the game as it is presented to the first player. In this aspect, each player may or may not see the other players' chip counts, because if you're not aware that they are playing a different game, the modification of the chip count may not make sense in their game. It may not make sense what the sidebet behavior is. So, again, a couple of ways to do it will depend on what the evolution of the user demands are in the future, but it really, is a variable whether the other player to sees the sidebet behavior or not. For example, it may be desirable to allow the players to see the win or loss or not, and whether to see what games the other players are playing, and how the players win.

With respect to FIGS. 1A-3B, the following reference numbers are used: 1: perspective video image of the dealer pulling the cards out of the shoe. 2: actual dealer hand. 3A, 4A, 5A: actual player hands. 6: overhead video image of the playing field. 7: indicia or logo identifying the game being played by the corresponding player. 3A, 4A, 5A: virtual representations of, or graphical overlays of the player hands. 8: wager area. 9: sidebet wager area. 10: virtual field. These reference numbers are carried forward throughout the remaining FIGS.

With respect to FIGS. 4A, 4B, 5A, 5B, 6A, and 6B, in another aspect of the present invention, each player may see what the other player's sidebets wagers and how much they won (Dynamic Multi-Game with Sidebet Reveal). In this embodiment, each player can see what game the other players are playing, including which sidebet. Each player can also see how much money the other players have won.

In this embodiment, several additional features have been added to each display screen. First, a small indicia or logo 7, 11 has been added to each player position on the virtual field 10. The small indicia or logo 7, 11 provides an indication of the game each player is playing.

Figure 4A:
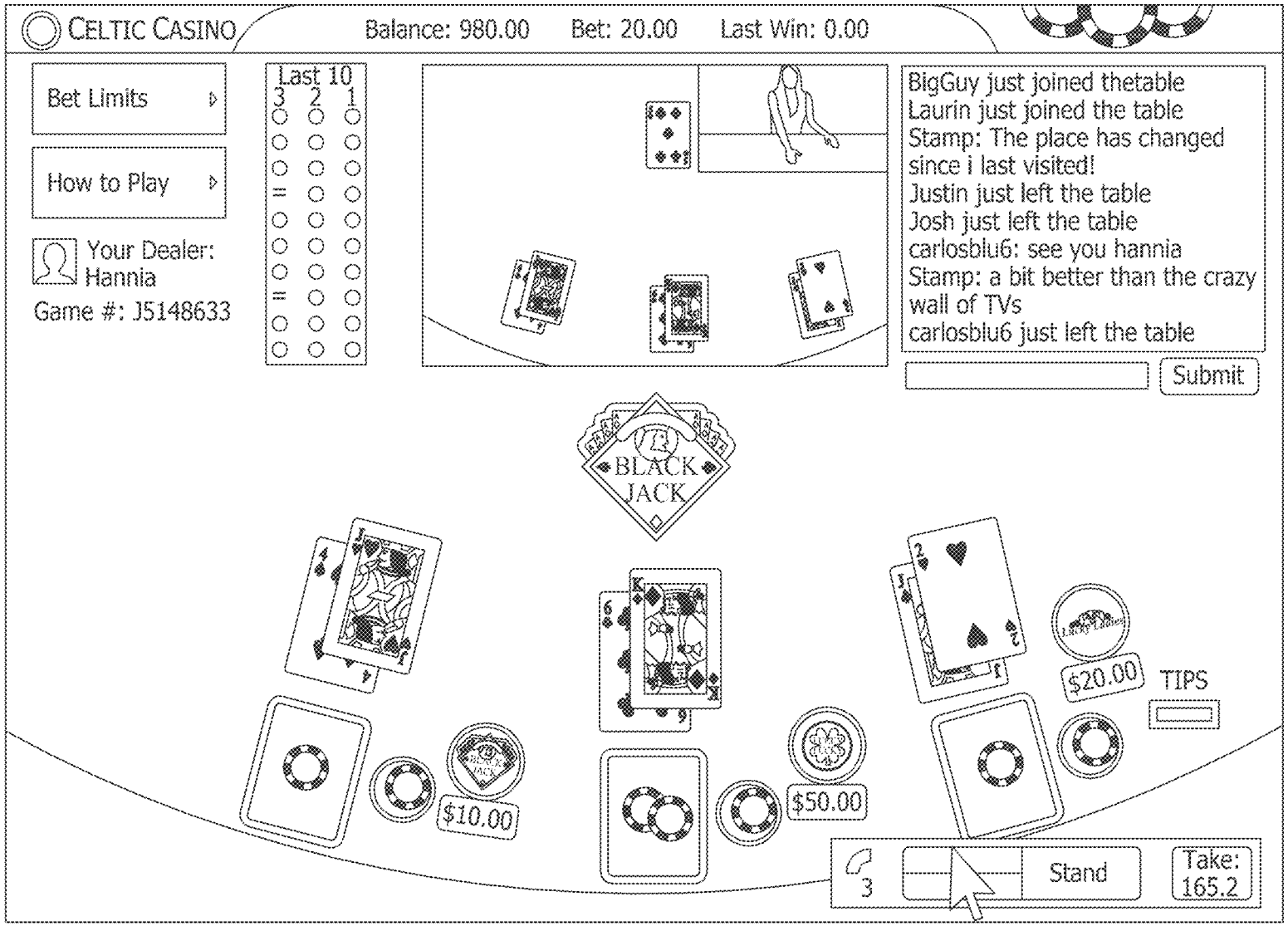
Figure 4B:
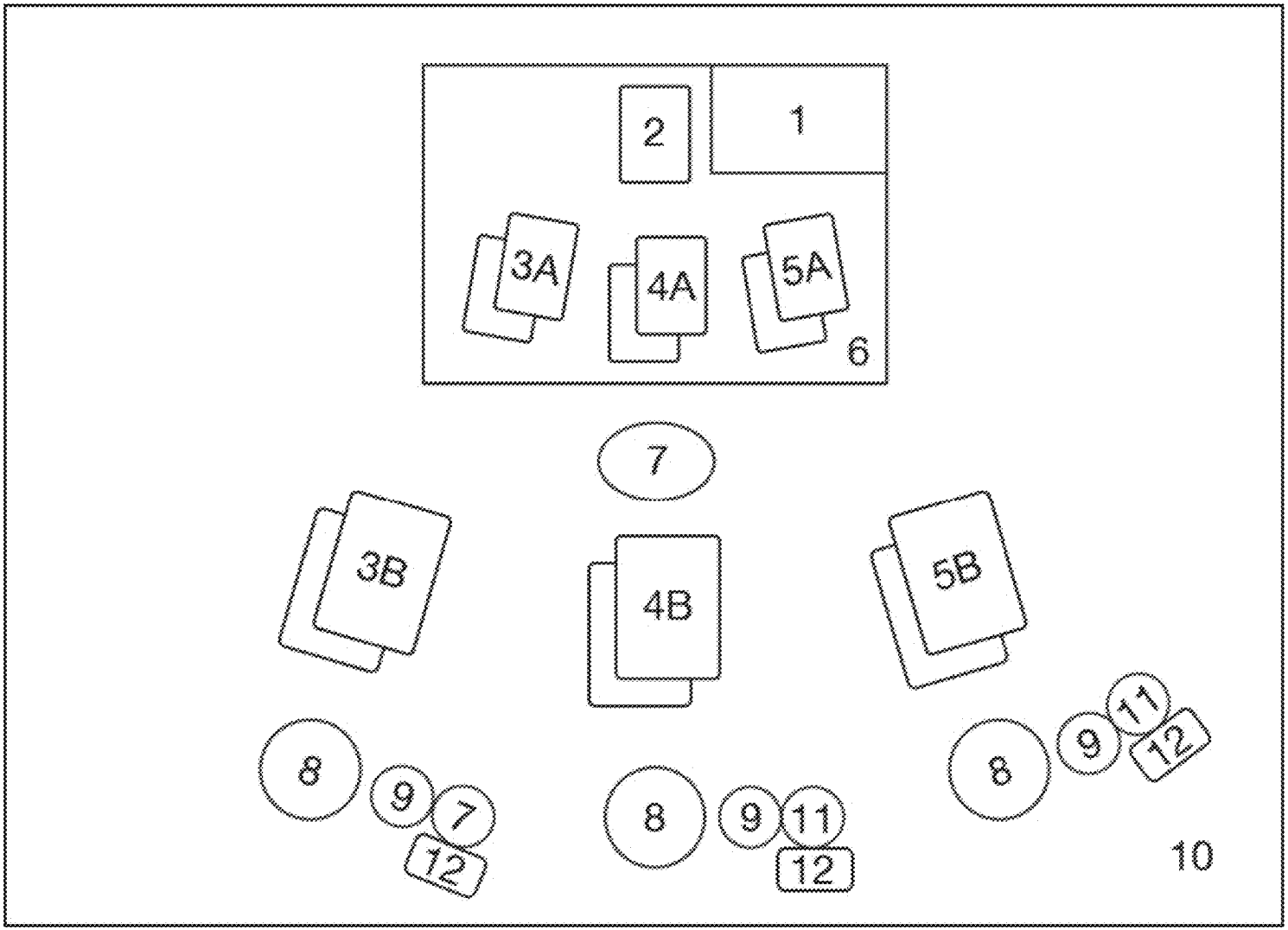
Figure 5A:
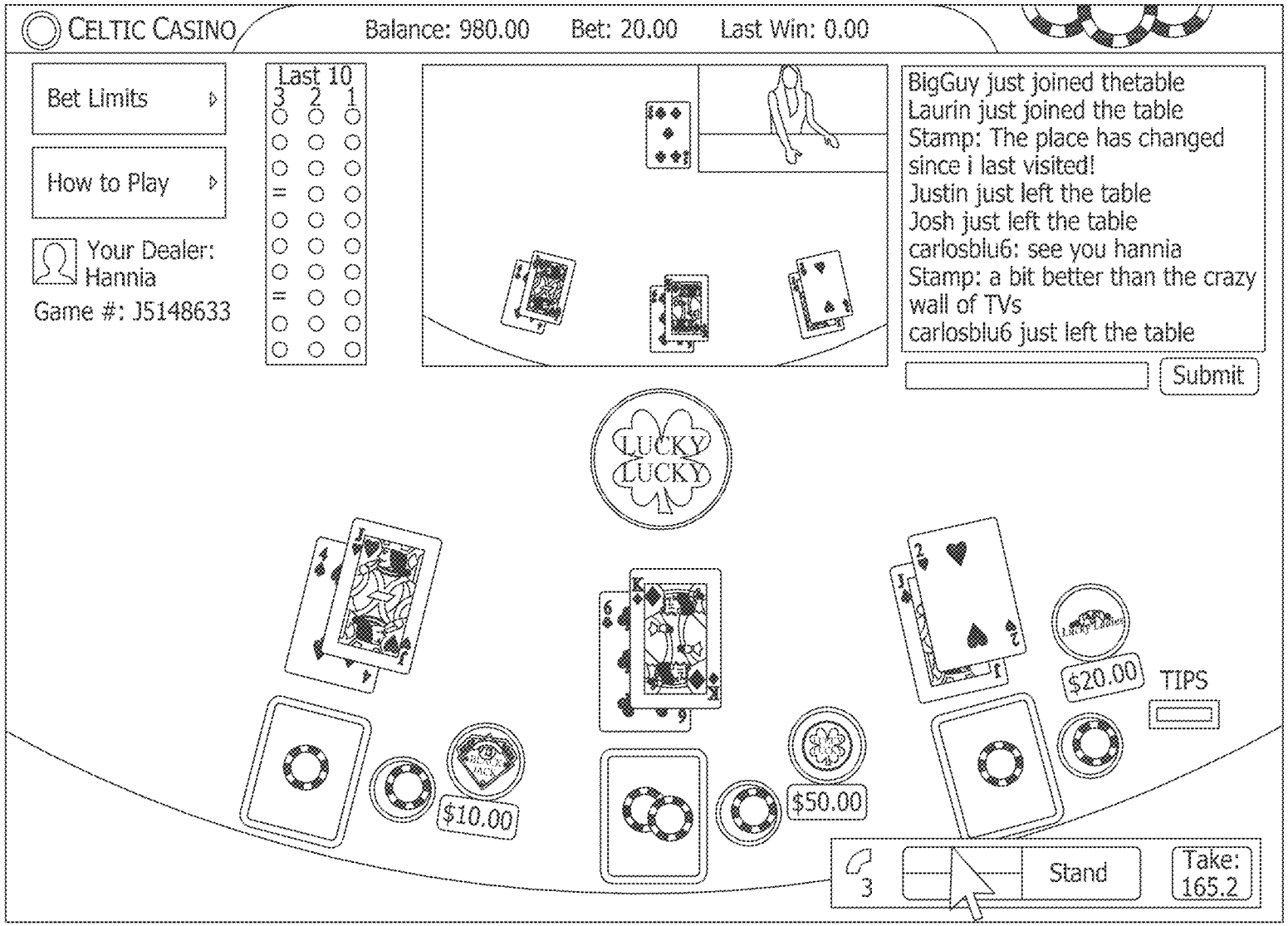
Figure 5B:
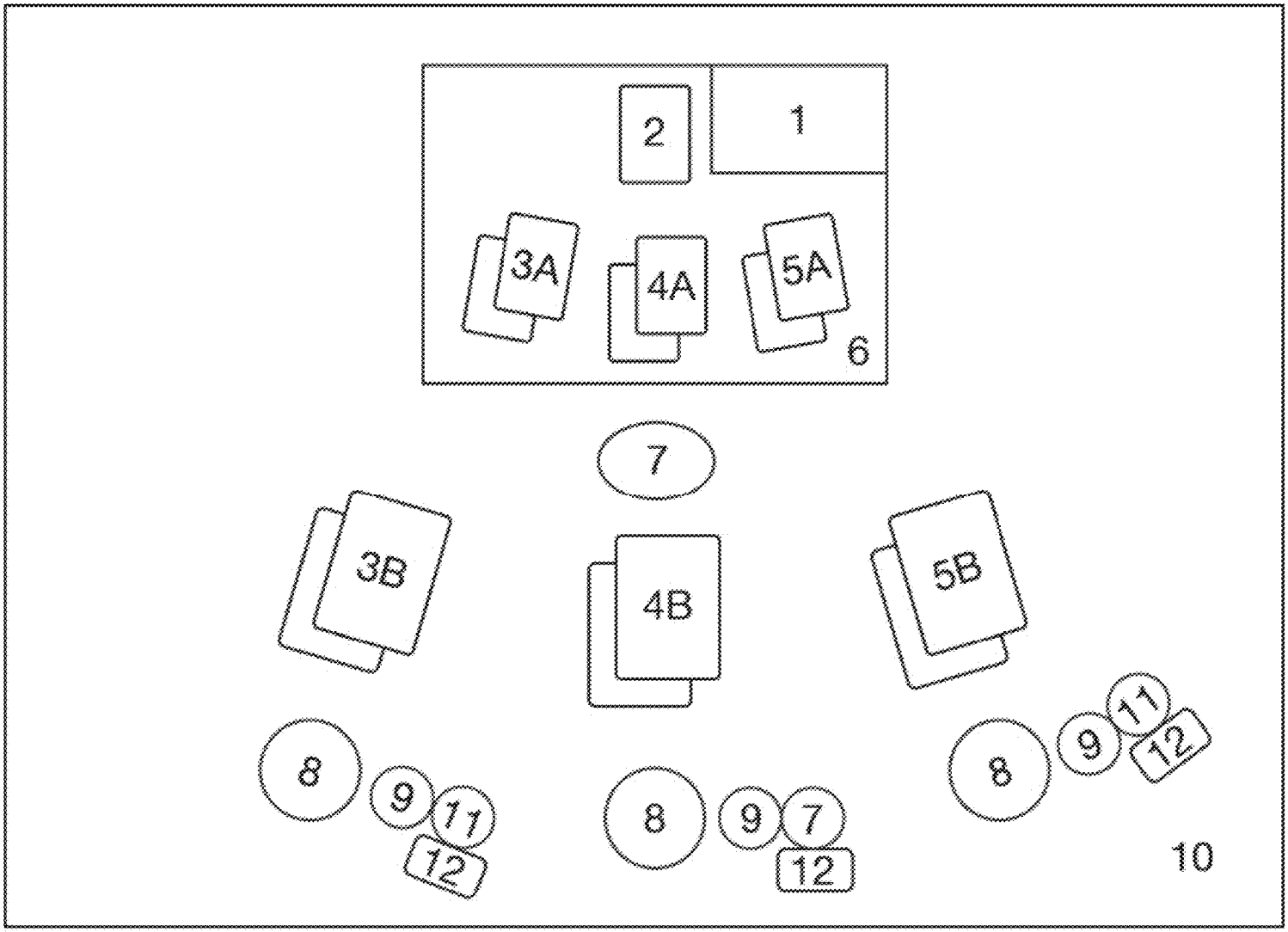
Figure 6A:
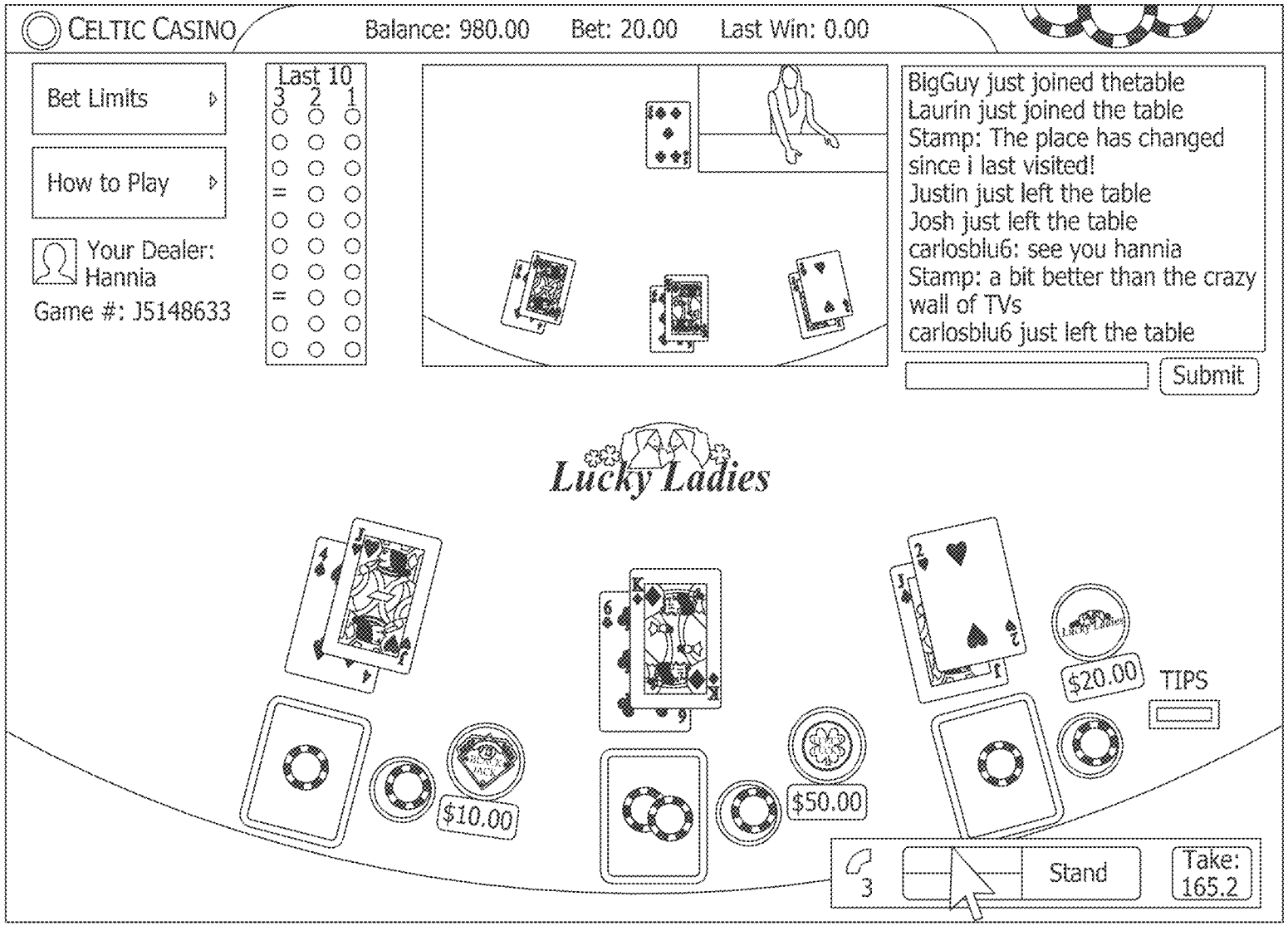
Figure 6B:
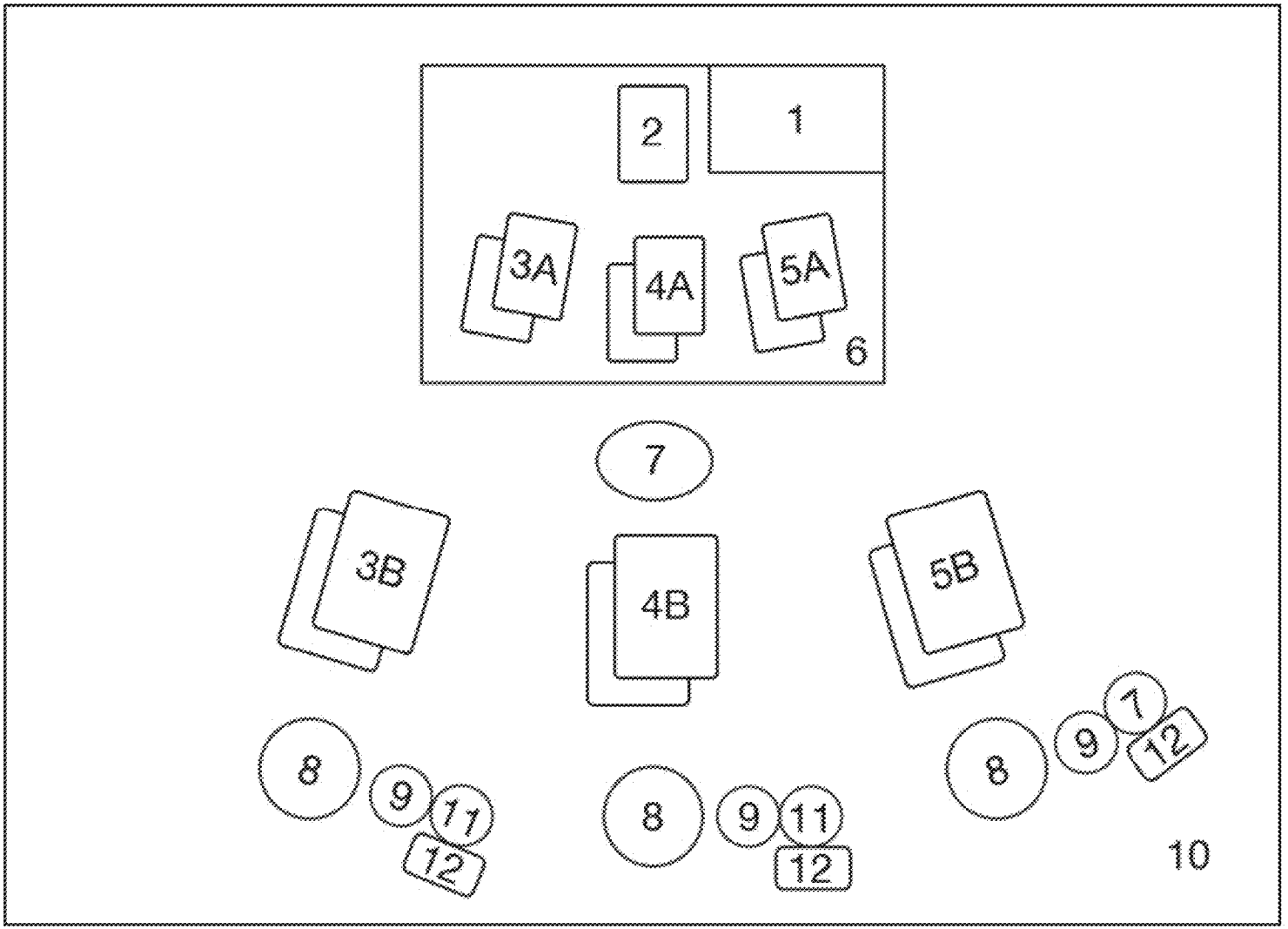

For instance with respect the display screen of the first player as shown in FIGS. 4A and 4B, in the first player position is provided a small indicia or logo 7 which matches the logo in the center of the first player display (FIG. 4A). The second player position includes a small indicia or logo 11 in the second player position which matches the logo displayed in the middle of the second player's display screen shown in FIG. 5A, i.e., the Lucky Lucky logo. The third player position (on the first player's display screen shown in FIG. 4A) includes a small indicia or logo 7 which matches the logo displayed in the middle of the third player's display screen shown in FIG. 6A, i.e., the Lucky Ladies logo.

In other words, for each player, the small reference number 7 on the graphic corresponds to the logo that is in the middle of that player's table. That is the game that the player is playing.

In another aspect of the present invention, the game that each player is playing defines which sidebet is available to that player. By providing an indication of the sidebets that are available to, or that are being played by, the other players, a player may be incentivized to desire to want to try the other games.

As discussed below, a player by highlighting or selecting one of the small indicias or logos 7, 11 or the center indicia or logo 7, a description and/or pay table for the respective game is displayed.

The other feature shown in FIGS. 4A-6B is an indication 12 of the actual payout. This also may provide an incentive to a player to seek out and play a game (or sidebet) played by one of the other players.

Figure 7A:
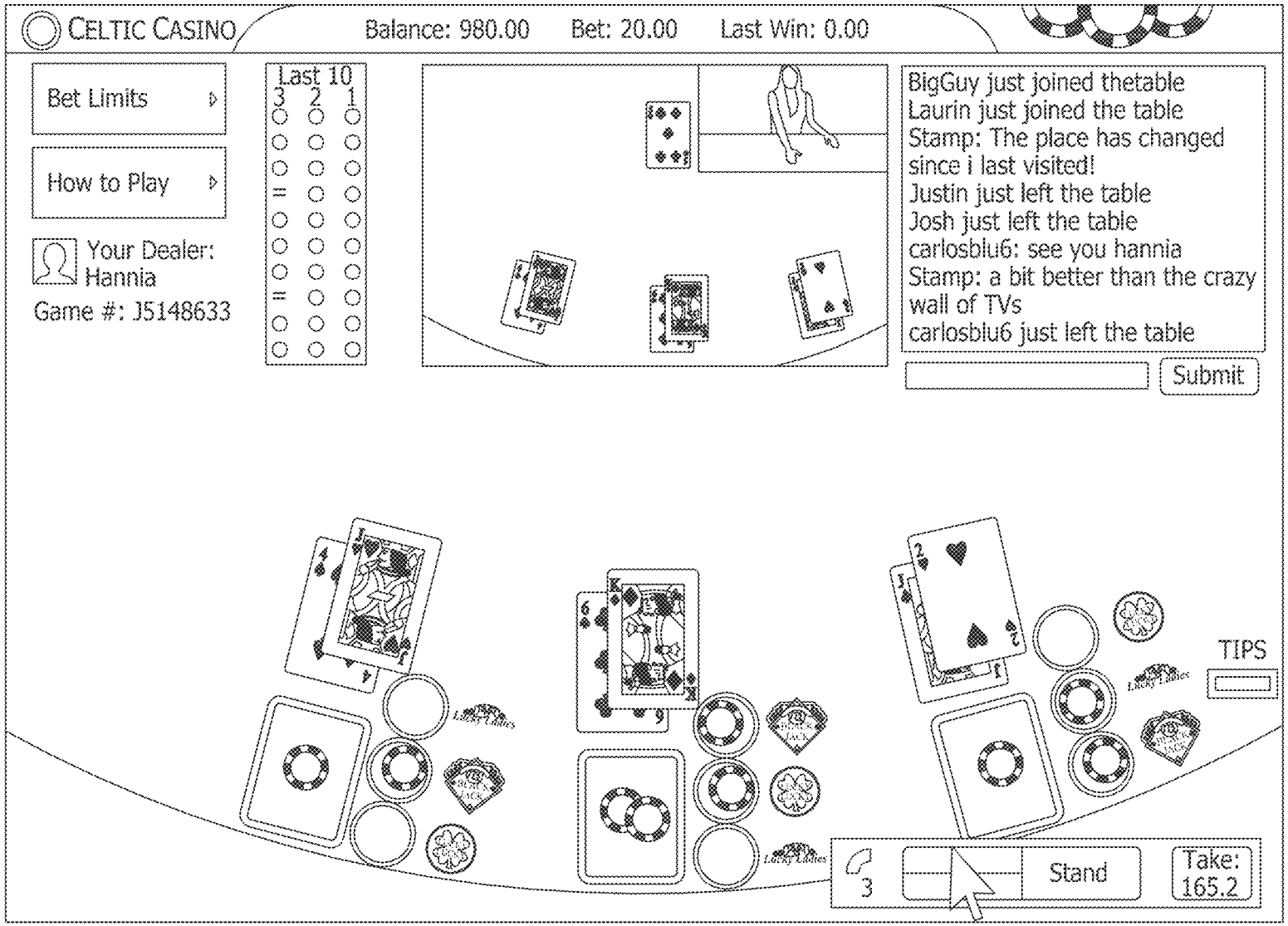
Figure 7B:
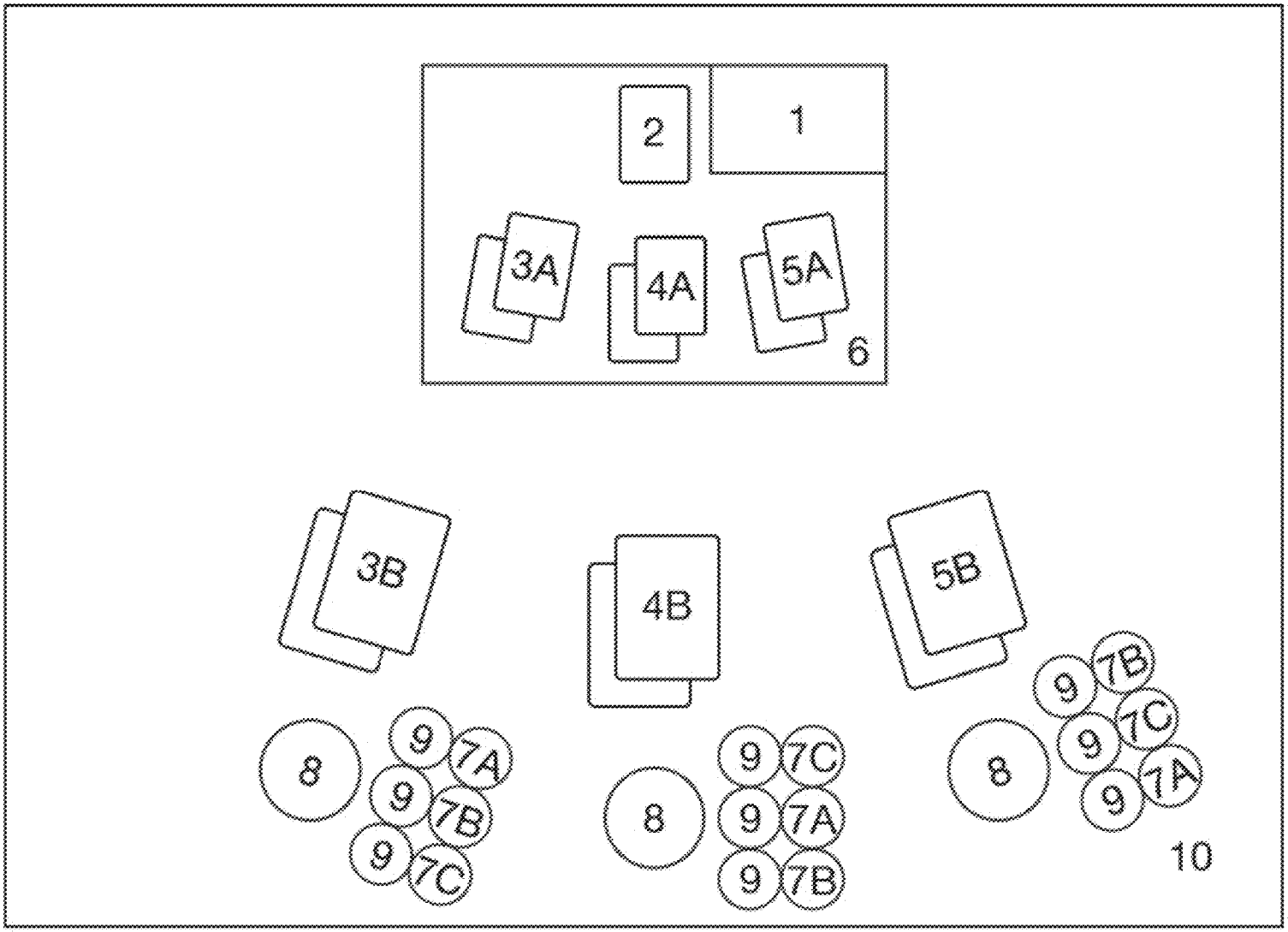
Figure 8A:
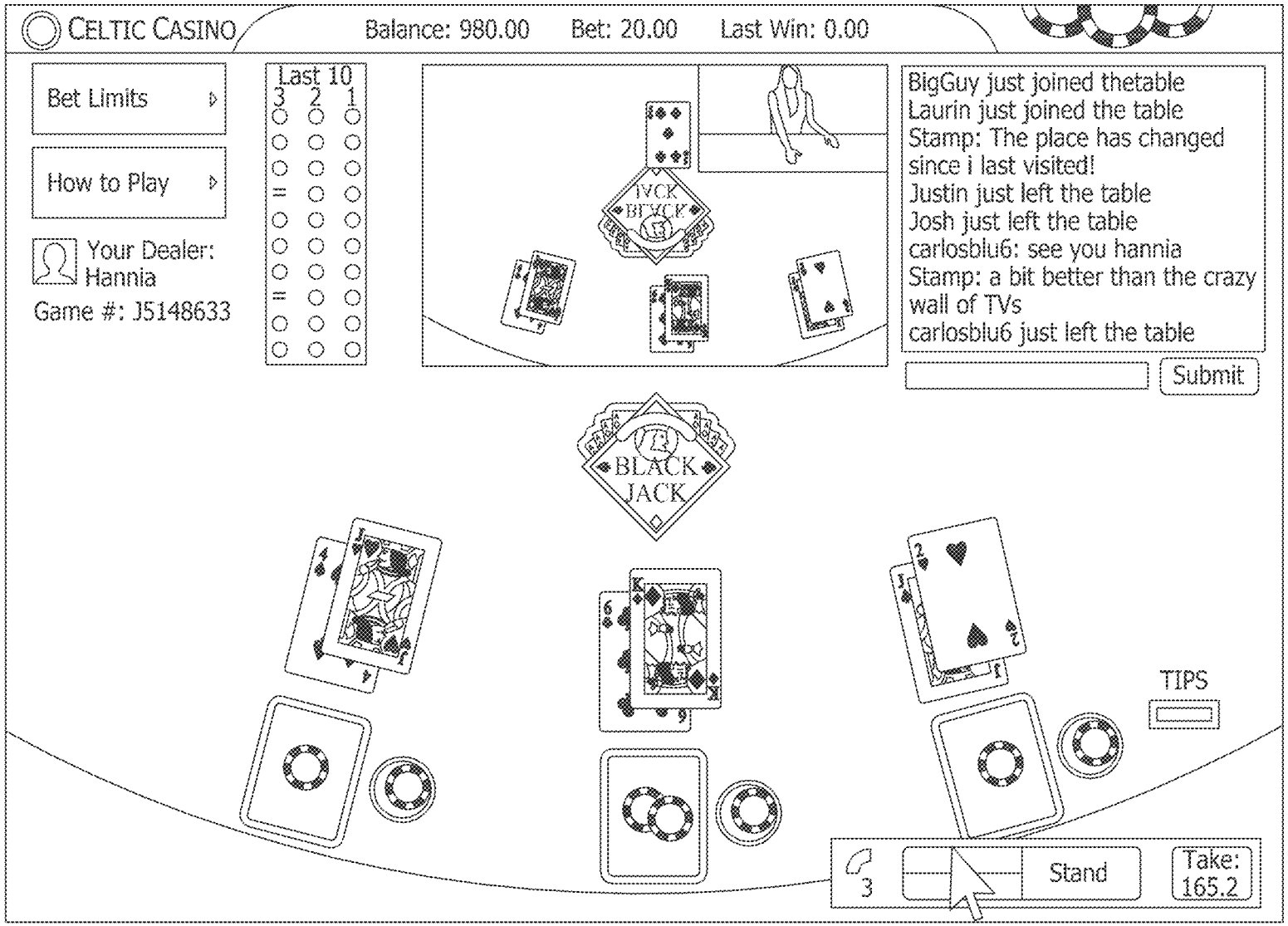
Figure 8B:
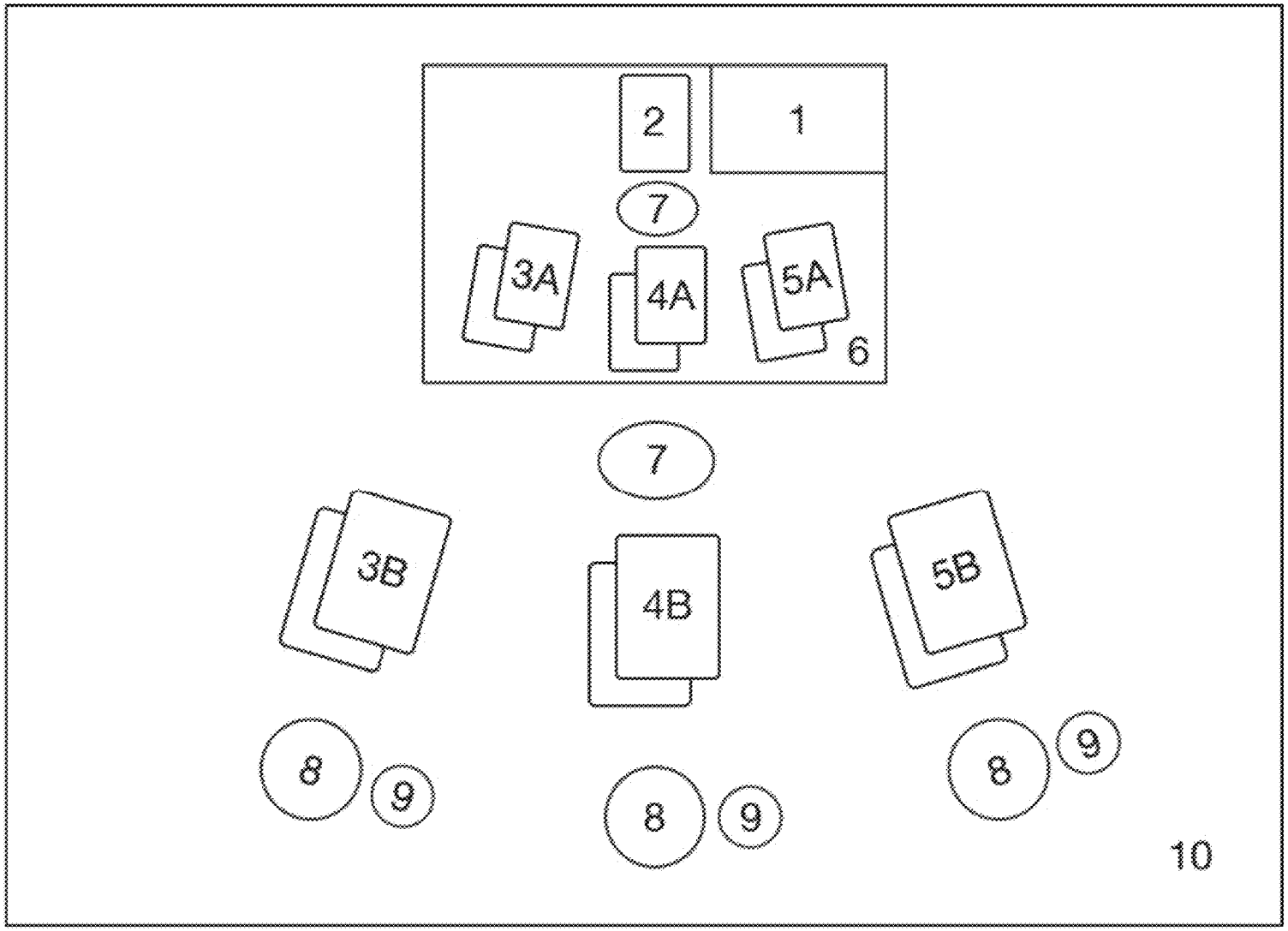
Figure 9A:
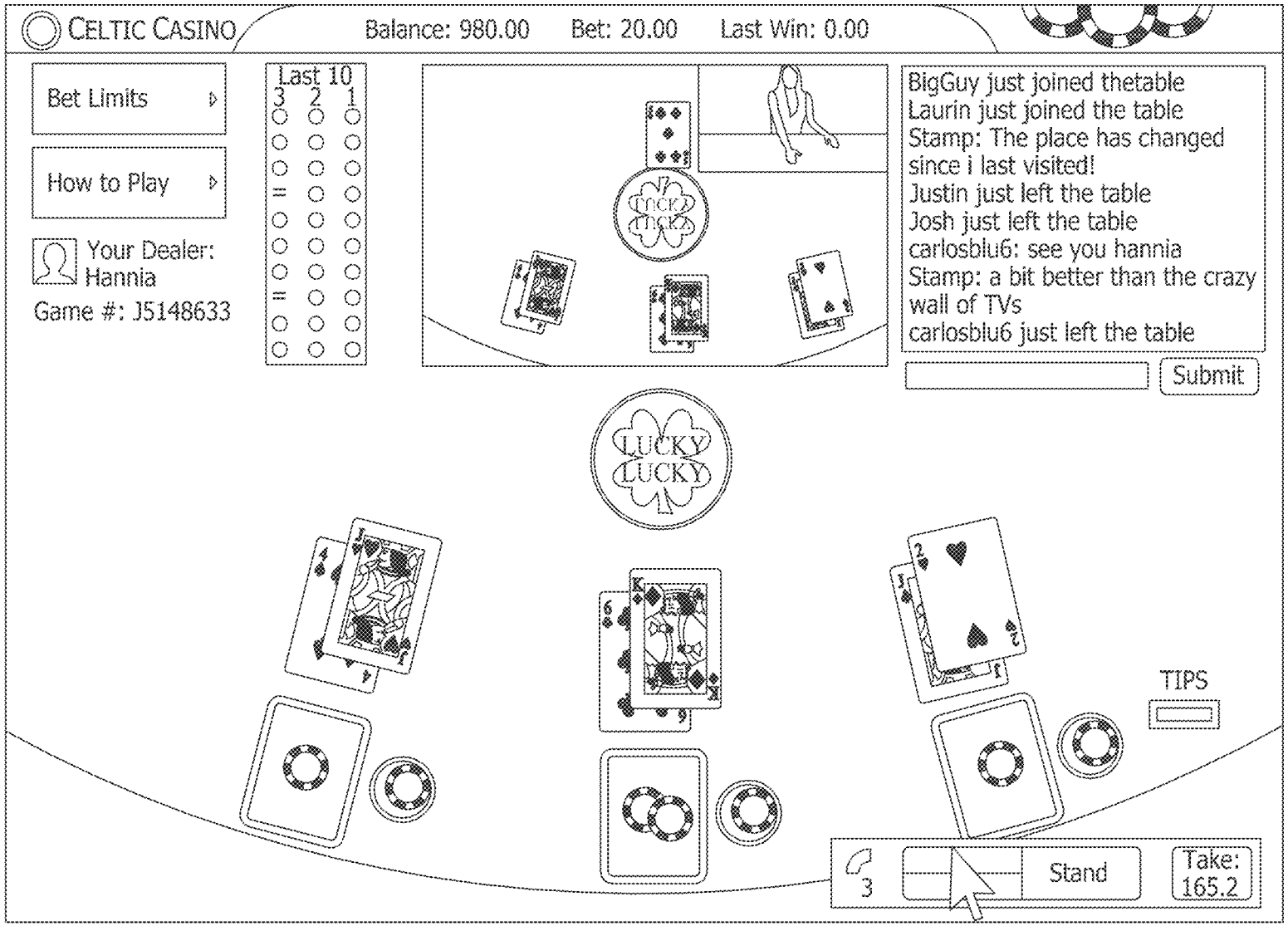
Figure 9B:
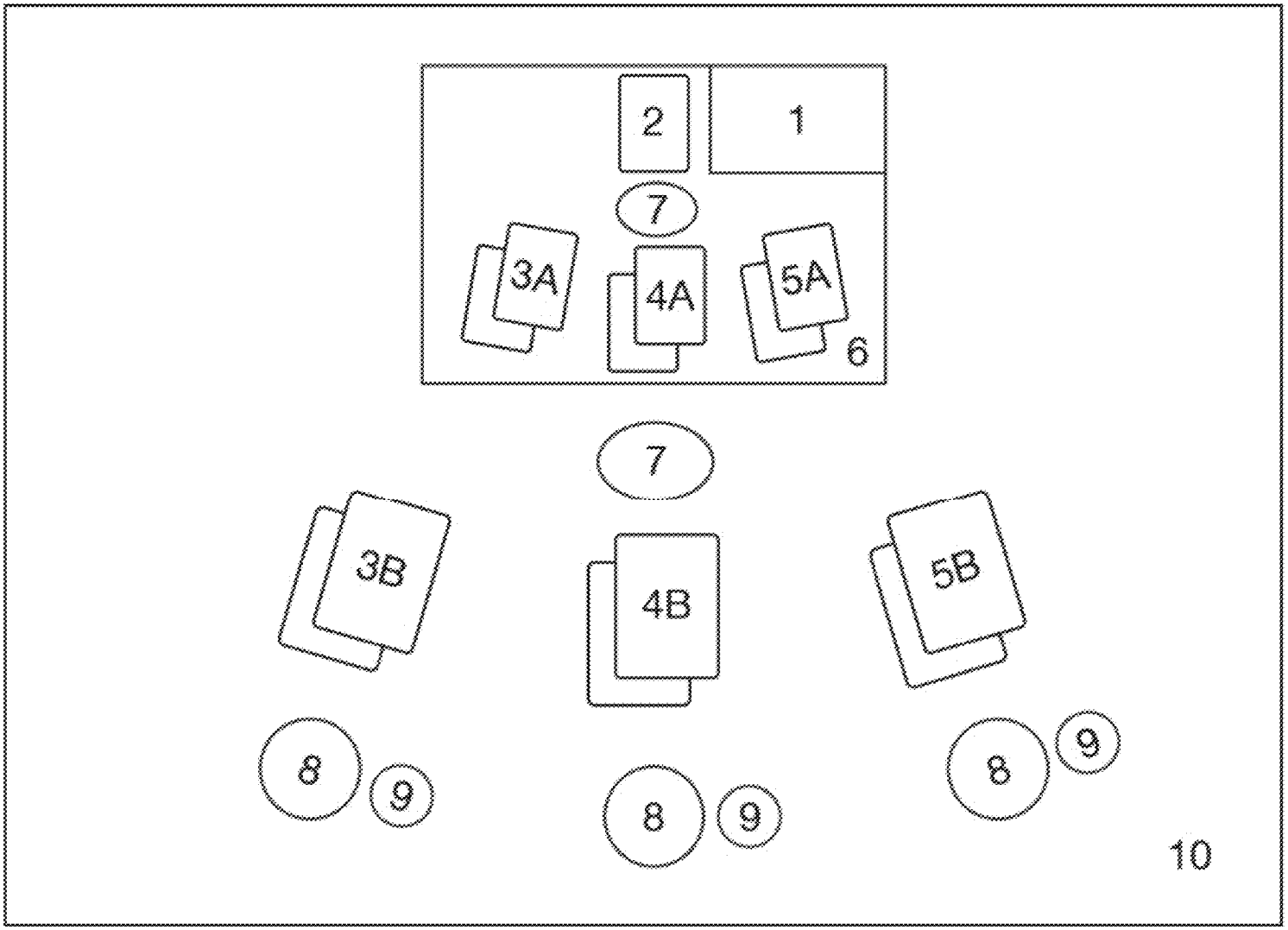
Figure 10A:
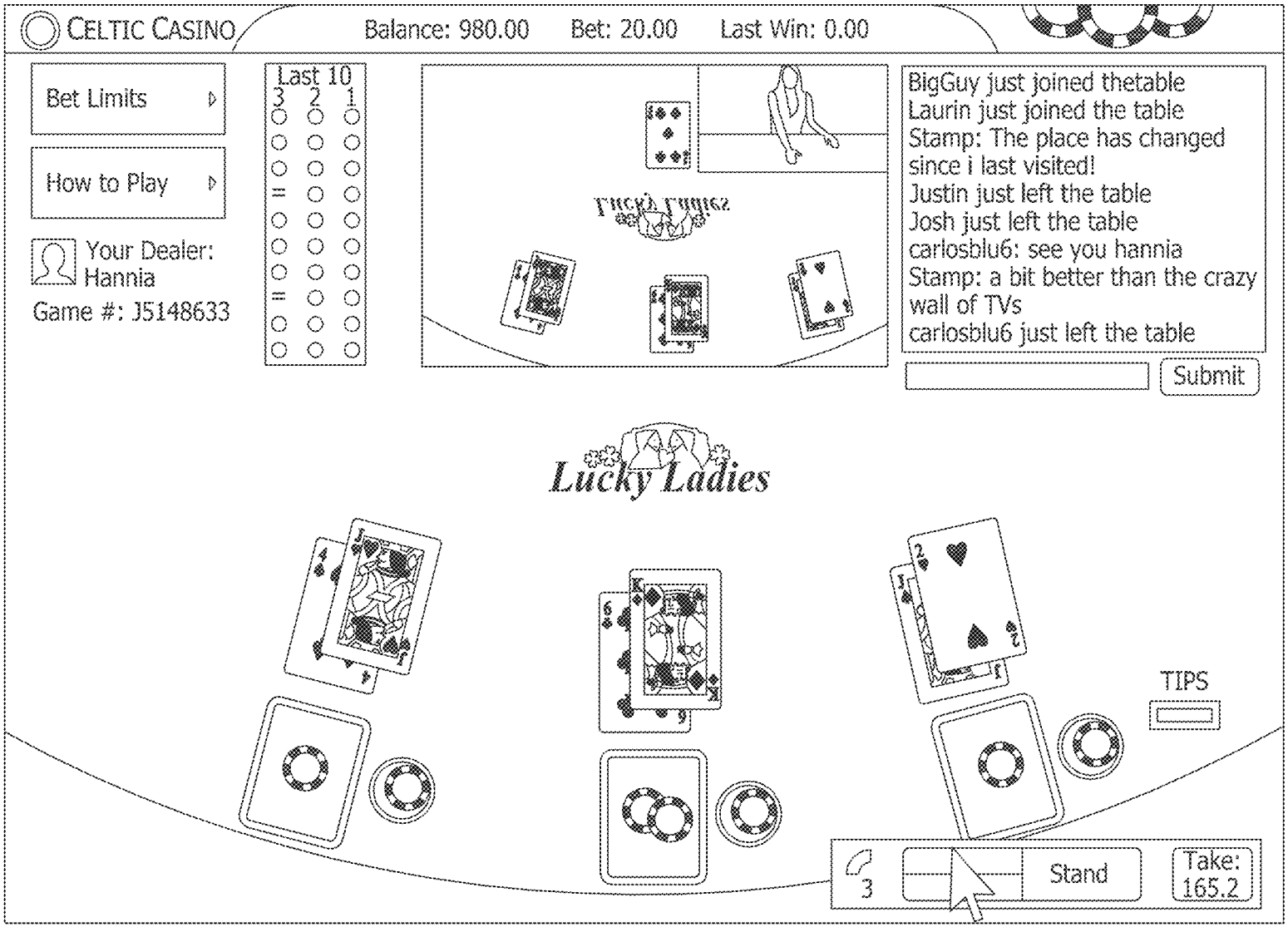
Figure 10B:
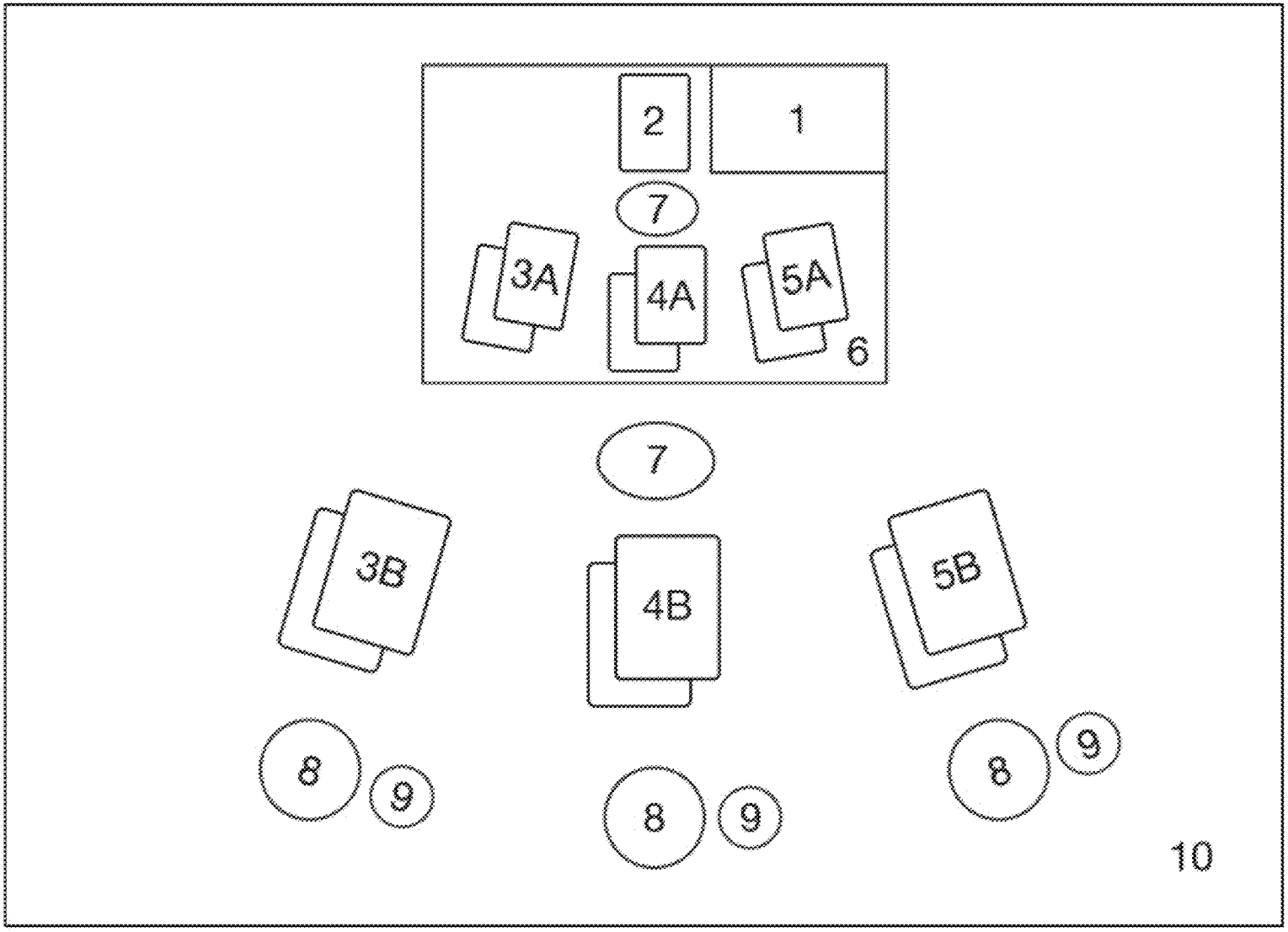

With reference to FIGS. 7A-7B, the player does not choose which game to play, rather each player may play the sidebet associated with one, or more, or all of the available games. Each player position includes a sidebet wager area 9 associated with each available sidebet. In the illustrated embodiment, there are three sidebets available: Progressive Blackjack, Lucky Lucky, and Lucky Ladies. Thus, each player position includes three side wager areas 9. An associated small logo 7A, 7B, 7C corresponding to Lucky Ladies, Progressive Blackjack, and Lucky Lucky, respectively is displayed adjacent to a respective side wager area 9 in each player position.

As shown, since each player has the option to play the sidebet associated with each game, the central indicia or logo is not displayed in the center of their display.

To play or place a particular sidebet, the player simply places a wager on the respective sidebet wager area. As stated above, a player may place zero sidebets, 1 sidebet, more than 1 sidebet, or all of the sidebets for each played hand. In the illustrated embodiment, three sidebets are shown. However, the present invention is not limited to three. For example, six different sidebets or games may be provided with corresponding sidebet wager areas 9 designated by an adjacent logo. In one embodiment, three sidebet wager areas 9 may be displayed on one side of the player position and three sidebet wager areas 9 may be displayed on the other side of the player position. Other arrangements may also be used.

Each small indicia may provide an indication (by selecting, clicking, or rolling over the indicia) of the rules and/or paytable of the corresponding sidebet).

The total payout could then be displayed as described above. The total payout would include any award from the base blackjack game and each of the sidebets played by the player.

In another aspect of the invention, the win or award for each played sidebet may be shown separately. In another aspect of the invention, the win or award a player could have won if they had played a sidebet (using a set or minimum wager) could also be displayed.

In general, each sidebet has its own minimum and maximum values. Some of these values are just standard one dollar bets or one pound bets, but could be other values such as 5. Other limits could be placed on the sidebet, e.g., a sidebet or total of sidebets cannot exceed a player's wager on the base game. Generally, such parameters may be modified.

Actual payouts and hypothetical payouts may be graphically distinguished, e.g., by a different color, highlighted, flashing or similar effect.

With reference to FIGS. 8A-10B, in another embodiment, a video image on each player's display screen may be separately or individually branded or identified based on the game being played by that player.

FIGS. 8A-10B are similar to FIGS. 1A-3B. Each player selects the game that they want to play.

As shown in FIGS. 1A-3B, the central area of the virtual field 10 is branded by logo 7 in the center. The table shown in the overhead video image does not have a logo printed thereon because it is used in different games.

However, as shown in FIGS. 8A-10B, a graphic overlay containing the logo of the game being played by each player may be displayed on (as an overlay) on the overhead video image 6 shown on each display screen. The video image 6 in each player's display screen will have overlaid thereon the logo of the game being played by the respective player as shown. If the player switches games, then the logo overlaid on the video image 6 will be changed as well.

Figure 11A:
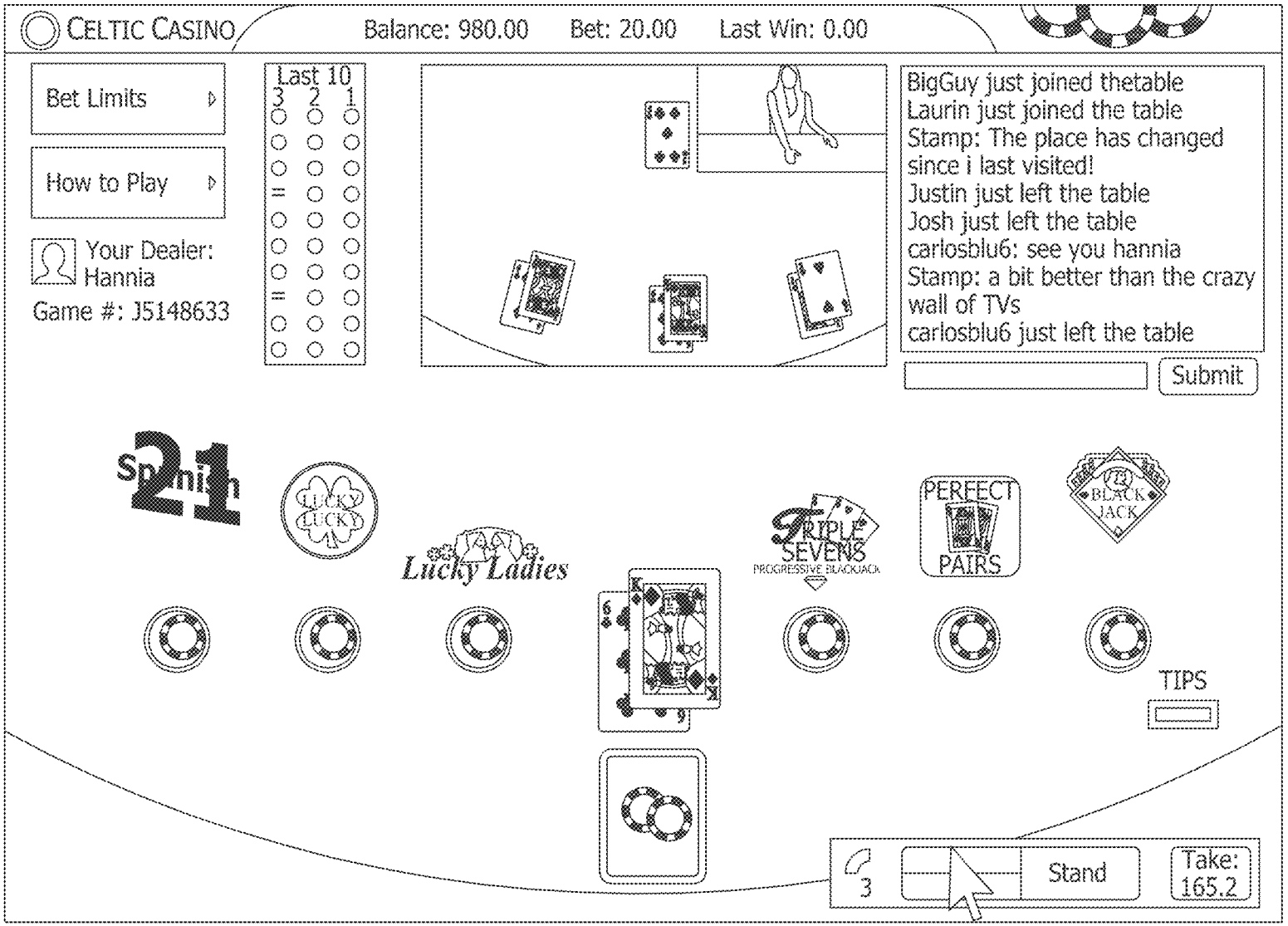
Figure 11B:
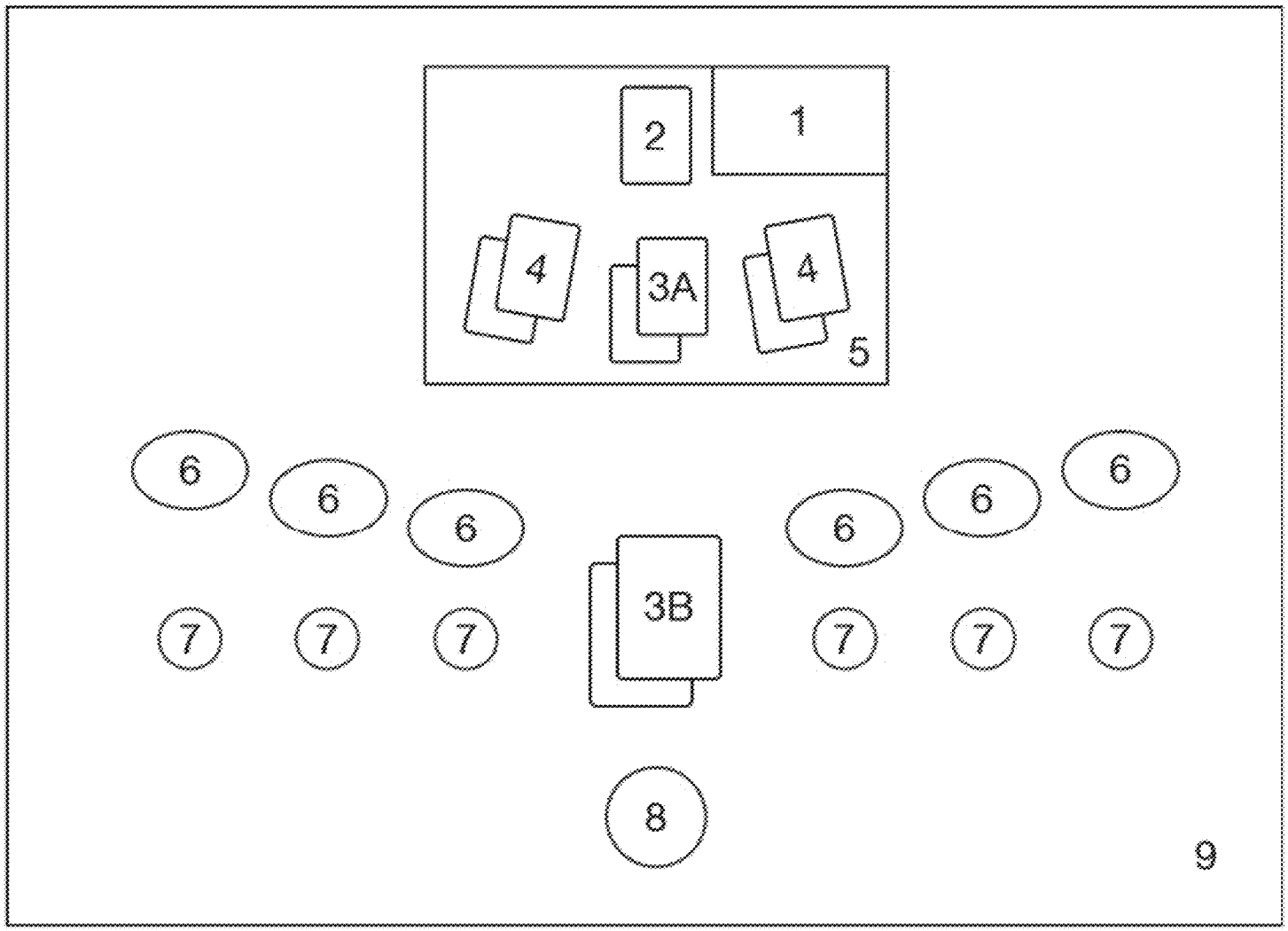

With reference to FIGS. 11A-11B, in one embodiment, each player's virtual field only displays their cards. In the illustrated embodiment, the display of the second player is shown, so their cards 3B are shown. The other player's cards are still shown in the video images 1, 6. This provides additional screen real estate to display the sidebets. In the illustrated embodiment, six potential sidebets may be played. Therefore, the virtual field 10 includes a sidebet wager area 9 and an associated logo 7 for each available sidebet.

Figure 12A:
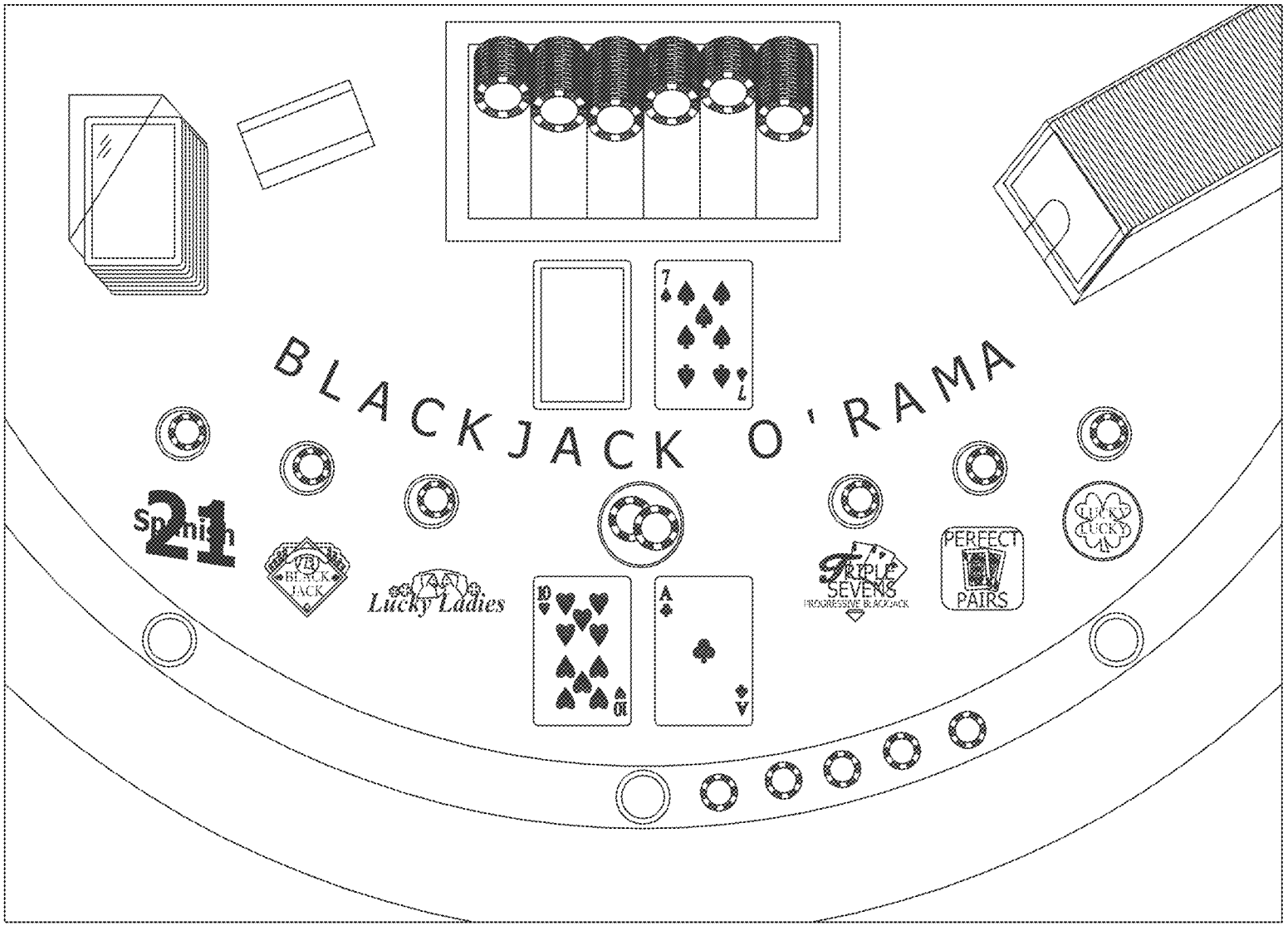
Figure 12B:
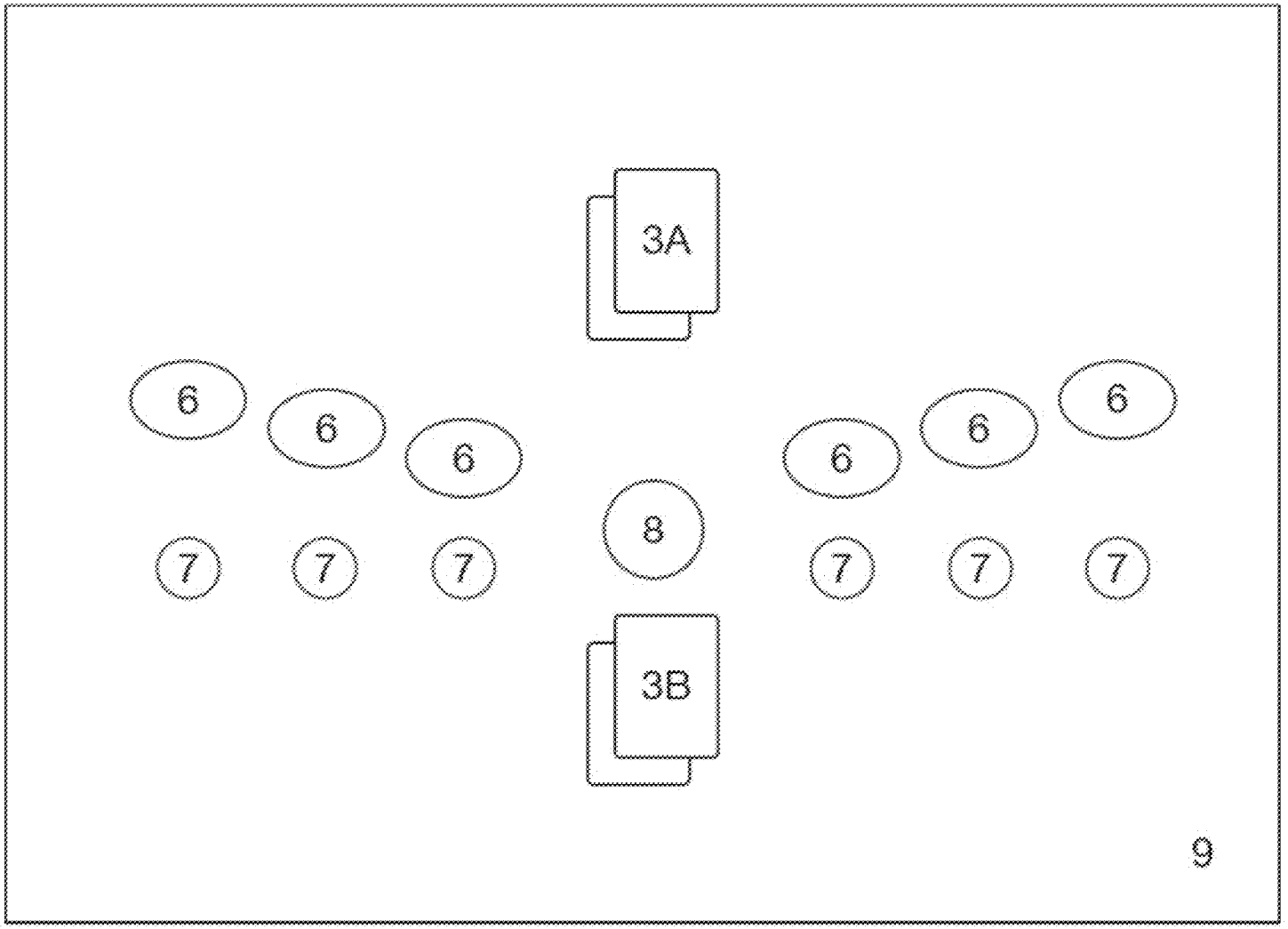

With reference to FIGS. 12A-12B, in another aspect of the present invention, the features of FIGS. 11A-11B may be applied to a stand-alone single player game without a live dealer. As shown, the display screen does not include a video image. Rather than the game cards being generated or dealt using a live dealer, a random number generator (RNG) is used to generate the cards. In the illustrated embodiment of FIGS. 12A-12B, a single player is playing blackjack against the dealer. However, in this embodiment six sidebets are available to the player.

Figure 13A:
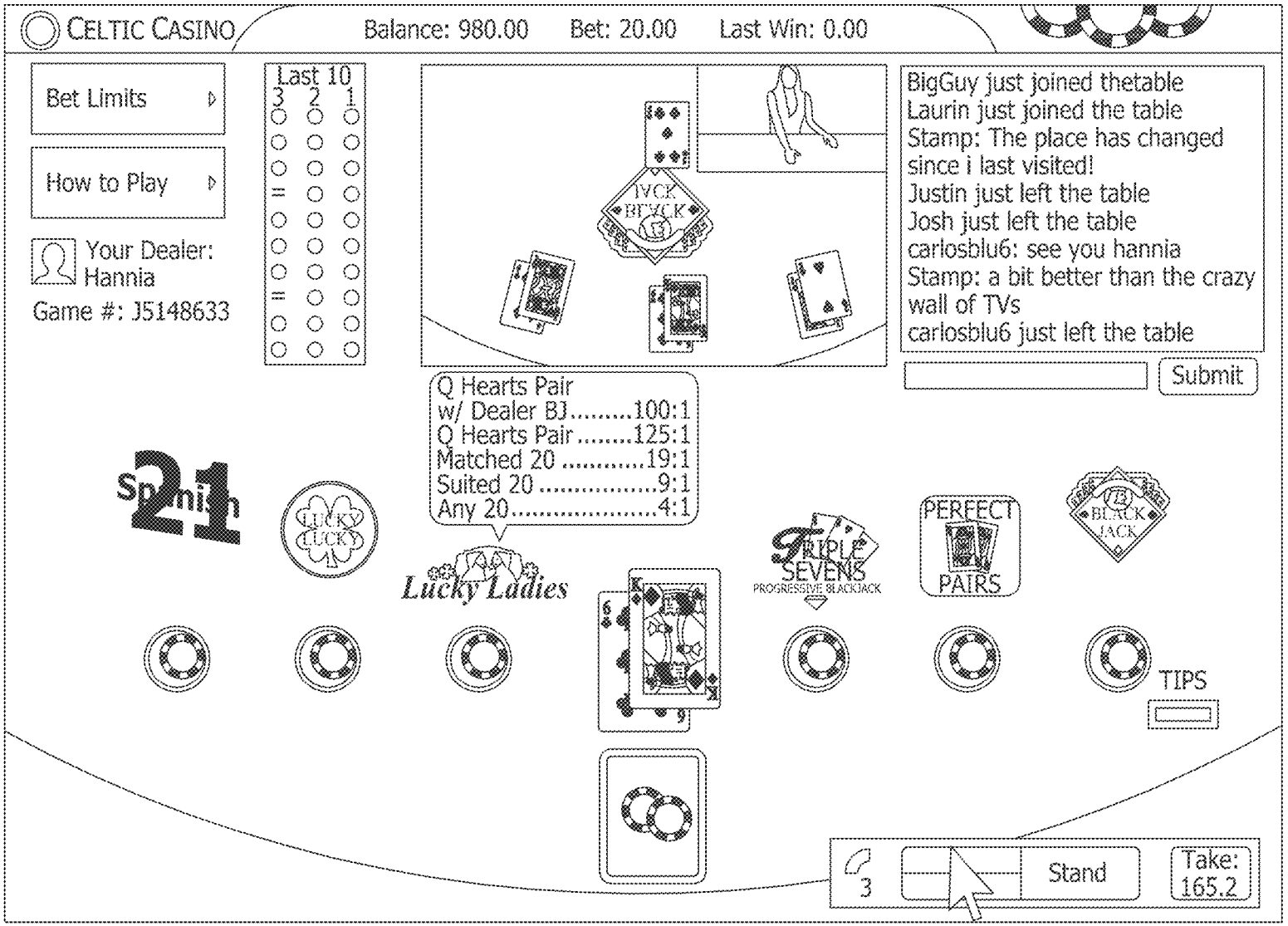
Figure 13B:
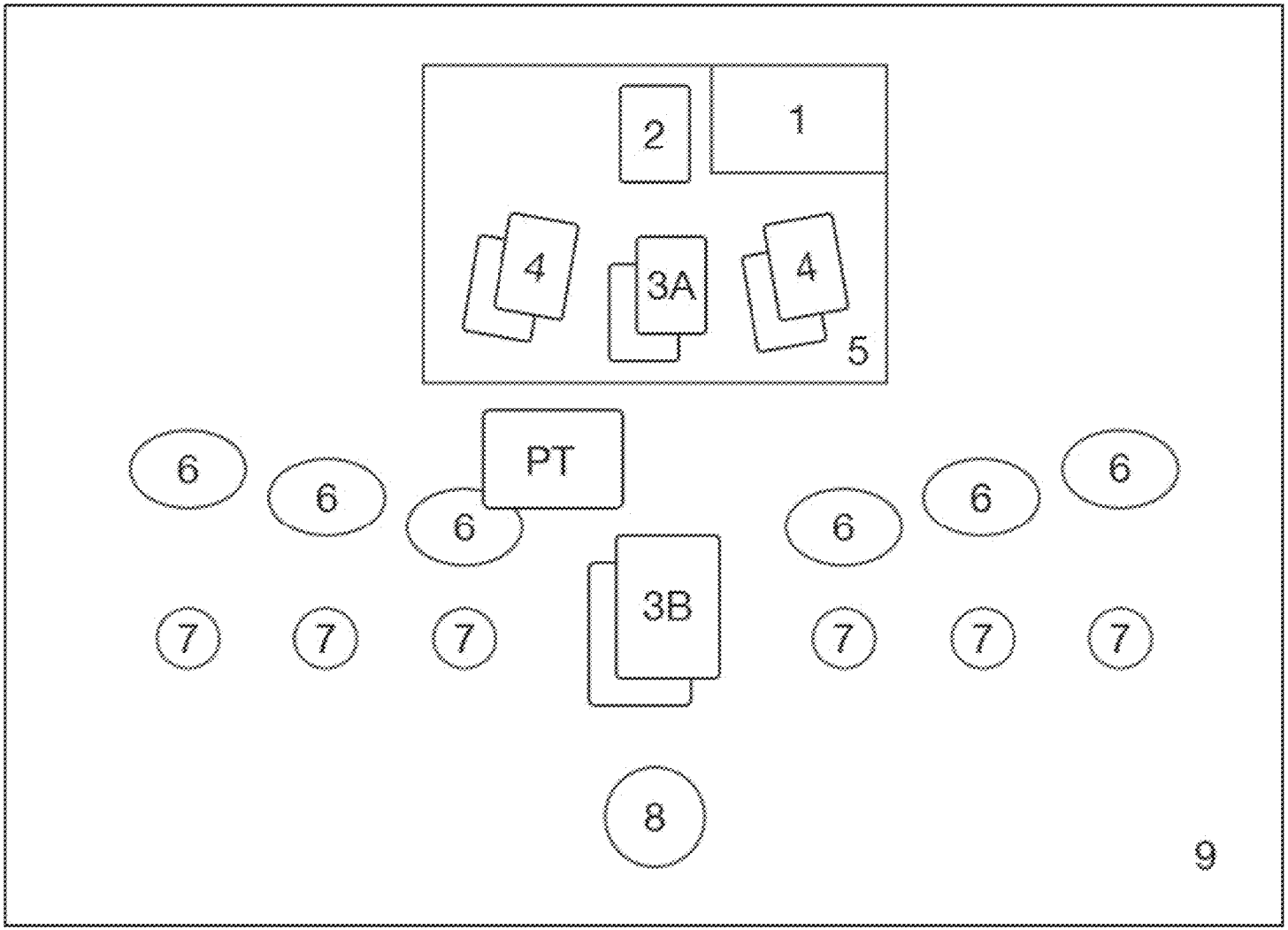
Figure 14A:
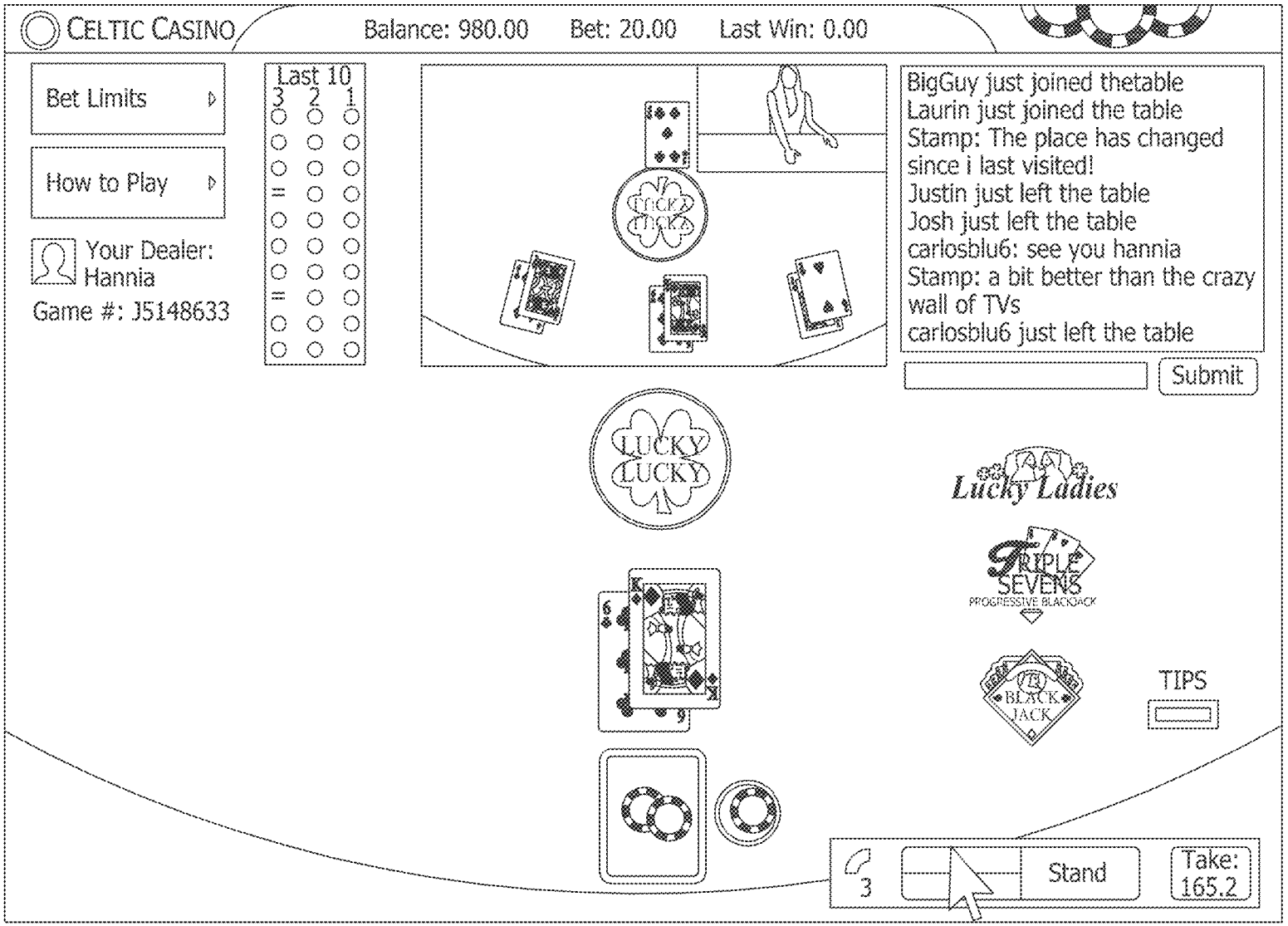
Figure 14B:
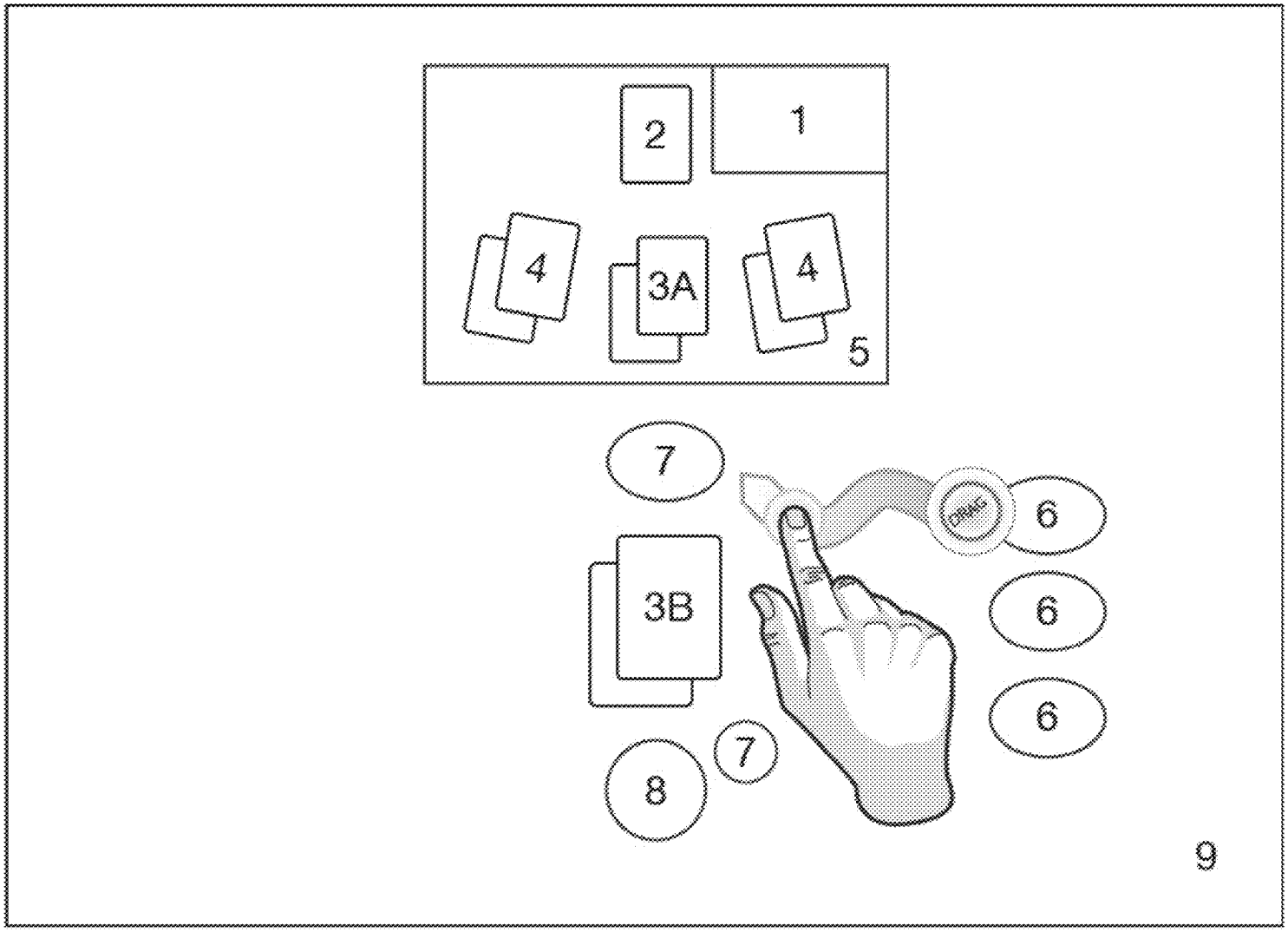
Figure 15A:
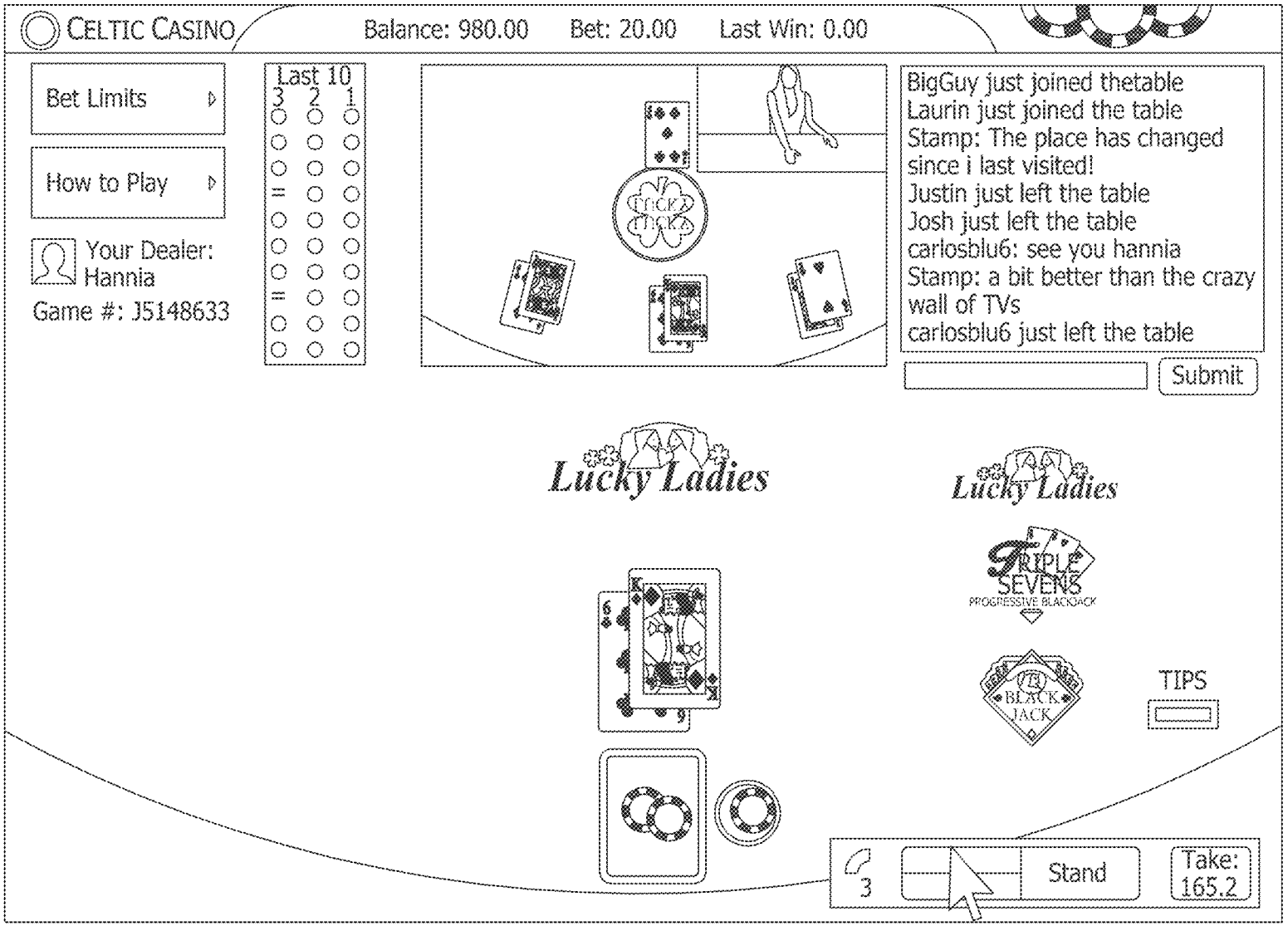
Figure 15B:
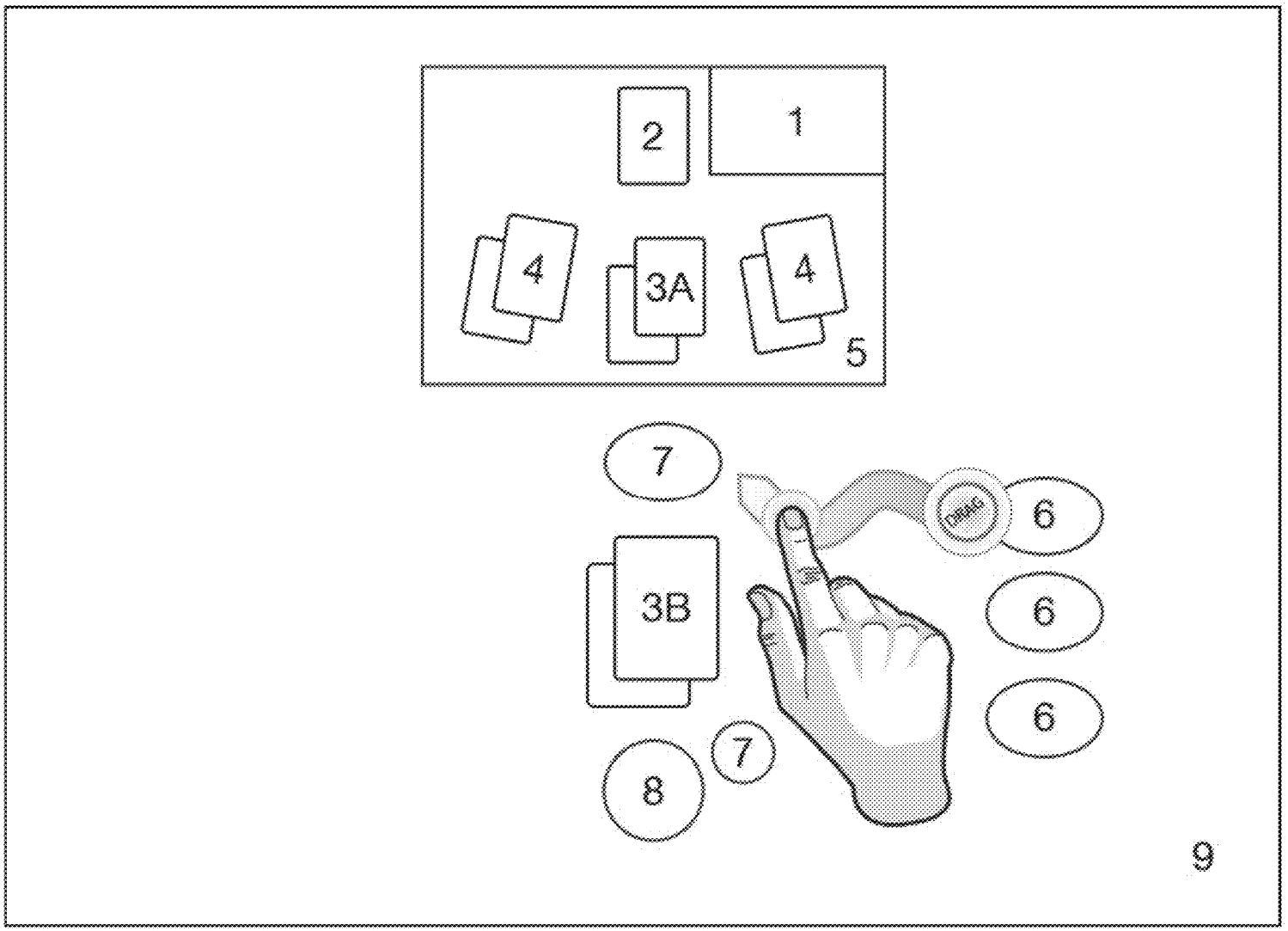

With reference to FIGS. 13A-13B, the display screens shown therein are similar to the display screens in FIGS. 11A-11B. A cursor in the shape of a hand is shown. If the cursor is placed over one of the indicia or game logos (or the indicia or game logo is selected) a pop-up paytable (PT) is displayed. The pop-up paytable for a game may be displayed relative to any logo or indicia for the respective game, i.e., sidebet, displayed anywhere on the display screen. The paytable may include not only the payouts for particular sidebet conditions, but also the maximums and minimums for that particular operator.

In general, the user interface defines how wagers may be made. In general, if for example, a virtual chip rack is used or displayed, the player could drag and drop chips representing the wager onto the wager area or one or more of the side bet areas. As discussed above, some other mechanism may be used to enter and place wagers.

With reference to FIGS. 14A-20B, in another embodiment the user interface allows the user or player to select one or more games or sidebets from a list of possible games or sidebets to play. In the illustrated embodiment, the player selects which game(s) or sidebet(s) to play by selecting and dragging and dropping an indicia for the desired game or sidebets onto the existing slot (or one of the existing slots).

In FIGS. 14A-15B, a live remote dealer implementation is shown in which only the player's hand is shown on the virtual field. In this embodiment, the player may only play one game/sidebet at a time. The available sidebets are shown on the right. Currently the player is playing Lucky Lucky Blackjack. To change from Lucky Lucky Blackjack to Lucky Ladies Blackjack, the player selects the Lucky Ladies Blackjack logo on the right and slides it over the Lucky Lucky Logo. Once released, the Lucky Ladies Logo replaces the Lucky Lucky Logo and the game switches over.

The changeover may include not only the logo, but may also include other look and feel elements including fonts, colors and other graphical elements. In general, such a changeover may only be performed between hands. In another aspect of the present invention, the system may provide a confirmation request to confirm that the player wants to changeover games.

Figure 16A:
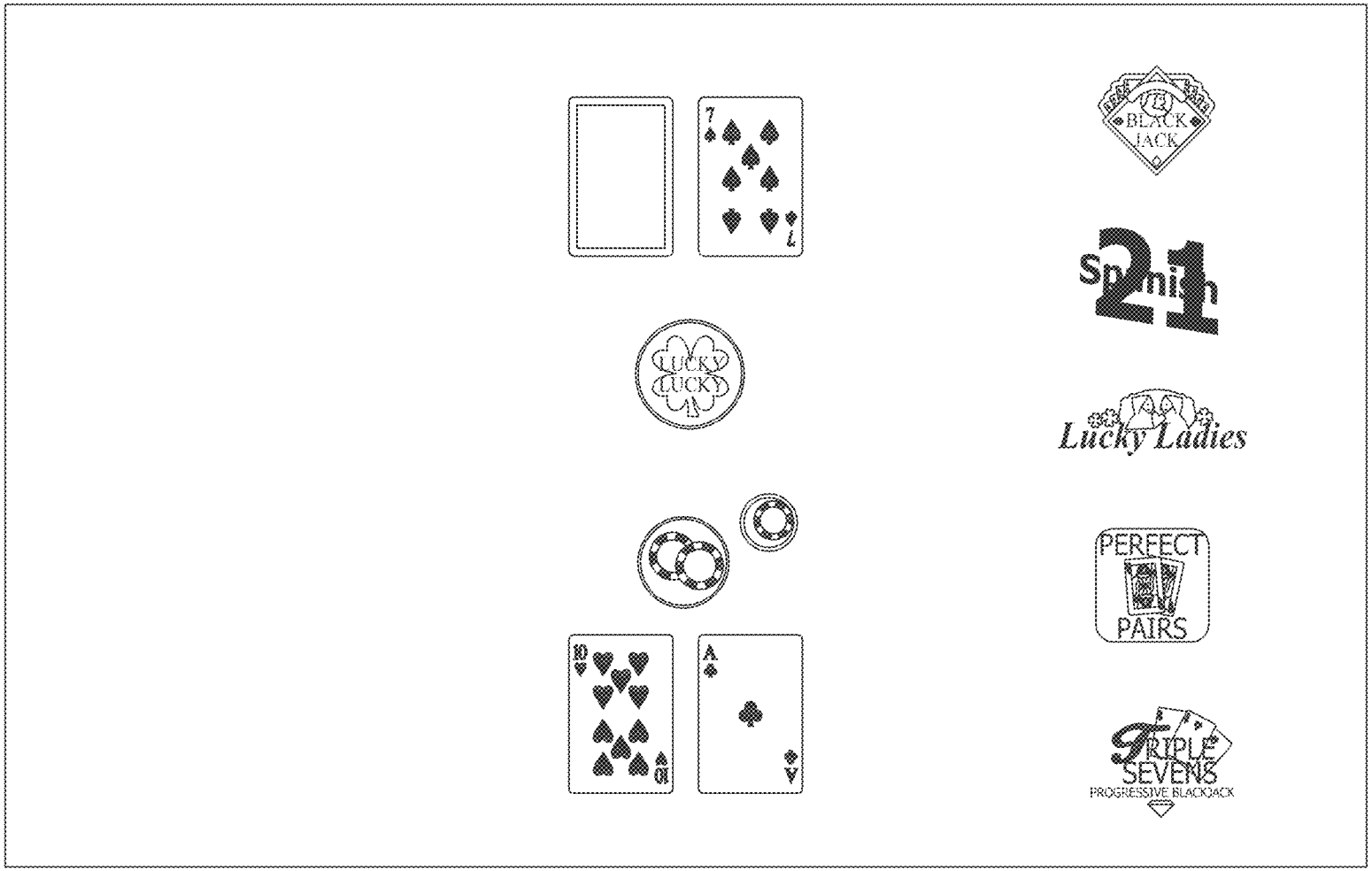
Figure 16B:
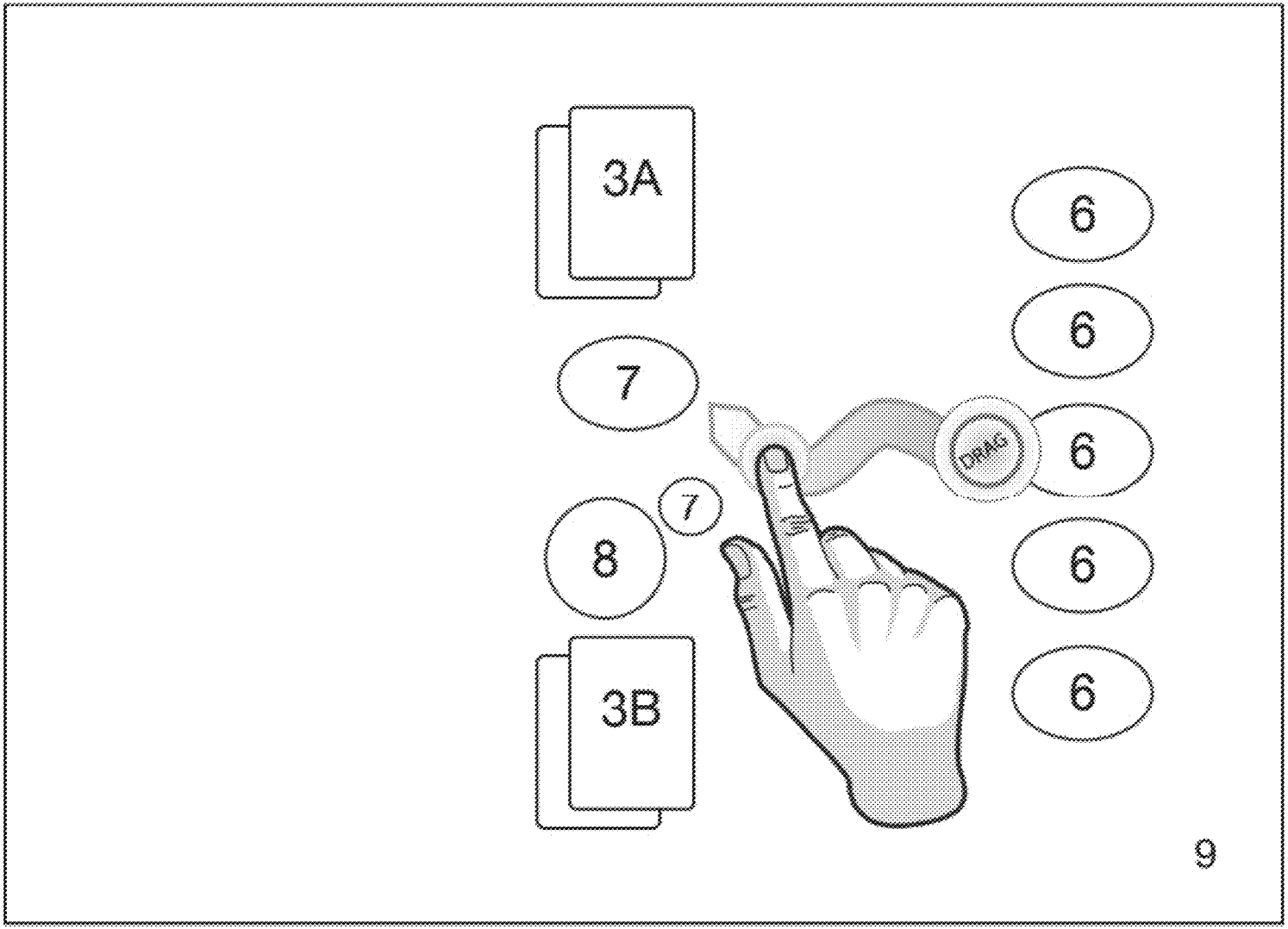
Figure 17A:
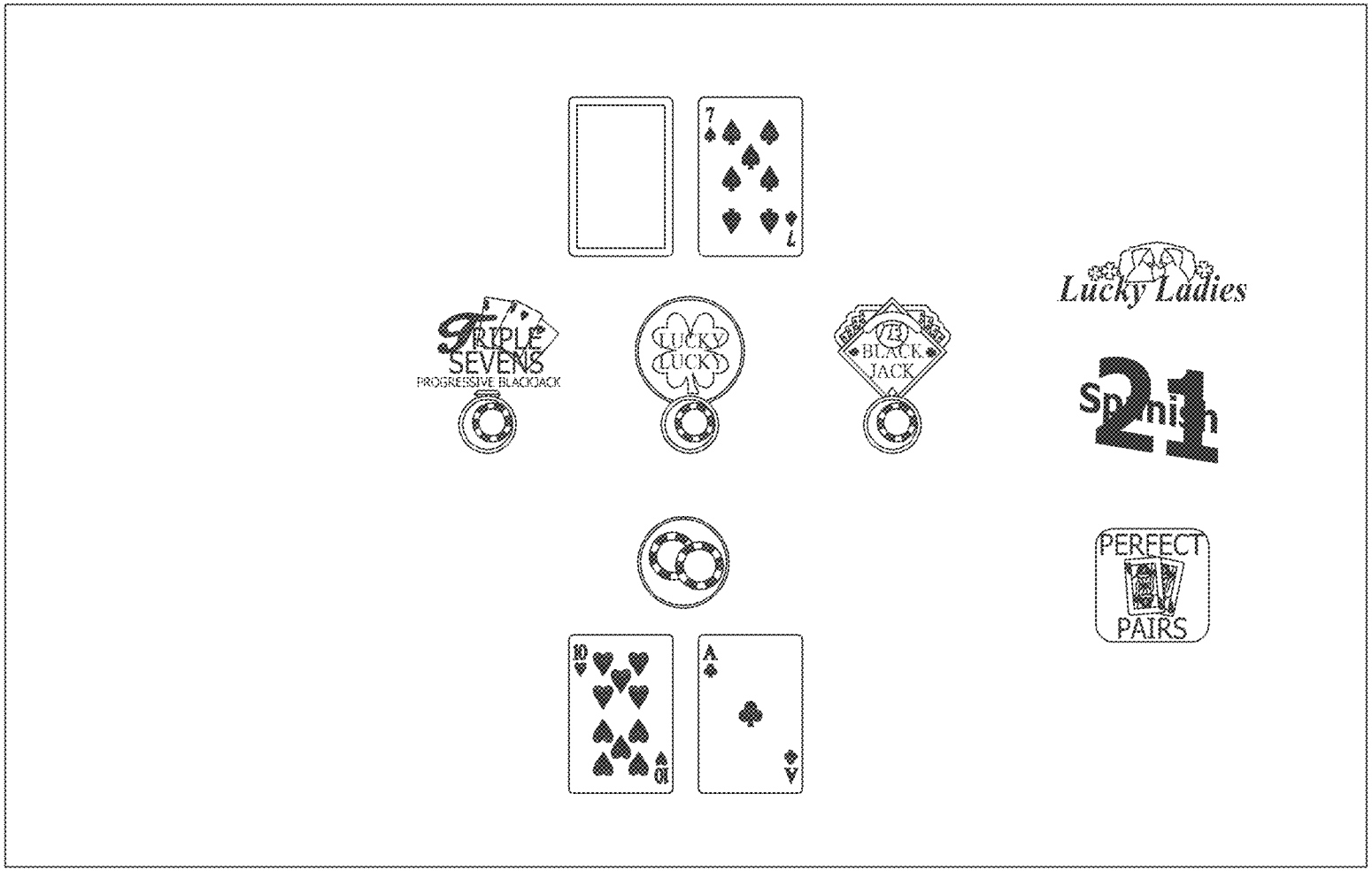
Figure 17B:
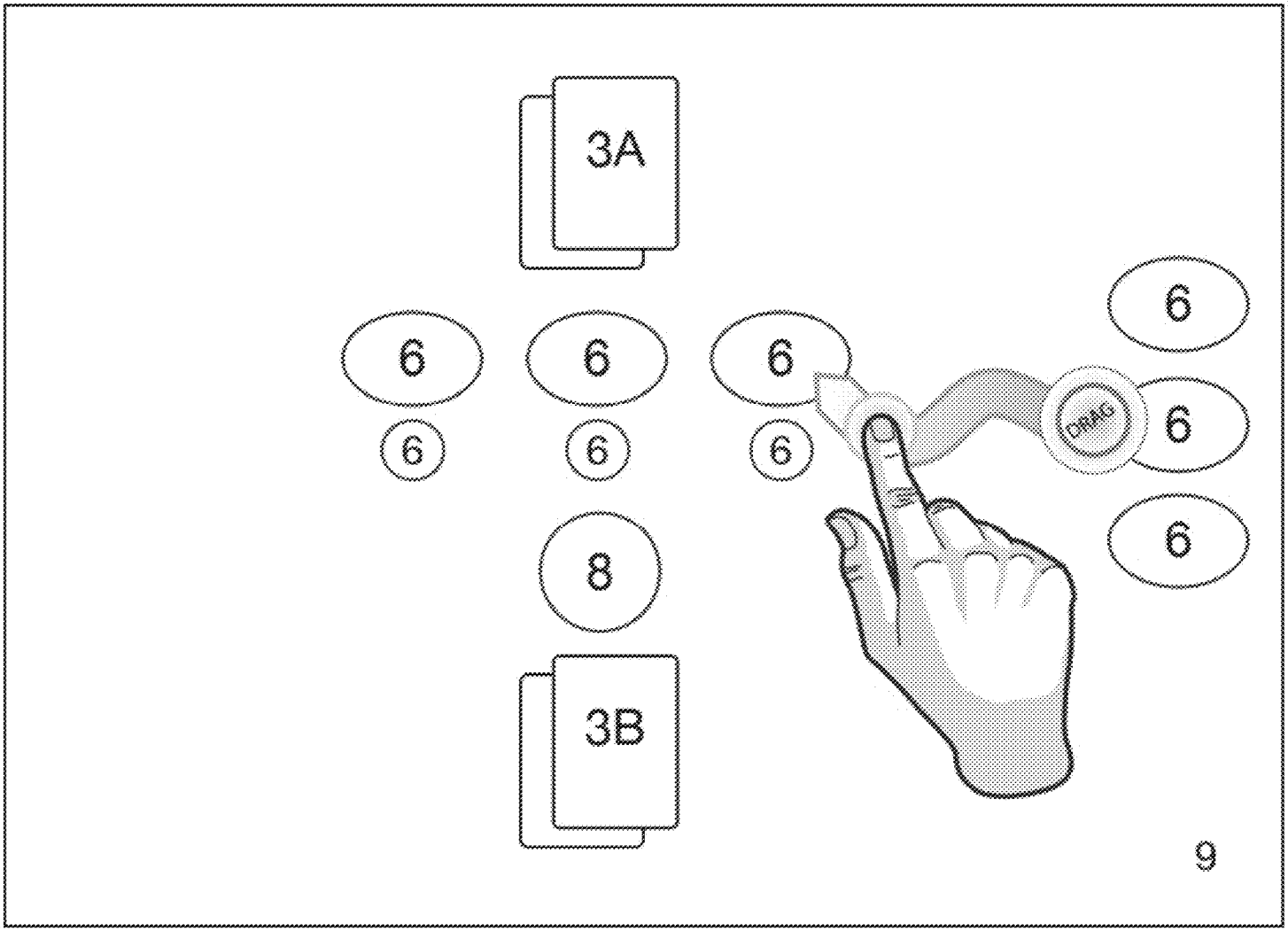
Figure 18A:
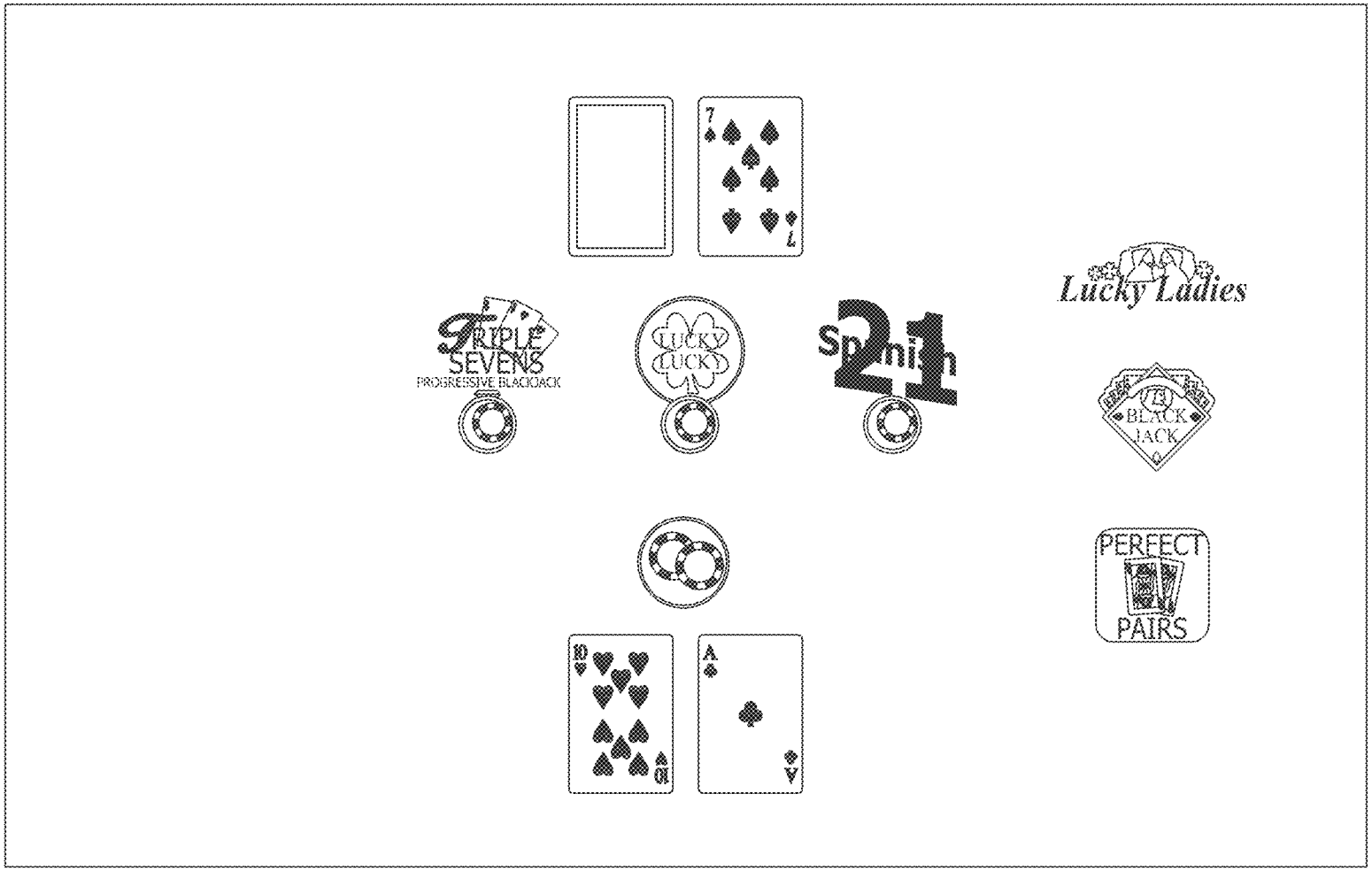
Figure 18B:
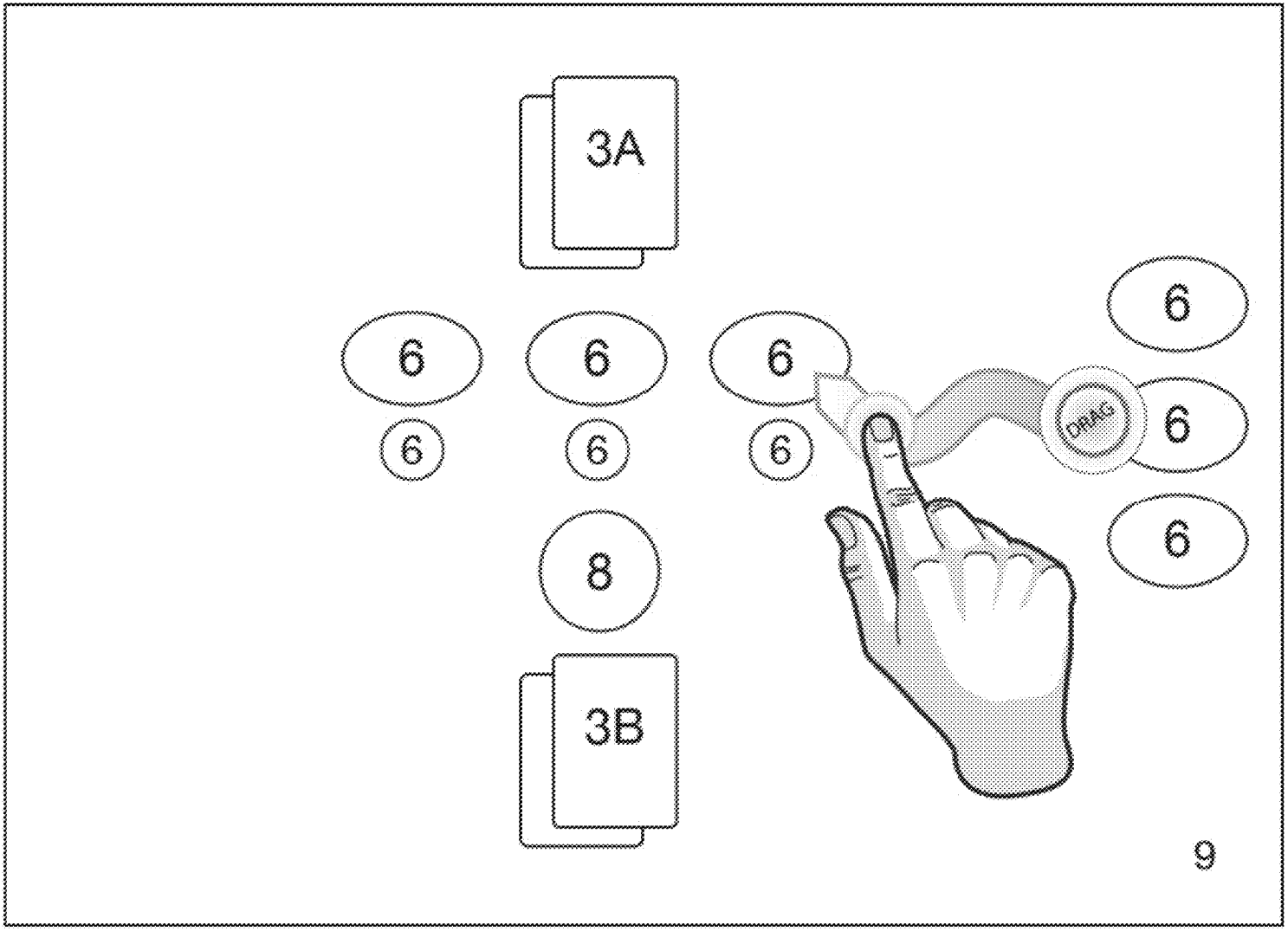

With respect to FIGS. 16A-16B, the same changeover feature may be applied to non-live remote dealer games. In this embodiment, the feature is applied to a stand-alone system which utilizes a RNG to determine the cards being played or the outcome of the game. In this embodiment, the player is playing solely against a dealer. However, the games or sidebets that the player may play are shown on the display screen. To change games or sidebets, the player simply selects, and drags and drops the logo of the desired game/sidebet to the sidebet slot (shown in the center). If there already is a logo in the slot, then the new logo replaces the logo in the center. The replaced logo may then appear in the list of the available of games/sidebets.

In FIGS. 17A-19B, the player may be allowed to play or place multiple sidebets each hand. As shown, in the illustrated embodiment, the player may play up to three games or sidebets each hand. There are three slots available which are displayed relative to the player station. The games or sidebets not being played may be illustrated off to the side of the player station. To select a new game or sidebet, the player selects and drags and drops one of the (non-played) logos and into one of the available slots. If the selected slot already contains a logo, it is replaced by the new logo.

In one aspect of the present invention, the user interface is fully customizable. The player or the operator may place various elements in different locations or positions on the display screen. With respect to the game or sidebets logos, the player may place the selected or played games around the player station in any manner the player desires. Alternatively, the system may automatically move or adjust the locations of the logos based on how many are being played (or not played) at any time. In one aspect to play a game, the player need only move the logo past a predetermined line on the screen. The line may or may not be visible. Alternatively, the player may only need to move the logo near the player station. The selected logos may be automatically arranged along a predetermined geometric element, such as a line or a curve.

Figure 19A:
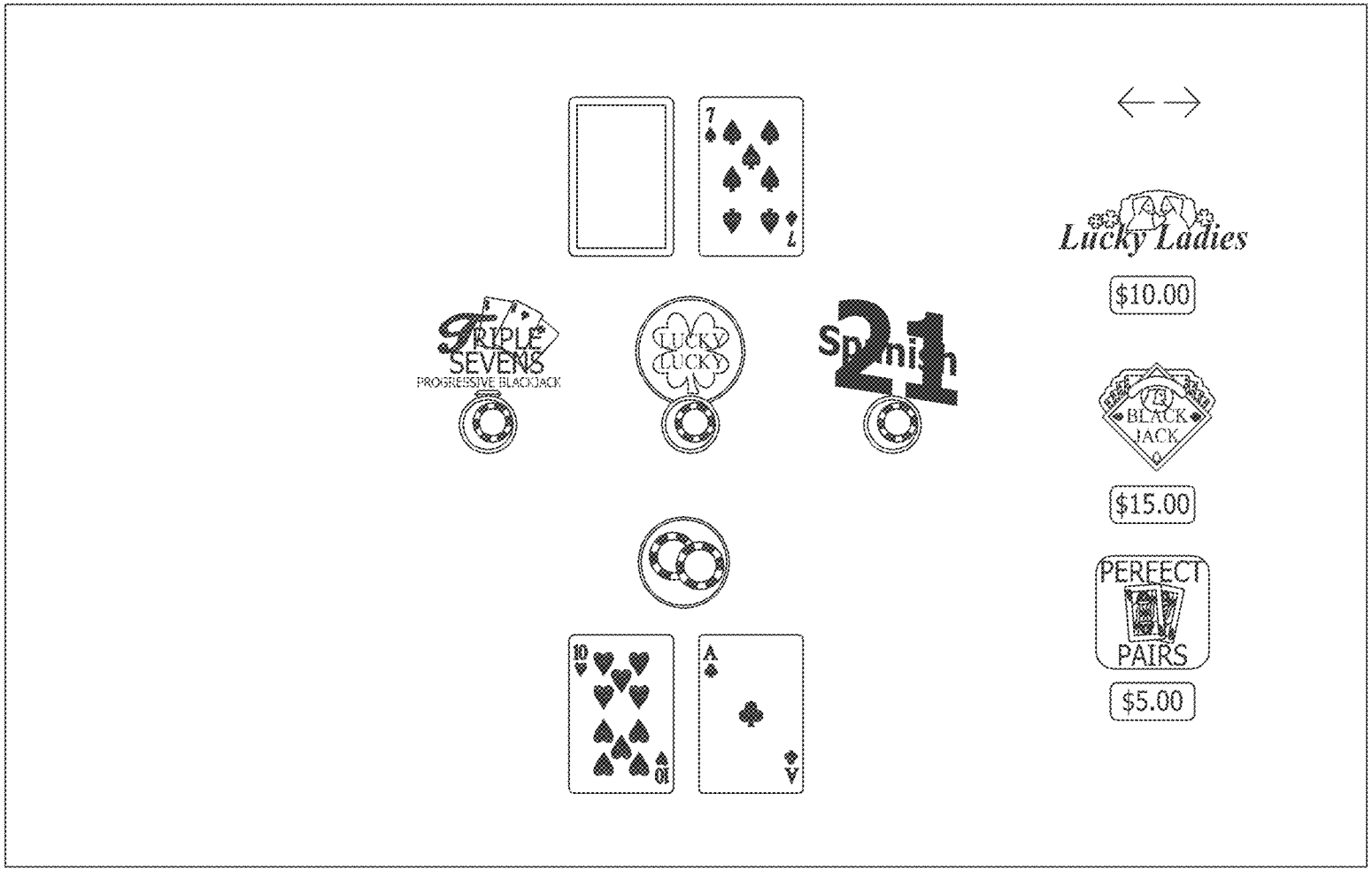
Figure 19B:
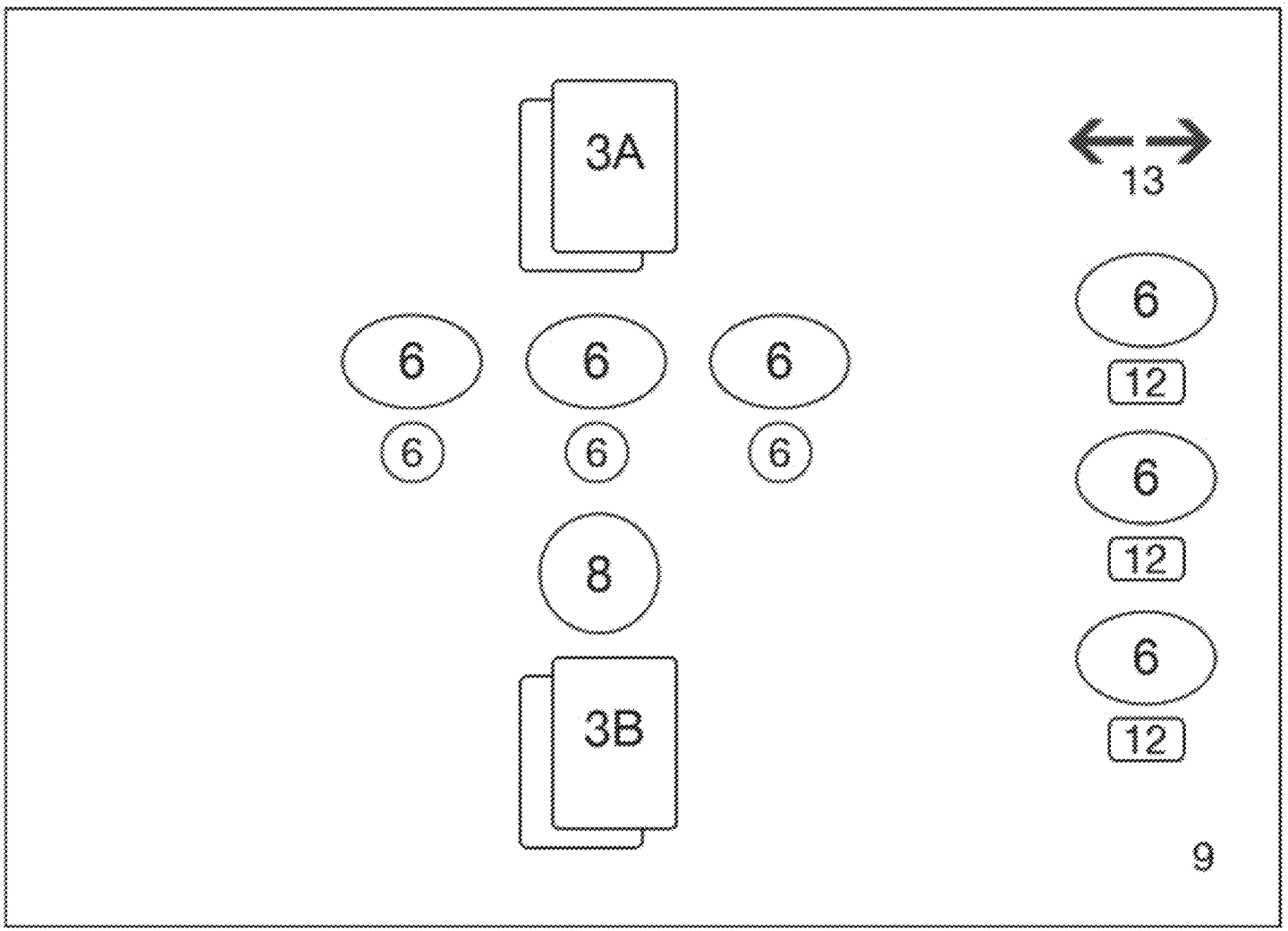

With respect to FIGS. 19A-19B, the amount that the player would or could have won for each non-played game or sidebet may be displayed.

Figure 20A:
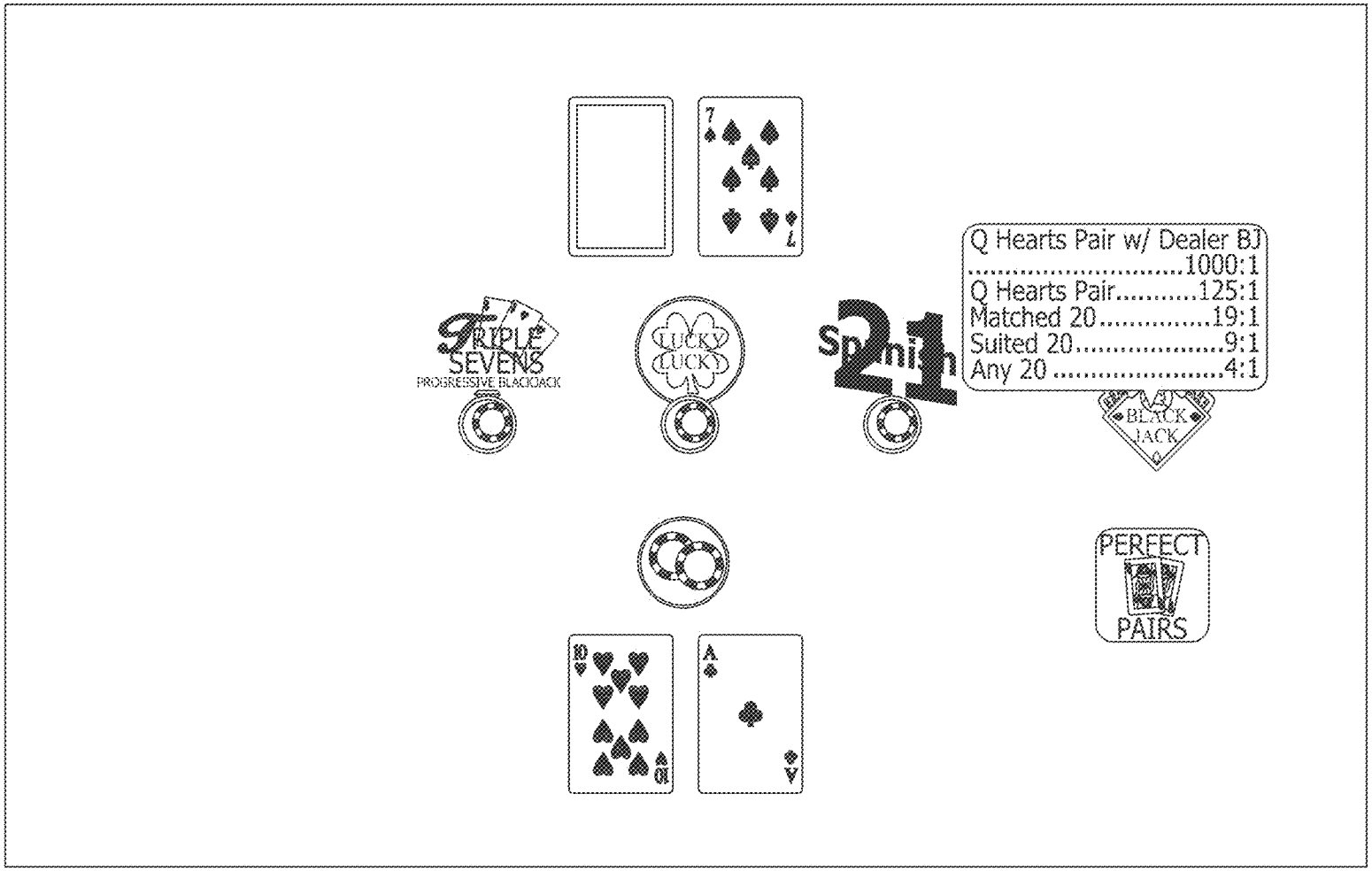
Figure 20B:
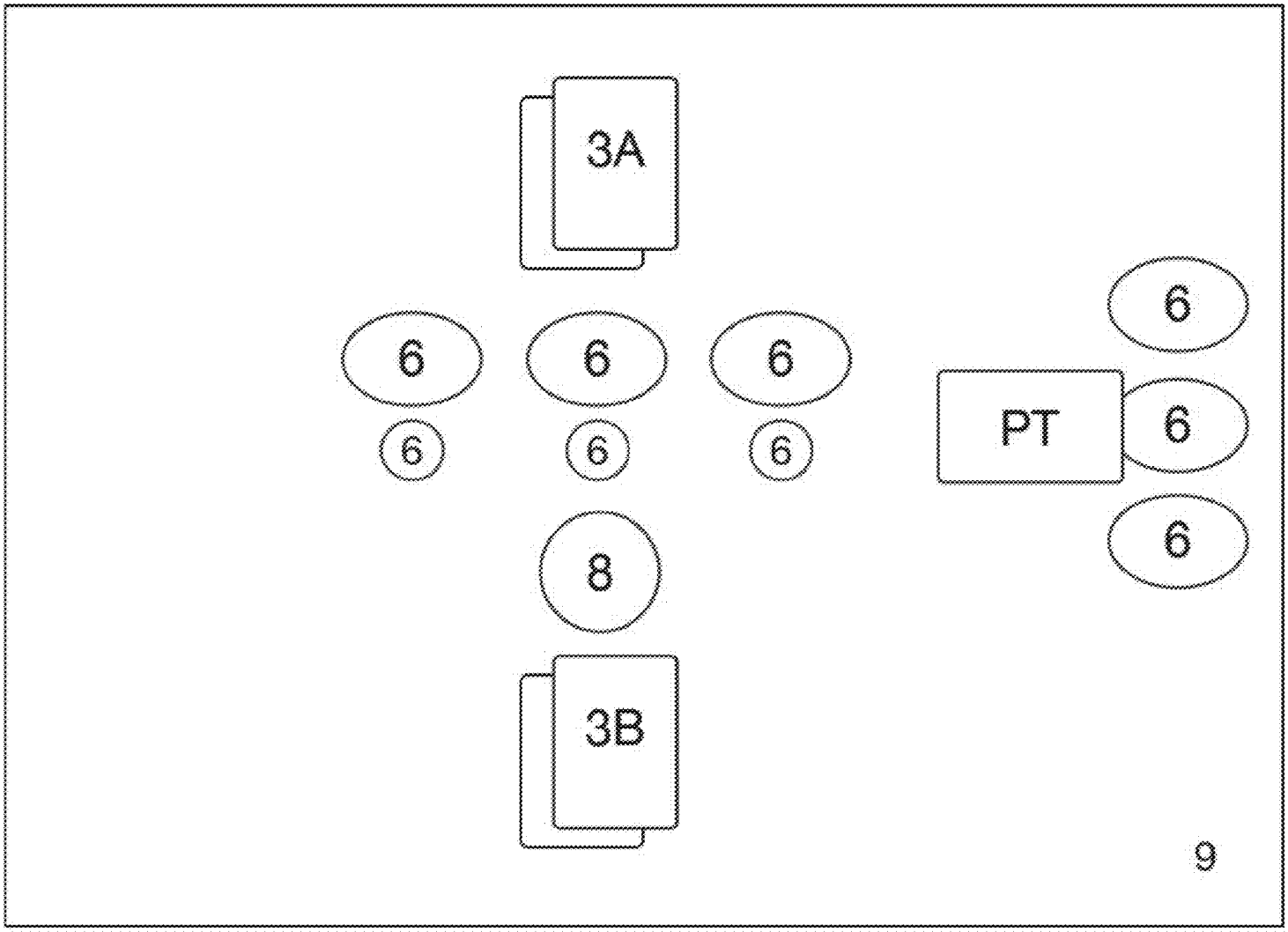

With respect to FIGS. 20A-20B, as discussed above, when the logo of either a played or non-played game is selected or highlighted, a pop-up paytable may be displayed.

In one aspect of the present invention, the above features are configurable by the player and/or provider. For instance, the player may be able to choose whether a single player display is used (meaning only their cards and sidebets are displayed in the virtual field 10) or whether a multi-player display is used (meaning all of the players' cards and sidebets are displayed in the virtual field 10) or each player may choose whether the chat window is displayed and available.

Further, while many of the features are discussed in the context of a live remote dealer system, some of the features are applicable, such as the configurable features, auto arranging features, and the provision of the multiple games/sidebets may be applied to other types of systems, such as stand-alone or networked games (single or multi-player) using a computer-based random number generator (RNG), instead of a live dealer.

Figure 21:
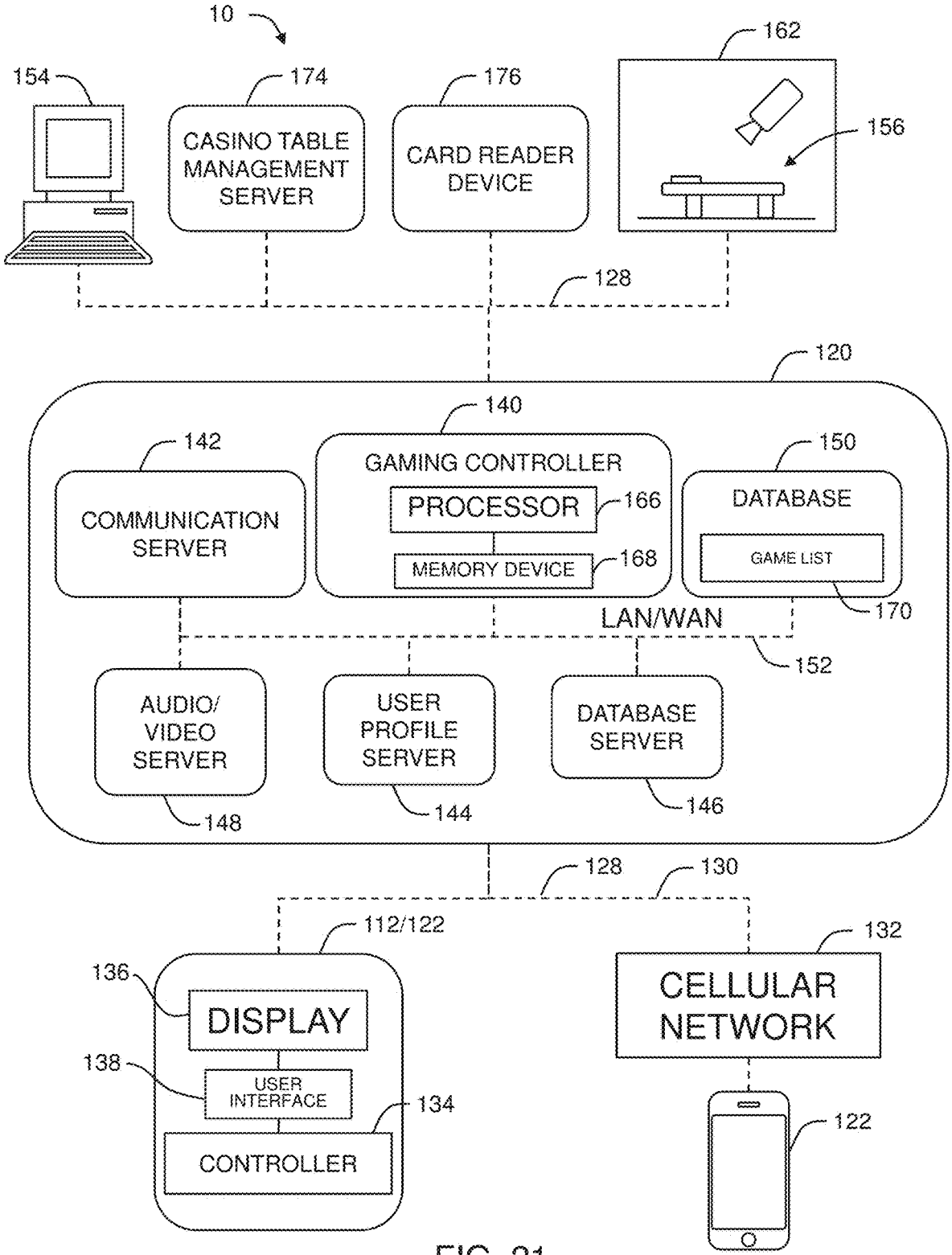
FIGS. 21 and 22 are schematic representations of the system shown in FIG. 1, according to an embodiment of the invention.
Figure 22:
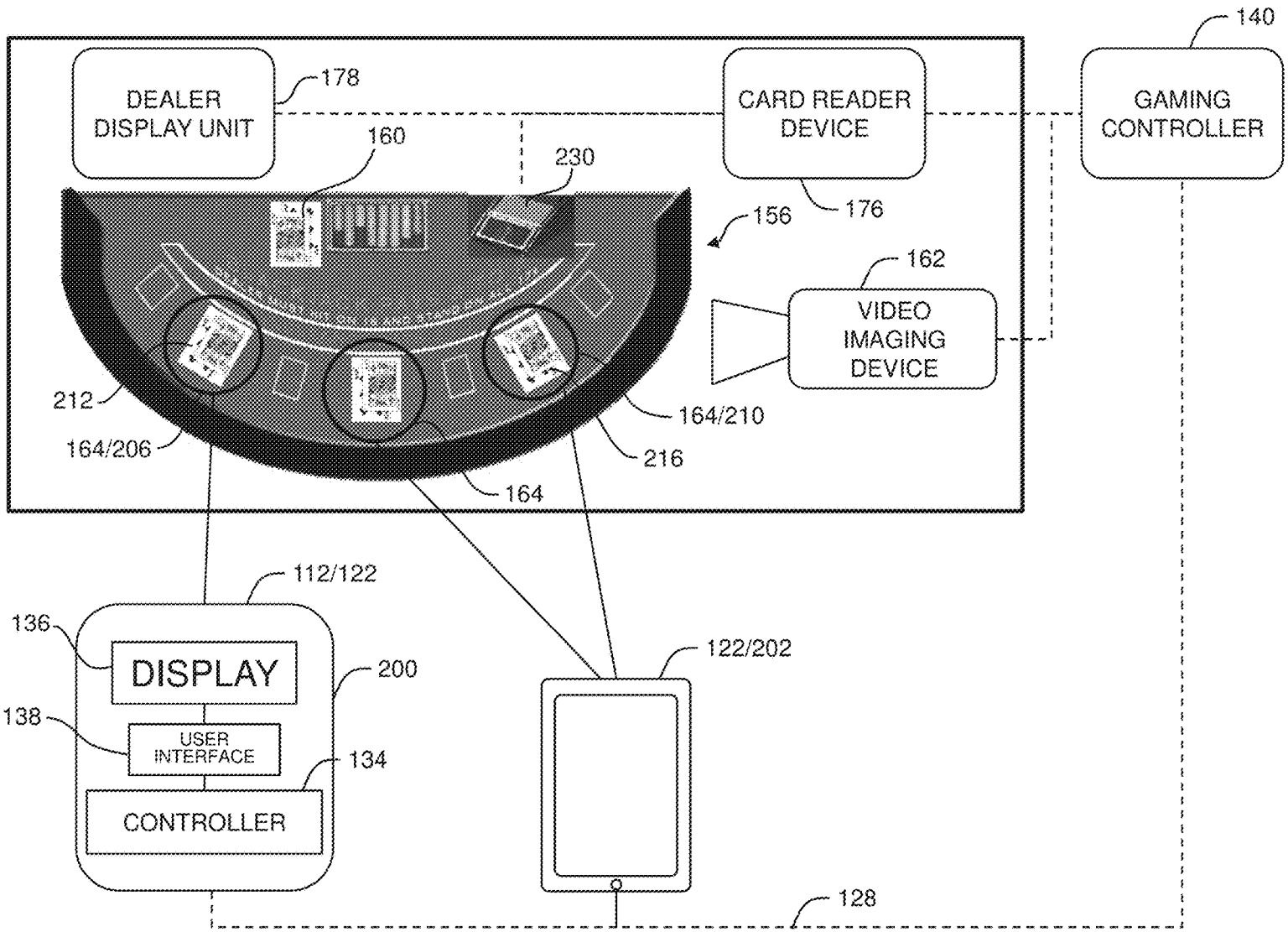

FIGS. 21 and 22 are schematic representations of the system 100, according to an embodiment of the invention. In one embodiment, the computer system 102 may include a server system 120 that is coupled to one or more remote devices 122 such as, for example, one or more remote stations 112. Each remote device 122 is configured to transmit and receive data to and/or from the server system 120 to display a game 124 and graphical interfaces 126 (shown in FIGS. 1A-20B) on the remote device 122 to enable a user to participate in live remote dealer games with the remote device 122. In the illustrated embodiment, the server system 120 is coupled to each remote device 122 via a communications link 128 that enables each remote device 122 to access server system 120 over a network 130 such as, for example, the Internet, a cellular telecommunications network 132, a wireless network and/or any suitable telecommunication network that enables the remote devices 122 to access the server system 120.

In the illustrated embodiment, each remote device 122 includes a controller 134 that is coupled to a display device 136 and a user input device 138. The controller 134 receives and transmits information to and from the server system 120 and displays the game 124 and the graphical interfaces 126 (shown in FIGS. 1A-20B) on the display device 136 to enable the user to interact with the server system 120 to play the games in accordance with the embodiments described herein. The display device 136 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data, video images, and/or text to a user. Moreover, the user input device 138 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 134 and/or to retrieve data from the controller 134. Alternatively, a single component, such as a touch screen, a capacitive touch screen, and/or a touchless screen, may function as both the display device 136 and as the user input device 138.

In the illustrated embodiment, the server system 120 includes a gaming controller 140, a communications server 142, a user profile server 144, a database server 146, an audio/video server 148, and a database 150 that are connected through a network 152 such as, for example, a local area network (LAN), a wide area network (WAN), dial-in-connections, cable modems, wireless modems, and/or special high-speed Integrated Services Digital Network (ISDN) lines. Moreover, at least one administrator workstation 154 may also be connected to the server system 120 to enable communication with the server system 120.

The communications server 142 communicates with the remote devices 122 and the administrator workstation 154 to facilitate transmitting data over the network 130 via the Internet and/or the cellular network 132, respectively.

The database server 146 is connected to the database 150 to facilitate transmitting data to and from the database 150. The database 150 contains information on a variety of matters, such as, for example, account information related to a user, user profile information, list of games, game types, sidebet types, game rules, wager amounts, wager types, a payout value associated with each wager, and image data for producing game images and/or screens on the remote device 122 and temporarily stores variables, parameters, and the like that are used by the gaming controller 140. In one embodiment, the database 150 includes a centralized database that is stored on the server system 120 and is accessed directly via the remote devices 122. In an alternative embodiment, the database 150 is stored remotely from the server system 120 and may be non-centralized.

The audio/video server 148 is configured to broadcast images of a live gaming table 156 to the remote devices 122 to allow players to view streaming video images of a live dealer 158 dealing physical playing cards 160 in a game. In the illustrated embodiment, the audio/video server 148 is connected to an image broadcast system 162 that is configured to generate video images of a live gaming table 156 including images of a dealer 158 dealing physical playing cards to a plurality of player stations 164 associated with the gaming table 156. In one embodiment, the image broadcast system 162 includes a video imaging device such as, for example, a video camera that is configured to capture and transmit images of the dealer 158 and the live gaming table 156. The audio/video server 148 is configured to receive and record the images from the image broadcast system 162 and transmit the images to the remote devices 122. For example, in one embodiment, the server system 120 is configured to broadcast an image of a dealer 158 and the gaming table 156 (shown in FIG. 1A) to display the dealer dealing playing cards to the player stations 164. In addition, the audio/video server 148 may delay the broadcast of the dealer and the gaming table 156 for a predefined period of time, and/or broadcast a prerecorded live table game associated with a game outcome determined by the gaming controller 140.

The gaming controller 140 includes a processor 166 and a memory device 168 that is coupled to the processor 166. The memory device 168 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 166 to store, retrieve, and/or execute instructions and/or data.

The processor 166 executes various programs, and thereby controls other components of the server system 120 and the remote device 122 according to user instructions and data received from the remote devices 122. The processor 166 in particular displays the graphical interfaces 126 (shown in FIGS. 1A-20B) and executes a game program, and thereby enables the system 100 to generate games and allow the user to play the games in response to user instructions received via the remote devices 122 in accordance with the embodiments described herein. The memory device 168 stores programs and information used by the processor 166. Moreover, the memory device 168 stores and retrieves information in the database 150 including, but not limited to, image data for producing images and/or screens on the display device 136, and temporarily stores variables, parameters, and the like that are used by the processor 166. In addition, the memory device 168 may store a game list 170 that includes a list of games that are available to the player. The game list 170 may include information associated with each game including, but not limited to, game rules, game denominations, wager types, symbol images, table images, card images, card values, game types, and/or any suitable information that enables the system 100 to function as described herein.

In the illustrated embodiment, the user profile server 144 stores information associated with a plurality of user profile accounts and a plurality of corresponding unique user identifiers in a user profile program in the database 150. In the illustrated embodiment, the user profile server 144 uses the unique user identifier to identify the user profile account associated with the unique user identifier and provide the user access to the server system 120 to initiate a gaming session via a remote device 122. In one embodiment, the unique user identifier may include a combination of a username and password. Each user profile account may also include personal identification information such as, for example, a user name, address, personal identification number, date of birth, email address, mobile phone number, and/or any suitable information that enables the user profile server 144 to identify a user.

In the illustrated embodiment, each user profile account also includes financial account information associated with each user. The financial account information may include, but is not limited to, an amount of game credits available for use in playing games, available monetary funds for use in purchasing game credits, an available game credit account balance, and/or any suitable financial information that enables the system 100 to function as described herein.

In the illustrated embodiment, the workstation 154 includes a display and user input device to enable an administrative user to access the server system 120 to transmit data indicative of the games, game rules, and/or game awards to the database server 146. This enables an administrative user to periodically update the game list, game types, game rules, wager types, available awards, user profile accounts, and/or any suitable data and information that enables the system 100 to function as described herein.

In one embodiment, the server system 120 may also be adapted to communicate with a casino table management server 174 to acquire information being associated with gaming tables 156 within a casino property. For example, the casino table management server 174 may include information associated with gaming tables 156 including, but not limited to, a number of gaming tables 156 within a corresponding casino property, current players associated with each gaming table 156, available gaming tables 156, available player stations 164, gaming table occupancy, and/or any suitable information associated with gaming tables 156 that enable the system 100 to function as described herein.

In the illustrated embodiment, the system 100 may also include one or more card reader devices 176 that are coupled to the server system 120 for providing information indicative of a playing card being dealt by a dealer. In one embodiment, the system 100 may include a plurality of gaming tables 156. Each gaming table 156 may include a corresponding card reader device 176 that is adapted to identify each playing card being dealt by an associated dealer and transmit the information indicative of the identified playing card to the gaming controller 140. The card reader device 176 may include, but is not limited to, a barcode reader, a magnetic card reader, a RFID card reader, and/or camera or video based or some other technology.

In one embodiment, the system 100 may also include a dealer display device 178 that is configured to display the game 124 including images that are indicative of player's selections being made during the game 124 to allow the dealer to distribute playing cards in response to selections made by each of the players. The dealer display device 178 may be coupled to the gaming table 156 and positioned to enable the dealer to view the dealer display device 178 to facilitate conducting the game 124 in response to selections being made by the players with the remote devices 122. In one embodiment, the gaming controller 140 may display the game screen 180 on the dealer display device 178 including an indication of each selection being made by one or more players during play of the game. Moreover, the gaming controller 140 may receive a player selection via a remote device 122 and display an image indicative of the player's selection on the dealer display device 178 to provide a notification to the dealer of the player's selection. For example, in one embodiment, as shown in FIG. 1A, the gaming controller 140 may display the game screen 180 including plurality of player selectable areas 182 that correspond with actions a player may request during play of the game. Upon receiving a signal indicative of a player's selection, the gaming controller 140 may display a corresponding notification on the dealer display device 178.

Figure 23:
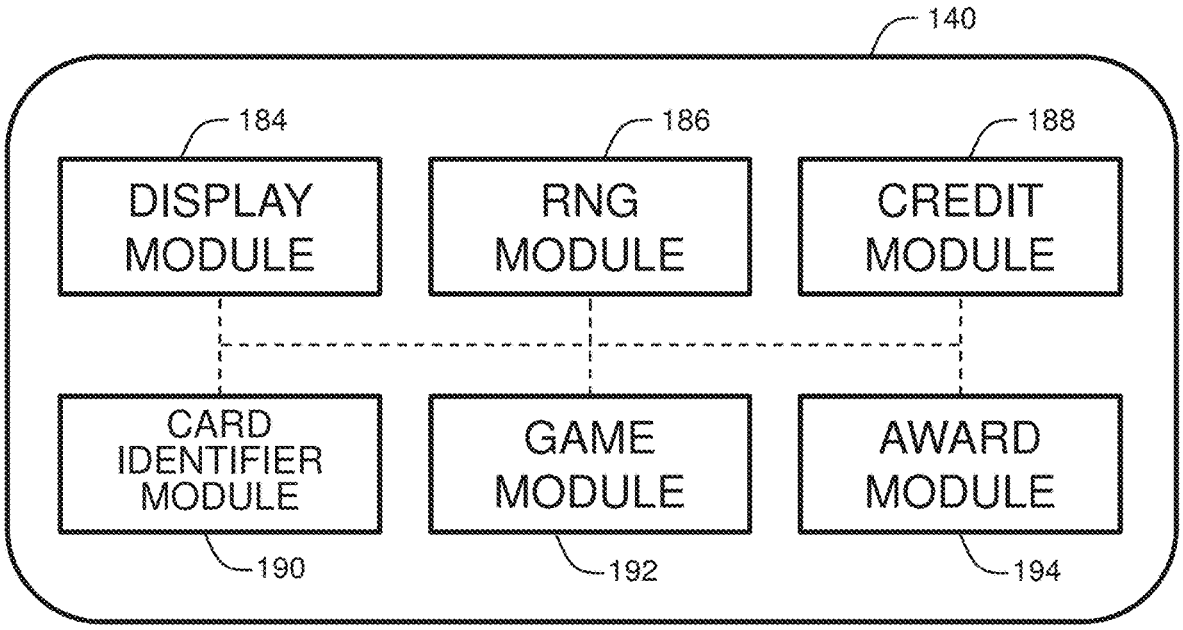
FIG. 23 is a schematic view of a gaming controller that may be used with the system shown in FIGS. 1, 21, and 22.

FIG. 23 is schematic view of the gaming controller 140. In the illustrated embodiment, the gaming controller 140 includes a display module 184, a random-number generator (RNG) module 186, a credit module 188, a card identifier module 190, a game module 192, and an award module 194. The gaming controller 140 may be configured display a plurality of games on each of a plurality of remote devices 122. Each of the plurality of games may be played with the same deck of playing cards 160 being dealt by the same live dealer 158 on the same gaming table 156. Each game 124 may be associated with a different game rule. Each game rule may include a set of game attributes including, but not limited to, wager types, wager denominations, sidebets, table images, table layouts, player hands, dealer hands, card values, award values, winning combinations, symbol images, game symbols, paytables, and/or any suitable game attribute that may be associated with game play.

In the illustrated embodiment, the gaming controller 140 displays a video image on each of the remote devices 122 that includes the physical gaming table 156 and the associated dealer 158 distributing a plurality of player hands 196 being dealt from a deck of randomly-ordered physical playing cards 160. In addition, the gaming controller 140 may assign each player station 164 to a corresponding remote device 122 such that the player hand 196 being dealt to the assigned player station 164 is being played by the player associated with the corresponding remote device 122.

For example, in one embodiment, the gaming controller 140 may receive a first request to play a game from a first player via a first remote device 200 and receive a second request from a second player to play a game via a second remote device 202. The gaming controller 140 may select a first game 204 in response to the first request and associate a first player station 206 with the first game 204. The gaming controller 140 may also select a second game 208 in response to the second request and associate a second player station 210 with the second game 208. The gaming controller 140 may also simultaneously display the first game 204 (shown in FIG. 1A) on the first remote device 200 and display the second game 208 (shown in FIG. 2A) on the second remote device 202. The gaming controller 140 may also display the video image of the gaming table 156 and the dealer 158 on each of the first remote device 200 and the second remote device 202.

During play of the first game 204 and the second game 208, the dealer 158 distributes player hands 196 from the deck of randomly-ordered physical playing cards 160 to each of the assigned player stations 164. Moreover, the gaming controller 140 may receive a signal from the card reader device 176 indicative of a first player hand 212 being dealt by the dealer to the first player station 206 and display an image of a simulated first player hand 214 on the first remote device 200. Similarly, the gaming controller 140 may receive a signal from the card reader device 176 indicative of a second player hand 216 being dealt by the dealer to the second player station 210 and display an image of a simulated second player hand 218 on the second remote device 202. The gaming controller 140 may also receive player input from each of the first and second remote devices 200 and 202 and display the corresponding player input on the dealer display device 178 to allow the dealer to deal one or more additional playing cards 160 to the player hands 196 in response to the received player input.

In the illustrated embodiment, the gaming controller 140 determines a first outcome of the first game 204 as a function of the first player hand 212, determines a second outcome of the second game 208 as a function of the second player hand 216, and responsively provides an award to the first player and/or the second player as a function of the first and second outcomes. In one embodiment, the first game 204 and the second game 208 may each be played with a different game rule. Moreover, the gaming controller 140 may determine the first outcome as a function of a first game rule being associated with the first game 204 and determine the second outcome of the second game 208 as a function of a second game rule that is different than the first game rule. In one embodiment, the gaming controller 140 may also display each game including a different table image that is indicative of the corresponding game rule. In one embodiment, the gaming controller 140 may display the first game 204 including a first table image 220 and display the second game 208 including a second table image 222 that is different from the first table image 220. For example, the first game 204 may be displayed with a first table image 220 including a logo, a table orientation, playing card images, and/or wagering chips, and the second game 208 may be displayed with a second table image 222 including a different logo, different table orientation, different playing card images and/or different wagering chips.

The display module 184 controls the display device 136 to display various images on the graphical interface 126 preferably by using computer graphics and image data stored in the database 150. More specifically, the display module 184 controls the symbols being displayed in a game such as, for example, a blackjack type card game 124 (shown in FIGS. 1A-20B) on the display device 136 by using computer graphics and the image data. The display module 184 also displays a plurality of user selection areas 182 (shown in FIGS. 1A-20B) within the graphical interface 126 that correspond to specific operations that may be initiated by the user. In the illustrated embodiment, the display module 184 is configured to display a broadcast video image of a live table game being played in a casino property. The display module 184 may display a game screen 180 including a dealer display area 224 and a player display area 226. The dealer display area 224 includes a broadcast video image including a live gaming table 156

(FIGS. 1A-20B) and associated dealer 158. The player display area 226 may also include a betting area include simulated images of betting chips for use by the player in placing one or more wagers on the outcome of the blackjack-type card game 124. In addition, the player display area 226 may also include simulated images of playing cards being dealt by the dealer. Moreover, in one embodiment, the player display area 226 may include a plurality of games that may be selected and/or being played by the player (shown in FIGS. 27-29).

In one embodiment, the display module 184 may display dealer display area 224 including a first image of a player hand 196 including a video image of the physical playing cards 160 associated with the player hand 196, and display the player display area 226 including a second image of the player hand 196 including simulated playing cards 228 that are indicative of the physical playing cards 160 being included in the corresponding player hand 196.

The credit module 188 communicates with the user profile server 144 to manage the amount of player's credits available for use in playing the games. The credit module 188 receives a user selection indicative of a request from a remote device 122 to place one or more wagers on a game including an amount of game credits associated with each wager. The credit module 188 sends a verification message to the user profile server 144 including a unique user identifier and a game credit amount associated with the requested wagers. The user profile server 144 identifies the user profile account associated with the unique user identifier and determines an amount of wagering credits available in the user profile account as a function of the user request.

The card identifier module 190 receives information indicative of a playing card being dealt by the dealer and transmits the information to the game module 192 for use in playing the game 124. In one embodiment, the card identifier module 190 receives playing card information from the card reader device 176. For example, in one embodiment, during the game 124, the dealer deals a plurality of card hands to one or more player stations 164 included with a gaming table 156. Each card hand is dealt from one or more decks of physical playing cards 160 being stored in a card shoe 230. Moreover, in one embodiment, the card reader device 176 may be coupled to the card shoe 230 for reading information associated with each playing card 160 being dealt from the card shoe 230 by the dealer. In addition, the card reader device 176 transmits the playing card information to the card identifier module 190 when the associated playing card 160 is dealt by the dealer. In one embodiment, the card identifier module 190 receives the playing card information, determines the player station 164 receiving the dealt playing card, and assigns the playing card to the corresponding player station 164 and/or corresponding player.

The game module 192 includes a game program for use in playing a game based on user selection input received from a remote device 122. The game module 192 receives game information included in the database 150 and performs various functions and calculations to play the game according to player input and an associated game rule. More specifically, the game module 192 retrieves game elements from the database 150 and causes the display module 184 to display the game 124 on the remote device 122. The game module 192 receives signals indicative of a user selection input via the user input device 138, generates an outcome of the game 124 based on the associated game rule and the received user selection input, and displays the game outcome on the display device 136.

In the illustrated embodiment, the game module 192 receives a request to play a game from a remote device 122 and responsively displays the player selected game 124 on the remote device 122. Moreover, the game module 192 may determine if a player station 164 is available at a gaming table 156 and assign the player station 164 to the player and/or the remote device 122. The game module 192 may also determine a game rule being associated with the selected game, display the selected game 124 on the remote device 122 including images and symbols indicative of the corresponding game rule, and allow the player to play the game 124 with the remote device 122. During play of the game 124, the game module 192 receives signals from the card reader device 176 that are indicative of playing cards being dealt by the dealer 158, determines a player hand 196 being dealt to the assigned player station 164, and displays the simulated player hand 232 on the remote device 122. Moreover, the game module 192 determines an outcome of the game based on the player hand 196 and the associated game rule. In addition, the game module 192 may also receive a signal indicative of a dealer hand 234 being dealt by the dealer 158 and may determine an outcome of the game as a function of the dealer hand 234 and the player hand 196.

In one embodiment, the game module 192 may receive a request to play a plurality of games on a remote device 122, associate a player station 164 to each of the selected games, and simultaneously display each of the selected games on the remote device 122 to allow the player to play the plurality of selected games. Moreover, one or more of the selected games may include different game rules. The game module 192 may also determine a physical player hand 196 being dealt to each of the associated player stations 164 and responsively display corresponding simulated player hands 232 on the remote device 122 to allow the player to the play multiple games with multiple player stations 164. In one embodiment, each player station 164 is associated with the same gaming table 156. In another embodiment, one or more player stations 164 may be associated with a different gaming table 156 having a different dealer and playing card deck.

The award module 194 receives the determined outcome from the game module 192 and compares the game outcome with winning combinations stored in a winning combination table to determine if the game outcome includes a winning outcome that is associated with a type of award. In addition, the award module 194 may compare the game outcome with each received wager to determine if an award is provided to a player as a function of the game outcome, the corresponding game rule, and the corresponding wager.

In the illustrated embodiment, during each game, the game module 192 determines an outcome of each game 124 and transmits the game outcomes to the award module 194 including an identification of one or more players achieving a winning player hand. The award module 194 responsively provides an award to each identified player determined as a function of a wager received from the player. In one embodiment, the game module 192 may determine a value of the winning player hand and transmit the determined player hand value to the award module 194. The award module 194 may compare the game outcome including the value of the player hand with winning combinations stored in a winning combination table to determine if the player hand value and/or game outcome matches a winning outcome that is associated with a type of award.

The RNG module 186 generates and outputs random numbers to the game module 192 for use in playing the game 124. In addition, the game module 192 may use random numbers generated by the RNG module 186 to determine if a winning condition has occurred in the outcome of the game, and to determine whether or not to provide an award to a player. For example, in one embodiment, the game module 192 may use the RNG module 186 to randomly select one or more playing cards to be included in a deck of playing cards, and to randomly select one or more playing cards from the deck to form a corresponding player hand and/or a dealer hand, respectively. In one embodiment, the game module 192 may randomly select an additional playing card to be included in a player hand being dealt by the live dealer. In addition, the game module 192 may allow a player to request a randomly selected player hand to be played in the game in addition to the player hand being dealt by the dealer and/or to replace the player hand being dealt by the dealer.

Figure 24:
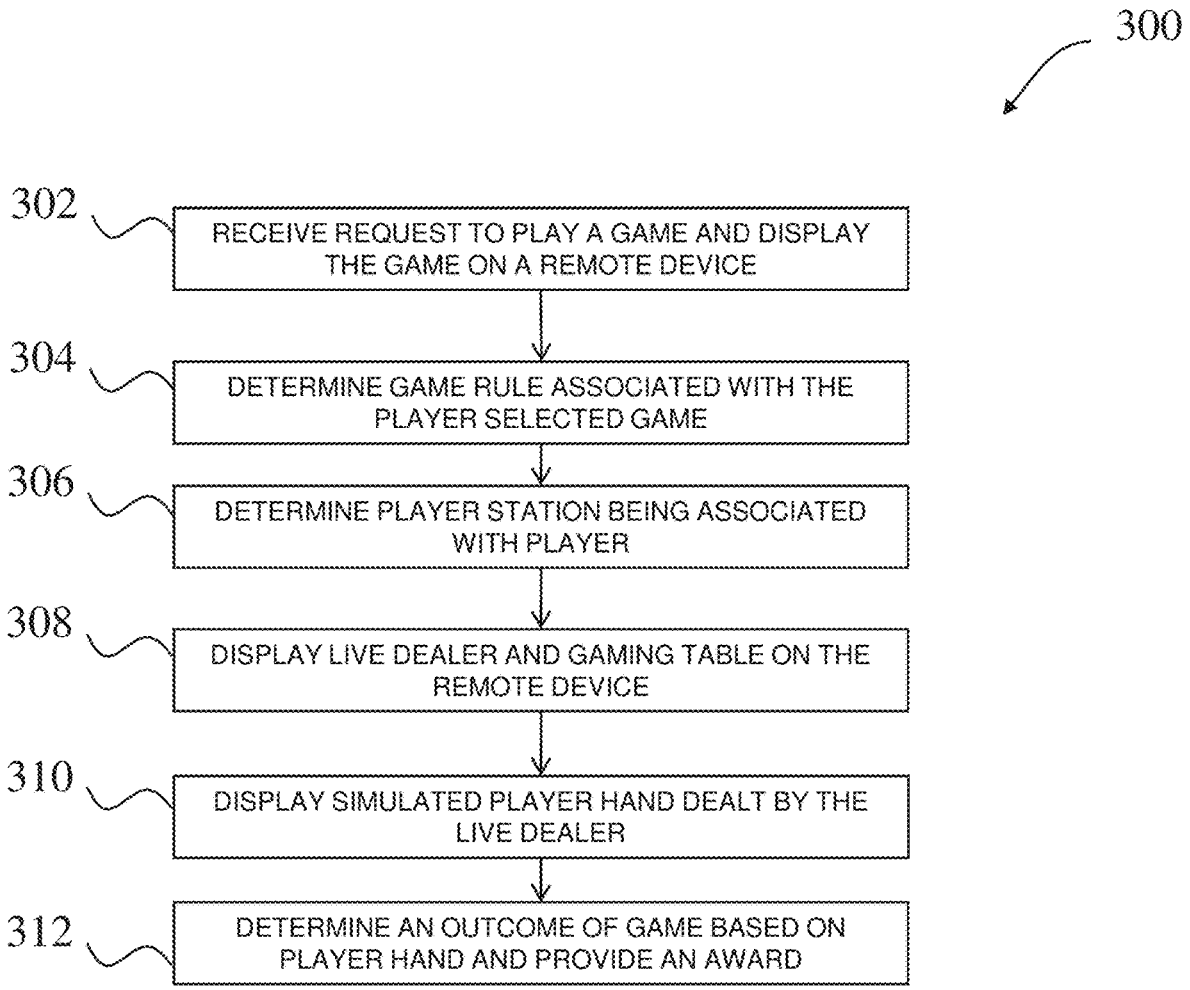
FIG. 24 is a flowchart of a method that may be used with the system shown in FIGS. 1, 21, and 22 for allowing a player to play a live remote dealer game via a remote device, according to an embodiment of the invention.

FIG. 24 is a flowchart of a method 300 that may be used with the system 100 for allowing a player to play games including a live dealer via a remote device. Each method step may be performed independently of, or in combination with, other method steps. Portions of the method 300 may be performed by any one of, or any combination of, the components of the system 100. FIGS. 1A and 2A are exemplary entertaining graphical displays of games that may be played with the system 100. In the illustrated embodiment, entertaining graphical displays for amusement purposes are presented by the remote devices 122 via the display device 136 (shown in FIGS. 1 and 21) and may receive input (e.g., selections and/or entries) via the user input device 138 (shown in FIGS. 1 and 21). For example, in one embodiment, a selection may be received via the user input device 138 of the remote device 122 and may be transmitted by the remote device 122 to the server system 120 via the network 130.

In the illustrated embodiment, in the method step 302, the gaming controller 140 receives a request from a player to play a game and responsively displays the game on a corresponding remote device 122. In addition, the gaming controller 140 may retrieve a plurality of games from the game list 170 included in the database 150 and display the plurality of games on the remote device 122 to enable the player to select one or more games from the list of games. In one embodiment, a player may submit the request by accessing a website via the communications server 142. In another embodiment, the player may access a mobile website via the cellular network 132. In addition, in one embodiment, the method step 302 may include receiving, by the gaming controller 140, a unique user identifier to validate the request to display the game 124. More specifically, the display module 184 may display a login screen (not shown) on the remote device 122 to request the unique user identifier such as, for example, requesting a username and/or password. The gaming controller 140 may receive the unique user identifier and transmit a validation request including the user credentials to the user profile server 144. The user profile server 144 may compare the received unique user identifier with the collection of unique user identifier contained in the user profile program to validate the unique user identifier and responsively send a validation message to the gaming controller 140 if the received unique user identifier is included in the user profile program. Upon receiving the validation message from the user profile server 144 the gaming controller 140 may display the game 124. In addition, in one embodiment, if the received user identifier is not included in the user profile program, the gaming controller 140 may prompt the user to establish a user account and/or display the game 124 without requiring the user to establish a user account and/or verify a user account. In addition, in one embodiment, method step 302 may also include receiving a wager from the player and/or receiving a request to purchase a play of the game with game credits from the corresponding user profile account.

In method step 304, the gaming controller 140 determines a game rule being associated with the player selected game and displays a game screen 180 on the remote device 122 including the selected game having the associated game rule. In one embodiment, the gaming controller 140 receives a signal indicative of the selected game from the remote device 122, determines a game rule continued in the database 150 and being associated with the selected game, determines the game attributes associated with the corresponding game rule, and displays the game screen 180 with the corresponding game attributes.

In method step 306, the gaming controller 140 selects a player station 164 included in a live gaming table 156 and associates the selected player station 164 with the selected game. For example, in one embodiment, the system 100 may include a gaming table 156 having a plurality of player stations 164 for use in playing a game. Upon receiving a request from a player, the gaming controller 140 may determine a number of player stations 164 that are available and/or not currently assigned to another game, and assign one of the available player stations 164 to the player and/or game. Moreover, the system 100 may include a plurality of gaming tables 156, and the gaming controller 140 may determine one or more gaming tables 156 and/or one or more player stations 164 that may be available for play, and assign the player and/or game to a corresponding player station 164. In one embodiment, the gaming controller 140 may transmit a request to the casino table management server 174 including a request for an available gaming table 156 and/or player station 164. In addition, the gaming controller 140 may receive a response from the casino table management server 174 including a notification indicative of an available gaming table 156 and/or player station 164. Upon receiving the response from the casino table management server 174, the gaming controller 140 may associate the game with the identified player station 164.

In one embodiment, the gaming controller 140 may associate a plurality of player stations 164 to a remote device 122 to enable a player to simultaneously play a plurality of games on the remote device 122 with the same gaming table 156 and live dealer 158. Moreover, the gaming controller 140 may receive a request from a player to play a plurality of games via a remote device 122, and assign a player station 164 on the gaming table 156 to each game being selected by the player.

In method step 308, the gaming controller 140 displays a game screen 180 including the selected game 124, a live dealer 158, and the corresponding gaming table 156 including the associated player station 164. In the illustrated embodiment, the gaming controller 140 displays the game screen 180 including the dealer display area 224 and the player display area 226. The dealer display area 224 includes video images of the dealer 158 and the gaming table 156 being received from the audio/video server 148. The player display area 226 includes images and symbols indicative of the game 124 and the associated game rule. Images and symbols being associated with a game rule may include, but are not limited to, a logo, a game denomination, card symbols, available wagers, and/or wagering chips associated with the game 124. In addition, the player display area 226 may include images of simulated playing cards 228 being distributed to the corresponding player station 164 and simulated wagering chips that may be indicative of current wagers being placed during the game 124. In one embodiment, the player display area 226 may include one or more simulated player stations that are associated with different players and/or different games to allow a current player to view wagers and/or player hands being distributed to the other player stations 164 by the live dealer 158. In one embodiment, each simulated player station being displayed in the player display area 226 is associated with the same gaming table 156 and live dealer 158.

In method step 310, gaming controller 140 receives a signal indicative of a physical player hand 196 being dealt by the live dealer 158 and displays a corresponding simulated player hand 232 on the remote device 122. Moreover, in one embodiment, the gaming controller 140 receives a signal from the card reader device 176 indicative of the physical playing cards being dealt by the dealer 158, determines a player hand 196 and/or player station 164 receiving the playing card, and displays a simulated image of the playing card in the player display area 226.

In method step 312, the gaming controller 140 determines an outcome of the game 124 as a function of the player hand 196 being associated with the corresponding player station 164 and/or the game, and provides an award to the player as function of the player hand 196 and the corresponding game rule associated with the game 124. In one embodiment, the gaming controller 140 may also receive a signal indicative of a dealer hand 234 being dealt by the dealer 158, and determine an outcome of the game as a function of the dealer hand 234 and the player hand 196.

Figure 27:
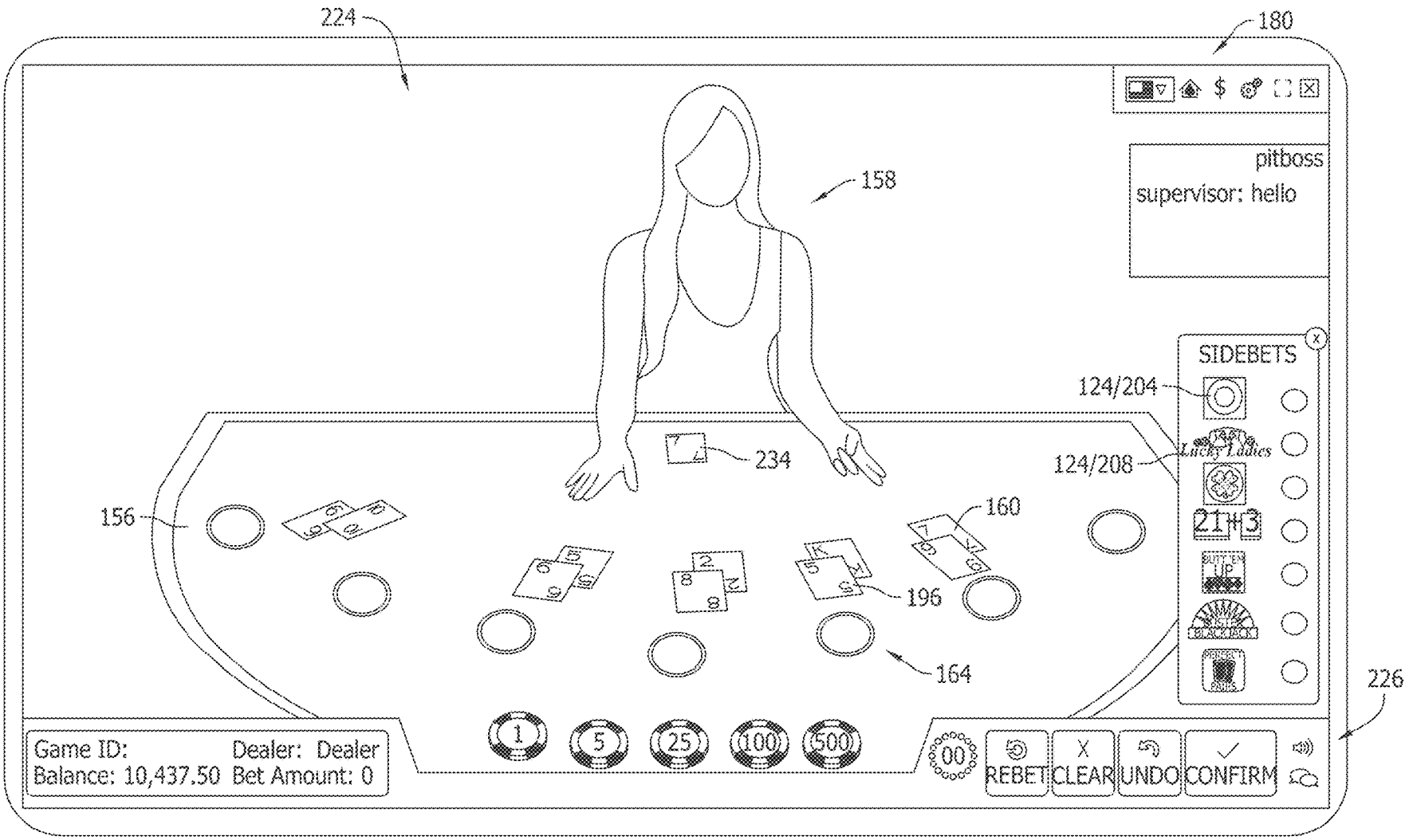
FIGS. 27-29 are graphical displays of a live remote dealer game that may be displayed with the system shown in FIG. 1.
Figure 28:
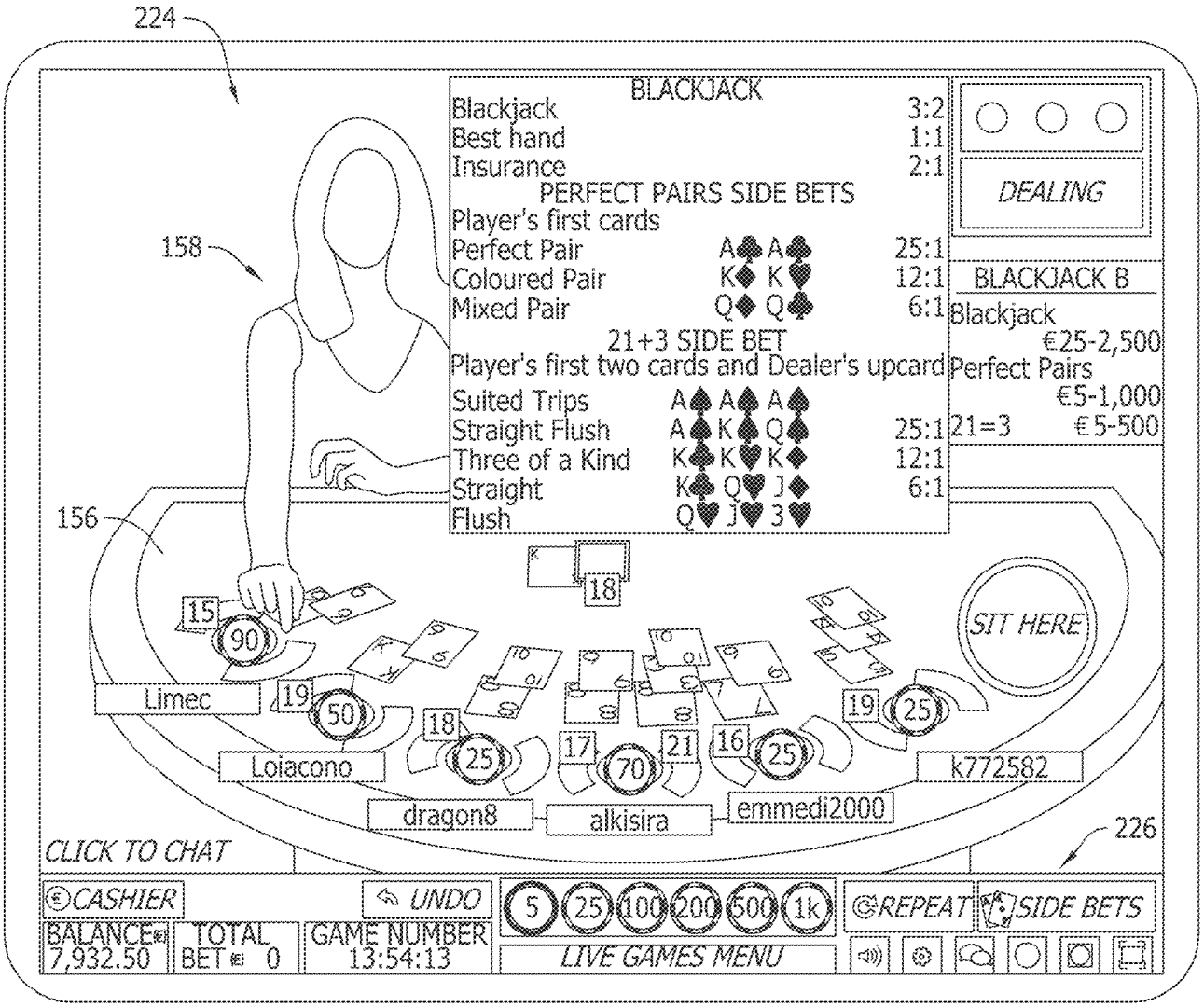
Figure 29:
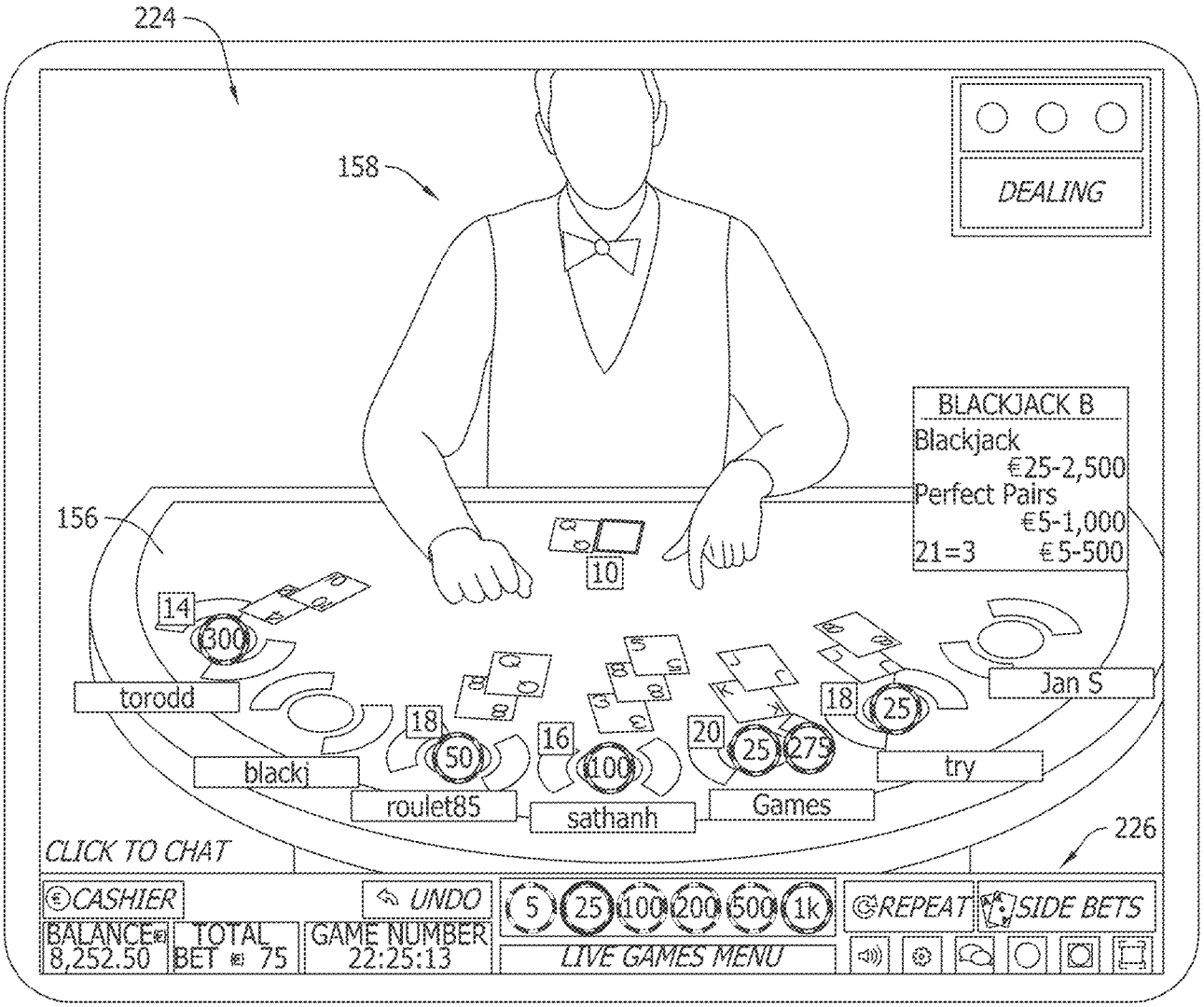

Referring to FIGS. 27-29, in one embodiment, the gaming controller 140 may allow a player to select a plurality of games to be played using the associated player hand 196, and determine an outcome of each player selected game 124 as a function of the player hand 196 and the corresponding game rules. For example, in one embodiment, the gaming controller 140 may display a plurality of side-bets 124 that may be selected by the player to be played using the associated player hand 196. As the dealer 158 distributes the dealer hand 234 and the player hand 196, the gaming controller 140 may determine the outcome of each player selected side-bet 124 as a function of the playing cards 160 being included in the dealer hand 234 and/or the player hand 196.

In addition, in one embodiment, the gaming controller 140 may assign a plurality of players to the same player station 164 and allows each of the players to select and play a different game with the player hand 196 being dealt to the player station 164. For example, the gaming controller 140 may assign a first player, e.g. a primary player, to the player station 164 and assign a plurality of second players, e.g. secondary players, to the same player station 164. The gaming controller 140 may also allow the primary player and the secondary players to each select one or more games to be played. For example, each secondary player may select one or more side bets to be played with the corresponding player hand 196.

Moreover, the gaming controller 140 may also allow the primary player to make selections and/or decisions associated with the playing cards 160 being dealt to the corresponding player hand 196 based on game rules associate with the game being played by the primary player. The gaming controller 140 may also determine an outcome of each game being played by each of the secondary player based on the playing cards being dealt to the player hand 196 and/or the dealer hand 234, thus allowing each of the secondary players to play games with the player hand 196 without allowing the secondary players to influence the number of playing cards 160 distributed to the corresponding player hand 196.

Figure 25:
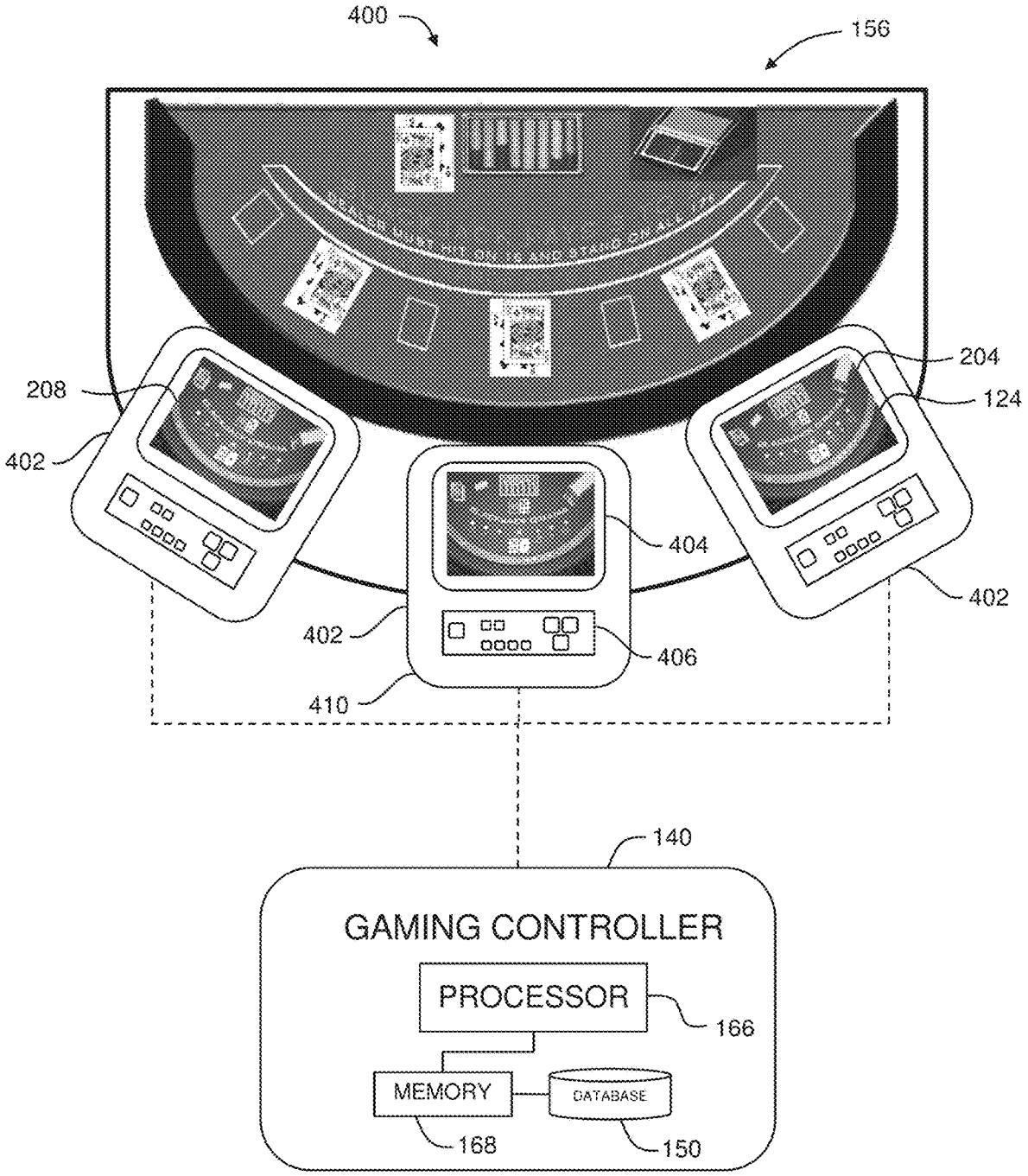
FIG. 25 is another schematic representation of the system shown in FIG. 1, according to an embodiment of the invention.
Figure 26:
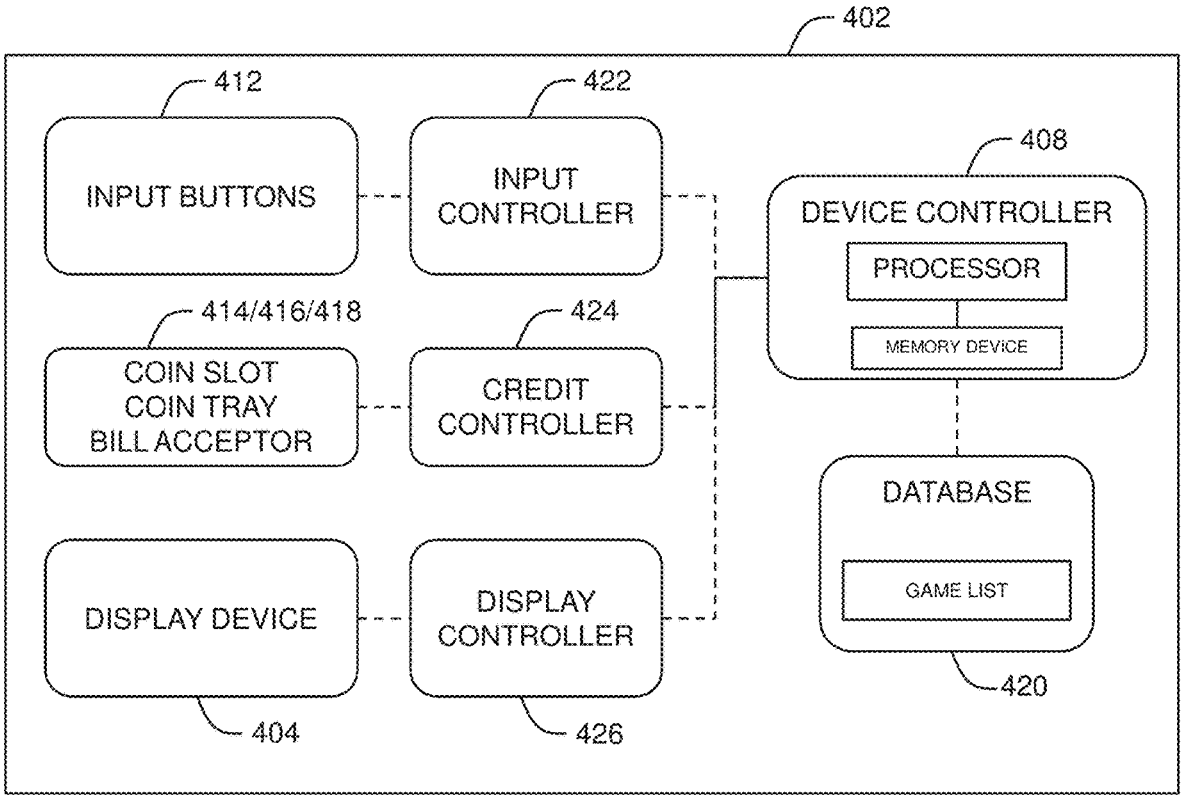
FIG. 26 is a schematic view of a gaming device that may be used with the system shown in FIG. 25.

FIG. 25 is a schematic view of another system 400 for allowing a player to play a plurality of games with a live dealer. FIG. 26 is a schematic illustration of a gaming device 402 that may be used with the system 400. In the illustrated embodiment, the system 400 includes a gaming table 156 and a plurality of gaming devices 402 that are associated with the gaming table 156. In a preferred embodiment, the gaming table 156 and gaming devices 402 are located within a casino property. The gaming table 156 includes a plurality of player stations 164. Each player station 164 is associated with a corresponding gaming device 402.

In the illustrated embodiment, the gaming device 402 includes a display device 404 such as, for example display device 136 for displaying a plurality of games, a user input device 406 to enable a player to interface with the gaming device 402, and a device controller 408 that is operatively coupled to the display device 404 and the user input device 406 to enable a player to play games displayed on the display device 404. The gaming device 402 may also include a housing assembly 410 that is configured to support the display device 404, the user input device 406, and/or the device controller 408 from a supporting surface.

The display device 404 and the user input device 406 are coupled to the housing assembly 410 and are accessible by the player. In one embodiment, the device controller 408 is positioned within the housing assembly 410. Alternatively, the device controller 408 may be separated from the housing assembly 410, and connected to components of the gaming device 402 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 404 displays the game screen 180 (shown in FIGS. 1A-20B) including indicia and/or symbols for use in a game, e.g., symbols for a bingo game, cards used by a card game, roulette wheel and symbols used in a roulette game, and/or reels used in a reel game.

The user input device 406 includes a plurality of input buttons 412, a coin slot 414, a bill acceptor 416, and a coin tray 418 for dispensing coins to the player. In one embodiment, the input buttons 412 may include a plurality of BET switches for inputting a wager on a game and selecting a number of rounds to be played during a gaming session, a plurality of selection switches for allowing a player to select a plurality of game symbols, a CLEAR switch for deselecting player selected game symbols, a PAYOUT switch for ending a gaming session and dispensing accumulated game credits to the player, and a start button, i.e., a DEAL switch to initiate an output of a game. In addition, the user input device 406 may include, for example, a keyboard, a pointing device, a mouse, a stylus, a touch sensitive panel (e.g., a touch pad or a touch screen), a gyroscope, an accelerometer, a position detector, an audio input device, and/or any suitable input device that enables the player to interact with the gaming device 402.

The coin slot 414 includes an opening that is configured to receive coins and/or tokens deposited by the player into the gaming device 402. The gaming device 402 converts a value of the coins and/or tokens to a corresponding amount of game credits that are used by the player to wager on games played on the gaming device 402. The bill acceptor 416 includes an input and output device that is configured to accept a bill, a ticket, and/or a cash card into the gaming device 402 to enable an amount of game credits associated with a monetary value of the bills, ticket, and/or cash card to be credited to the gaming device 402.

Referring to FIG. 26, in the illustrated embodiment, the gaming device 402 includes the device controller 408, a database 420, an input controller 422, a credit controller 424, and a display controller 426. The device controller 408 communicates to the database 420, the input controller 422, the credit controller 424, and the display controller 426, and executes various programs, and thereby controls other components of the gaming device 402 according to player instructions and data accepted by the user input device 406 and instructions received from the gaming controller 140. The device controller 408 in particular executes a game program to implement the method 300 and thereby conducts a game in accordance with the embodiments described herein. In addition, the device controller 408 may receive instructions from the gaming controller 140 and execute the game program to implement the method 300 in response to the received instructions. In one embodiment, the device controller 408 utilizes RAM to temporarily store programs and data necessary for the progress of the game, and EPROM to store, in advance, programs and data for controlling basic operation of the gaming device 402, such as the booting operation thereof.

The credit controller 424 manages the amount of player's credits, which is equivalent to the amount of coins and bills counted and validated by the bill acceptor 416. The credit controller 424 converts a player's credits to coins, bills, or other monetary data by using the coin tray 418 and/or for use in dispensing a credit voucher via the bill acceptor 416.

The input controller 422 is coupled to the user input device 406 to monitor player selections received through the input buttons 412, and accept various instructions and data that a player enters through the input buttons 412.

The display controller 426 controls the display device 404 to display various images on screens preferably by using computer graphics and image data stored in the database 420.

In the illustrated embodiment, the gaming controller 140 is coupled to each of the gaming devices 402 to enable a player to play one or more games on each of the gaming device 402 with the live dealer. In one embodiment, the system 400 may also include the image broadcast system 162 and/or the audio/video server 148 for displaying images of the gaming table 156 and/or the live dealer 158 on each of the gaming devices 402. In addition, the system 400 may also include the card reader device 176 for transmitting data indicative of the player cards being dealt by the live dealer to the gaming controller 140 for use in playing the games on each of the gaming devices 402.

In the illustrated embodiment, the gaming devices 402 and the gaming controller 140 are coupled in communication with a local area network (LAN). Alternatively, the gaming devices 402 and the gaming controller 140 may be coupled via a network such as, for example, an Internet link, an intranet, a WAN, dial-in-connections, cable modems, wireless modems, and/or ISDN lines. In one embodiment, the gaming controller 140 may be implemented by one of the device controllers 408 associated with a gaming device 402. In still another embodiment, the gaming controller 140 may be located remotely with respect to gaming devices 402, or within one of the housing assemblies 410.

Exemplary embodiments of a system and method of allowing a player to play a plurality of games with a live remote dealer are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other wagering applications.

Additionally, in the above embodiments, the display screen includes one or more live video images and a graphical display. Various features are described with respect to the graphical display. However, the graphical display and the live video image(s) may be combined into a composite image comprised of one or more video images and graphical elements overlaid thereon which may be selectable and/or manipulated by the player to perform similar functions as described above.

Obviously, many modifications and variations of the present invention are possible in light of the above teachings. Different features of the invention are discussed above and shown in the FIGS. It should be noted that the individual features described above and in the drawings may be combined in different combinations then specifically discussed. The invention may be practiced otherwise than as specifically described above.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A networked computer system for allowing players to play a plurality of games, comprising:

a video imaging device configured to capture video images of a physical gaming table including a plurality of player stations and a live dealer distributing physical playing cards to one or more of the player stations;

a memory device including a plurality of paytables, each paytable being associated with a different game; and a server computer coupled to a plurality of remote computing devices for hosting a website associated with the plurality of games, the server computer including a processor programmed to:

allow a first player to select a first game from the plurality of games;

receive a request from the first player via a first remote computing device to play the first game and display a first webpage on the first remote computing device including a game screen displaying an image of a simulated gaming table associated with the first game and the captured video image of the physical gaming table and the live dealer;

assign a first player station of the physical gaming table to the first remote computing device and select a first paytable associated with the first game;

display a first plurality of sidebets on the game screen, each sidebet being associated with a different paytable;

receive a player's selection of at least one sidebet from the first plurality of sidebets and select a first sidebet paytable associated with the selected at least one sidebet from the plurality of paytables;

detect an initiation of game play including a first player hand being distributed by the live dealer and receive a signal indicative of a first player hand being dealt by the live dealer to the first player station; and determine an outcome of the first game as a function of the first player hand and provide a primary award to the first player as a function of the first paytable and a secondary award to the first player as a function of the selected first sidebet paytable, the processor of the server computer further being programmed to:

allow a second player to select a second game to play from the plurality of games;

receive a request from the second player via a second remote computing device to play the second game and display a second webpage on the second remote computing device including a game screen displaying an image of the simulated gaming table associated with the second game and the captured video image of the physical gaming table and the live dealer;

assign a second player station of the physical gaming table to the second remote computing device and select a second paytable associated with the second game;

display a second plurality of sidebets on the game screen, each sidebet in the second plurality of sidebets being associated with a different paytable, wherein the first plurality and second plurality of sidebets includes at least one different sidebet;

receive a second player's selection of at least one sidebet from the second plurality of sidebets and select a second sidebet paytable associated with the selected at least one sidebet from the plurality of paytables;

detect an initiation of game play including a second player hand being distributed by the live dealer and receive a signal indicative of a second player hand being dealt by the live dealer to the second player station; and determine an outcome of the second game as a function of the second player hand and provide a primary award to the second player as a function of the second paytable and a secondary award as a function of the selected sidebet paytable, wherein the first and second player hands are dealt by the live dealer in a common hand.

2. The networked computer system of claim 1, wherein the processor is programmed to determine the outcome of the first game as a function of a first game rule and determine the outcome of the second game as a function of a second game rule that is different than the first game rule.

3. The networked computer system of claim 2, wherein the selected sidebet paytable associated with the first game is the same as the second paytable associated with the second game.

4. The networked computer system of claim 1, wherein the processor is programmed to:

receive a signal indicating a dealer hand being dealt by the live dealer;

determine the first outcome of the first game as a function of the dealer hand, the first player hand, and the first game rule; and determine the second outcome of the second game as a function of the dealer hand, the second player hand, and the second game rule.

5. The networked computer system of claim 1, wherein the processor is programmed to display simulated images of the first player hand and the second player hand on the simulated gaming table displayed on the first webpage.

6. The networked computer system of claim 5, wherein the processor is programmed to display the simulated images of the second player hand indicating a game rule being used to determine an outcome of the second game.

7. The networked computer system of claim 1, wherein the processor is programmed to conduct the first game and the second game at the same time.

8. The networked computer system of claim 1, wherein, the first paytable is different than the selected sidebet paytable.

9. One or more non-transitory computer-readable storage media, having computer-executable instructions embodied thereon, wherein when executed by at least one processor, the computer-executable instructions cause the at least one processor to:

allow a first player to select a first game from a plurality of games;

receive, from a video imaging device, video images of the physical gaming table including the plurality of player stations and the live dealer distributing physical playing cards to one or more of the player stations;

receive a request from the first player via a first remote computing device to play the first game and display a first webpage on the first remote computing device including a game screen displaying an image of a simulated gaming table associated with the first game and the captured video image of the physical gaming table and the live dealer;

assign a first player station of the physical gaming table to the first remote computing device and select a first paytable associated with the first game;

display a first plurality of sidebets on the game screen, each sidebet being associated with a different paytable;

receive a first player's selection of at least one sidebet from the first plurality of and select a first sidebet paytable associated with the selected at least one sidebet from a plurality of paytables;

detect an initiation of game play including a player hand being distributed by the live dealer and receive a signal indicative of a first player hand being dealt by the live dealer to the first player station;

determine an outcome of the first game as a function of the first player hand and provide a primary award to the first player as a function of the first paytable and a secondary award to the first player as a function of the selected first sidebet paytable;

allow a second player to select a second game to play from the plurality of games;

receive a request from the second player via a second remote computing device to play the second game and display a second webpage on the second remote computing device including a game screen displaying an image of the simulated gaming table associated with the second game and the captured video image of the physical gaming table and the live dealer;

assign a second player station of the physical gaming table to the second remote computing device and select a second paytable associated with the second game;

display a second plurality of sidebets on the game screen, each sidebet in the second plurality of sidebets being associated with a different paytable, wherein the first plurality and second plurality of sidebets includes at least one different sidebet;

receive a second player's selection of at least one sidebet from the second plurality of sidebets and select a second sidebet paytable associated with the selected at least one sidebet from the plurality of paytables;

detect an initiation of game play including a second player hand being distributed by the live dealer and receive a signal indicative of a second player hand being dealt by the live dealer to the second player station; and determine an outcome of the second game as a function of the second player hand and provide a primary award to the second player as a function of the second paytable and a secondary award as a function of the selected sidebet paytable, wherein the first and second player hands are dealt by the live dealer in a common hand.

10. The one or more computer-readable storage media according to claim 9, wherein when executed by at least one processor, the computer-executable instructions cause the at least one processor to determine the outcome of the first game as a function of a first game rule and determine the outcome of the second game as a function of a second game rule that is different than the first game rule.

11. The one or more computer-readable storage media according to claim 10, wherein the selected sidebet paytable associated with the first game is the same as the second paytable associated with the second game.

12. The one or more computer-readable storage media according to claim 9, wherein when executed by at least one processor, the computer-executable instructions cause the at least one processor to:

receive a signal indicating a dealer hand being dealt by the live dealer;

determine the first outcome of the first game as a function of the dealer hand, the first player hand, and the first game rule; and determine the second outcome of the second game as a function of the dealer hand, the second player hand, and the second game rule.

13. The one or more computer-readable storage media according to claim 9, wherein when executed by at least one processor, the computer-executable instructions cause the at least one processor to display simulated images of the first player hand and the second player hand on the simulated gaming table displayed on the first webpage.

14. The one or more computer-readable storage media according to claim 13, wherein when executed by at least one processor, the computer-executable instructions cause the at least one processor to display the simulated images of the second player hand indicating a game rule being used to determine an outcome of the second game.

15. The one or more computer-readable storage media according to claim 9, wherein when executed by at least one processor, the computer-executable instructions cause the at least one processor to conduct the first game and the second game at the same time.

16. The one or more computer-readable storage media according to claim 9, wherein the first paytable is different than the selected sidebet paytable.

17. A method of operating a networked computer system including a server computer and a video imaging device, the video imaging device configured to capture video images of a physical gaming table including a plurality of player stations and a live dealer distributing physical playing cards to one or more of the player stations, the method including a processor of the server computer executing the steps of:

allowing a first player to select a first game from a plurality of games;

receiving a request from a first player via a first remote computing device to play the first game and displaying a first webpage on the first remote computing device including a game screen displaying an image of a simulated gaming table associated with the first game and the captured video image of the physical gaming table and the live dealer;

assigning a first player station of the physical gaming table to the first remote computing device and selecting a first paytable associated with the first game;

displaying a first plurality of sidebets on the game screen, each sidebet being associated with a different paytable;

receiving a player's selection of at least one sidebet and selecting a sidebet paytable associated with the selected at least one sidebet from a plurality of paytables;

detecting an initiation of game play including a player hand being distributed by the live dealer and receiving a signal indicative of a first player hand being dealt by the live dealer to the first player station;

determining an outcome of the first game as a function of the first player hand and providing a primary award to the first player as a function of the first paytable and a secondary award to the first player as a function of the selected first sidebet paytable;

allowing a second player to select a second game to play from the plurality of games;

receiving a request from the second player via a second remote computing device to play the second game and displaying a second webpage on the second remote computing device including a game screen displaying an image of the simulated gaming table associated with the second game and the captured video image of the physical gaming table and the live dealer;

assigning a second player station of the physical gaming table to the second remote computing device and selecting a second paytable associated with the second game;

displaying a second plurality of sidebets on the game screen, each sidebet in the second plurality of sidebets being associated with a different paytable, wherein the first plurality and second plurality of sidebets includes at least one different sidebet;

receiving a second player's selection of at least one sidebet from the second plurality of sidebets and selecting a second sidebet paytable associated with the selected at least one sidebet from the plurality of paytables;

detecting an initiation of game play including a second player hand being distributed by the live dealer and receiving a signal indicative of a second player hand being dealt by the live dealer to the second player station; and determining an outcome of the second game as a function of the second player hand and providing a primary award to the second player as a function of the second paytable and a secondary award as a function of the selected sidebet paytable, wherein the first and second player hands are dealt by the live dealer in a common hand.

* * * * *